US005761873A

United States Patent [19]

Slater

[11] Patent Number: 5,761,873

[45] Date of Patent: Jun. 9, 1998

[54] WEB, BEAM AND FRAME SYSTEM FOR A BUILDING STRUCTURE

[76] Inventor: Jack Slater, 98 Dunedin Drive, Etobicoke, Ontario, Canada, M8X 2K5

[21] Appl. No.: 403,181

[22] Filed: Sep. 12, 1994

Related U.S. Application Data

[63] Continuation of Ser. No. 144,616, Nov. 1, 1993, abandoned, which is a continuation of Ser. No. 681,064, Apr. 5, 1991.

[51] Int. Cl.[6] ..... E04C 3/02

[52] U.S. Cl. ..... 52/693; 52/694; 52/696; 52/633

[58] Field of Search ..... 52/633, 693, 694, 52/695, 696

[56] References Cited

U.S. PATENT DOCUMENTS

| | | | |
|---|---|---|---|
| 2,152,189 | 3/1939 | Henderson | 52/693 |
| 3,078,970 | 2/1963 | Black | 52/693 |
| 3,131,791 | 5/1964 | Davis et al. . | |
| 3,826,057 | 7/1974 | Franklin | 52/693 X |
| 4,002,116 | 1/1977 | Knowles . | |
| 4,078,352 | 3/1978 | Knowles . | |
| 4,102,108 | 7/1978 | Cody | 52/693 |
| 4,200,946 | 5/1980 | Lawrence | 52/693 X |
| 4,207,719 | 6/1980 | Knowles . | |
| 4,308,703 | 1/1982 | Knowles . | |
| 4,349,996 | 9/1982 | Lautensleger et al. | 52/693 X |
| 4,435,940 | 3/1984 | Davenport et al. . | |
| 4,485,606 | 12/1984 | Gottlieb | 52/693 X |
| 4,501,102 | 2/1985 | Knowles . | |
| 4,546,591 | 10/1985 | Beltz | 52/693 X |
| 4,548,014 | 10/1985 | Knowles . | |
| 4,637,194 | 1/1987 | Knowles . | |
| 4,831,797 | 5/1989 | Vladikovic | 52/693 X |
| 4,982,545 | 1/1991 | Stromback . | |
| 4,986,051 | 1/1991 | Meyer et al. | 52/693 X |
| 5,003,748 | 4/1991 | Carr | 52/693 |
| 5,120,378 | 6/1992 | Porter et al. . | |
| 5,457,927 | 10/1995 | Pellock et al. | 52/693 X |

FOREIGN PATENT DOCUMENTS

| | | | |
|---|---|---|---|
| 374316 | 6/1990 | European Pat. Off. . | |
| 7404716 | 10/1974 | Netherlands . | |
| 8005455 | 5/1980 | Netherlands . | |
| 8005455 | 10/1980 | Netherlands | 52/693 |
| 8005455 | 5/1982 | Netherlands . | |
| 847377 | 9/1960 | United Kingdom . | |

OTHER PUBLICATIONS

Promotional Material of SPACEJOIST™ (undated). Two sheets of product literature bearing a copyright notice dated 1976 describing the SPACEJOIST™ system.

*Primary Examiner*—Wynn E. Wood
*Attorney, Agent, or Firm*—Blake, Cassels & Graydon

[57] ABSTRACT

A self-jigging web for fastening two steel chords together to form a beam. There are different sizes of webs for assembly of beams of different depths. A web has several holes for locating screws for fastening the web to a pair of chords parallel to each other. Chords having the same outer cross-section but of different steel gauges are used to obtain beams of different strengths. Assembled beams are used in a frame of a building structure such as a wall, floor or ceiling. A system is provided such that a building designer, given the wind bearing (bending) and axial loads required to be borne by the structure, can determine beam spacing and beam depth required for the structure to bear the loads. Beams are then assembled to meet the determined requirements according to a standard set of instructions which detail the chord steel gauge, size of web, number and spacing of webs lengthwise along a beam, and a number and placement of screws for fastening each web to a pair of chords.

8 Claims, 29 Drawing Sheets

18 SCREWS code reference No. 5

12 SCREWS code reference No. 4

9 SCREWS code reference No. 3

6 SCREWS code reference No. 2

3 SCREWS code reference No. 1

8 SCREWS code reference No. 4

4 SCREWS code reference No. 2

2 SCREWS code reference No. 1

WEB, BEAM AND FRAME SYSTEM FOR A BUILDING STRUCTURE

This application is a continuation of application Ser. No. 08/144,616, filed Nov. 1, 1993, now abandoned which is a continuation of application Ser. No. 07/681,064, filed Apr. 5, 1991.

FIELD OF THE INVENTION

The present invention relates to a beam for use in a frame for building structures such as walls, floors, etc., the beam having a pair of spaced apart chords joined by webs. In its various aspects the invention concerns the web which joins the chords; the assembled beam; the frame including such beams; and methods for assembling the beam and frame.

BACKGROUND OF THE INVENTION

There is a variety of approaches currently taken to the construction of frames for building structures such as walls, floors, ceilings, etc. One example, a wood beam used as a stud, joist, etc., is still in common use. Wood is becoming increasingly expensive and should be treated to prevent rot and possible insect infestation. Wood may also warp and may be of inconsistent quality. A general characteristic of a wood beam is that a beam of given dimensions has particular load bearing characteristics, and increasing the load bearing characteristics of a frame constructed of wood beams generally requires using a greater number of beams or beams of increased cross-dimension. Wood, being a solid material, also requires holes to be drilled for the passage of concealed wires, etc., through the beams of a floor, or wall. Wood beams nevertheless have an advantage of being easily cut to fit a particular application, although a certain amount of pre-fabrication of wooden building frames has become common.

In any case, when designing a building structure an architect (or designer) determines the load which the structure is required to bear. Load bearing beams are selected from those available, consideration being given to material characteristics such as weight, cost, beam spacing and dimension required to bear the required load, etc. An architect is limited by these considerations. For example, an architect may prefer to use 6" deep wood joists in a floor, but finds that to meet the determined load requirement, the joists must be spaced no more than 14" apart. Standard subflooring materials require joists spaced at 48" intervals. A common solution to this problem would be simply overbuild the floor by using the 6" deep wooden joists spaced 12" apart. This would result in the use of more material and labor necessary than to simply meet the determined load bearing capacity. An alternative solution might be to use 8" deep wooden joists spaced 16" apart, but this changes the depth, i.e. thickness of the floor which may be undesirable or even not possible within the constraints of a particular situation. In any event, it might still lead to an overbuilt floor. It would thus be advantageous to have a beam for use in a building structure which beam permits the load bearing capacity of the structure to be conveniently tailored to a particular situation without necessarily requiring alteration of the beam dimension or spacing. Such a beam would provide a structure having material and labor costs more commensurate with the load bearing requirements of the structure.

BRIEF SUMMARY OF THE INVENTION

The approach of the present invention is to provide a frame in which load bearing members, i.e. beams, are tailored such that the load requirements of a particular structure are met. Each beam is assembled to include a pair of component chords and webs and fasteners, which components are selected from a set of standard chords, webs and fasteners according to a recipe. Given the load bearing requirements of a structure, the recipe indicates beam spacing within the frame, the type of chord, the type of web and number of webs and the number and positions of fasteners to be included in each beam.

The present invention thus provides, in one aspect, a beam kit of parts. The kit includes standard chords, webs and fasteners. These are assembled into beams according to a recipe and included in the frame of a structure having a required load-bearing capacity according to predetermined criteria. The recipe for beam assembly indicates which type of the standard chords to include in each beam, the number of webs to be included and the number and configuration of fasteners to be used in fastening the webs and chords together. The predetermined criteria indicate the spacing of beams necessary for the requried load bearing capacity of the structure.

According to a preferred embodiment, the set of standard chords include hollow metal chords having the same outer cross-section but of a variety of metal gauges. Preferably the webs are also of metal and are shaped to provide a pair of jigs which pre-locate the chords parallel to each other prior to installation of fasteners. Webs are preferably dimensioned such that an assembled beam is of a depth which may be used with conventional building materials. Preferably, each web also has a plurality of holes which are also pre-located by the jigs with respect to the chords for installation of the fasteners through the holes and into the chords.

The present invention also includes methods for assembling beams and constructing frames including the beams.

A method for assembling a beam for use as part of a frame of a building structure having a required load bearing capacity includes selecting a combination of chords and webs according to a recipe; positioning a first web and chord in a predetermined position; fastening the web and chord according to a recipe indicating the number of fasteners to be used; positioning a second chord in a position parallel to the first chord and for fastening to the web; fastening the second chord and web together according to a recipe indicating the number of fasteners to be used. The preceding positioning and fastening steps are carried out again for all of the webs selected in the first step.

A method for constructing a frame for a load-bearing building structure includes determining the load required to be borne by the structure; determining beam spacing and beam dimensions required for the frame to bear the load according to predetermined criteria; assembling beams by fastening together standard chords and webs according to a recipe indicating a number of webs and the types of web and chord to be included in each beam, and a number of fasteners for fastening each web to each chord; and incorporating so assembled beams as part of the frame to have the determined spacing.

DETAILED DESCRIPTION OF PREFERRED EMBODIMENTS

Figure 1:
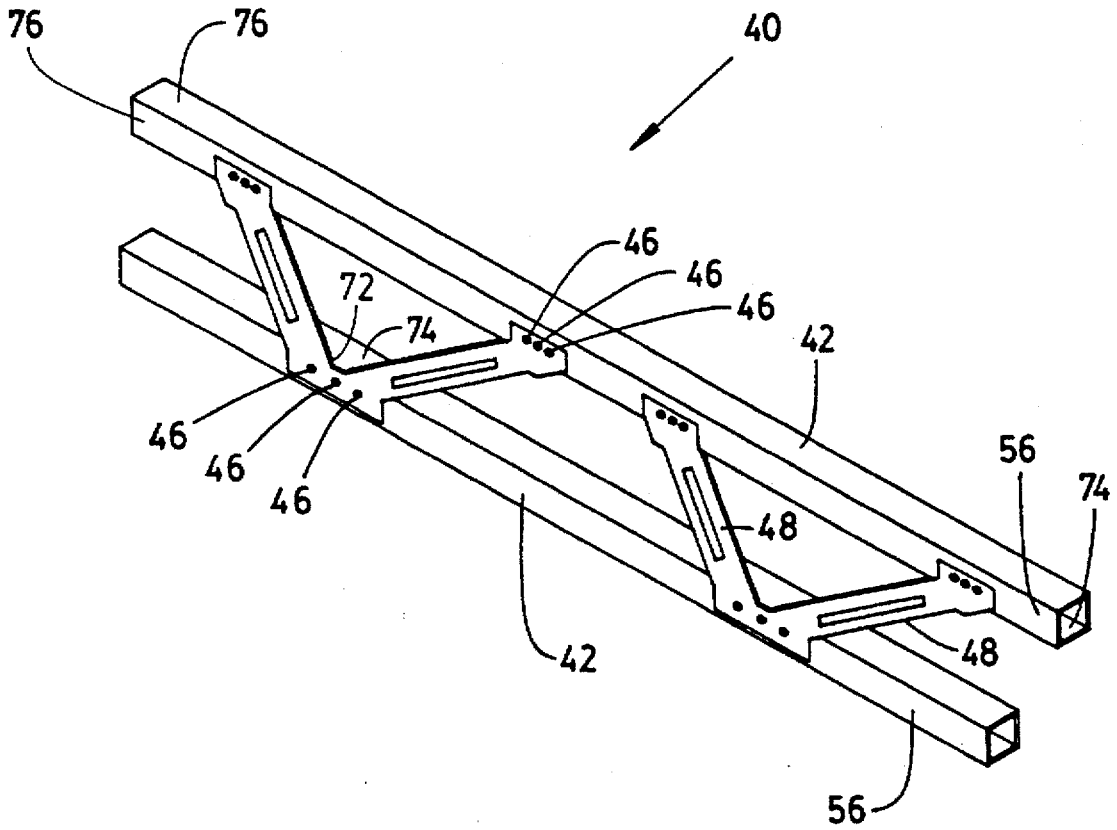
FIG. 1 is an isometric view of a portion of a preferred embodiment beam of the present invention.
Figure 2:
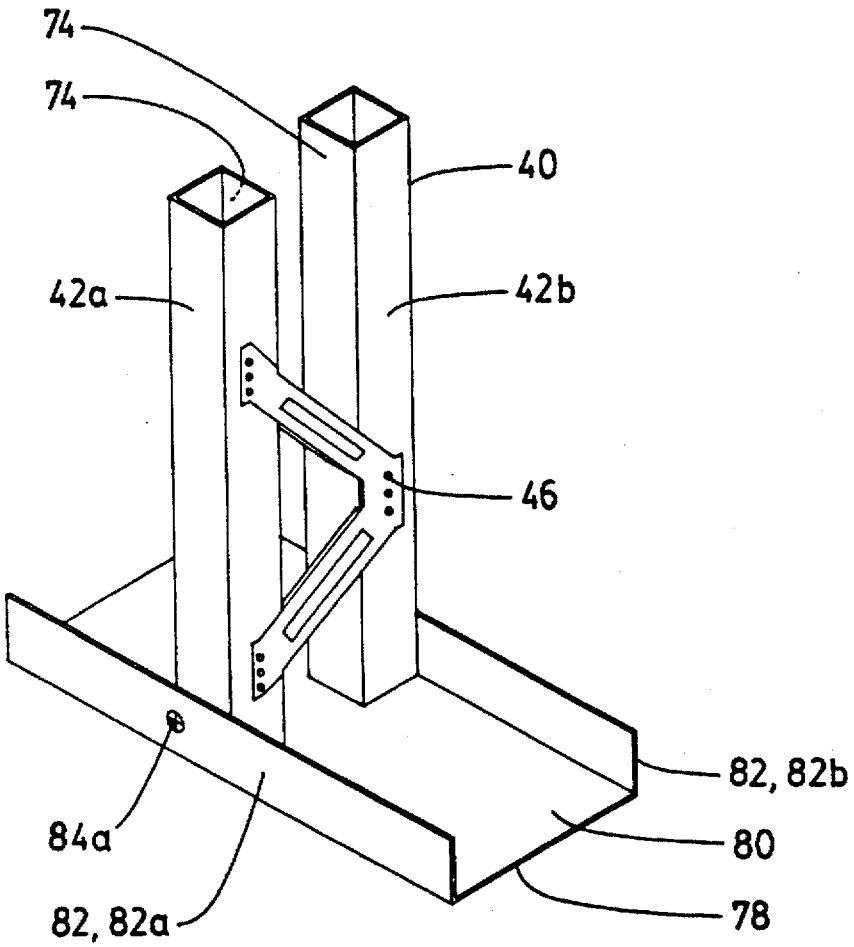
FIG. 2 is an isometric view of a lower part of the FIG. 1 beam, in place as a stud.

Referring to the drawings, FIG. 1 shows a portion of a preferred embodiment beam 40 and FIG. 2 shows a portion of the beam 40 of the positioned for use as a stud as part of a wall frame. Beam 40 includes a pair of spaced apart hollow metal chords 42, held together by "V"-shaped webs 44 secured to each chord by mechanical fasteners such as screws 46. The gauges of the webs and chords of the embodiments described further below are of a thickness which permits the screws to be installed using hand held tools such as an electrically-driven screw driver. Each chord is of metal tubing of generally square cross-section.

Figure 3:
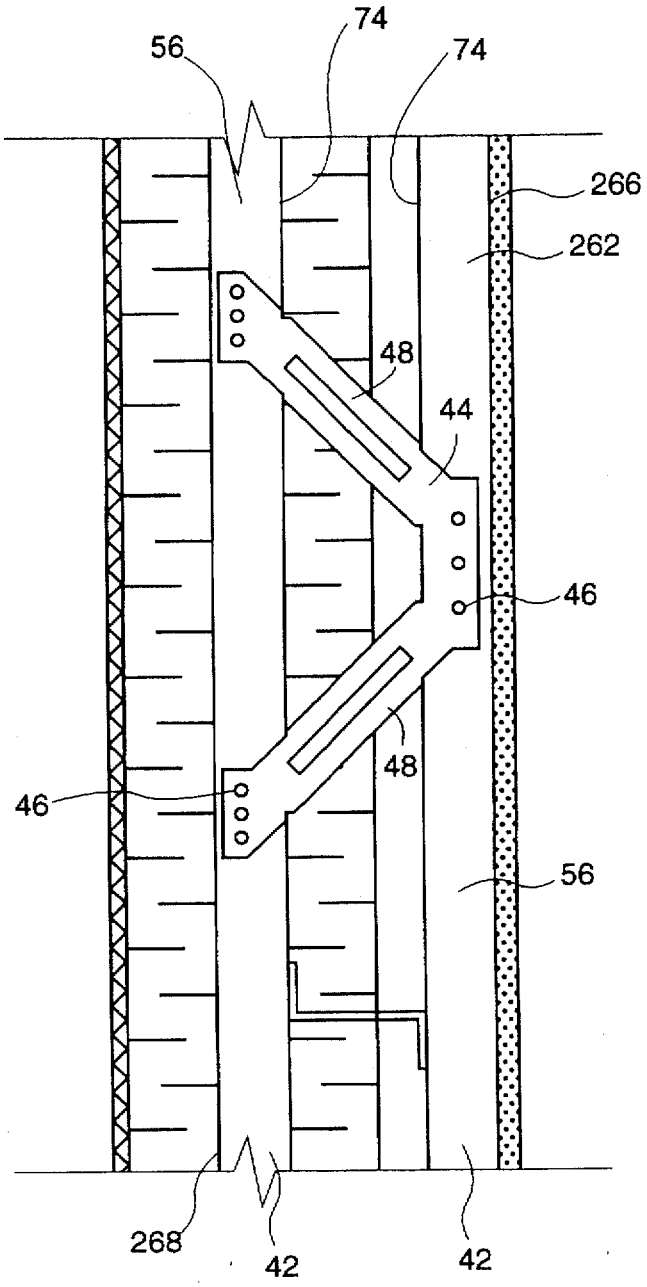
FIG. 3 is an elevation of the FIG. 1 embodiment beam shown as part of an exterior wall.
Figures 4, 5:
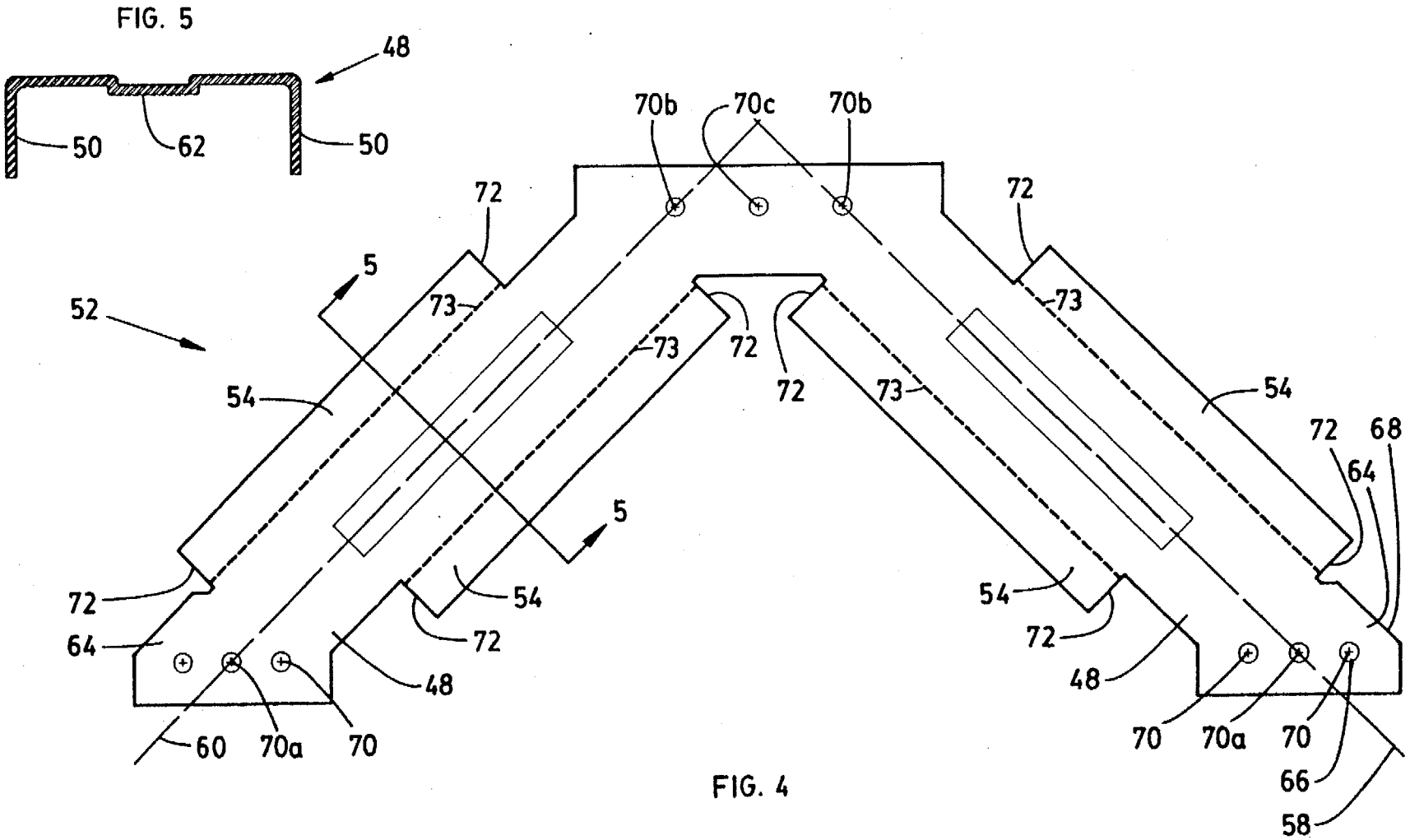
FIG. 4 is a plan view of a preferred embodiment web blank of this invention.
FIG. 5 is a cross-sectional view of the web of FIG. 4 folded, and taken along 5—5.

As easily seen in the elevation of FIGS. 3 and 4, each web 44 has two legs 48 disposed at a fixed 90° to each other. The webs hold the chords parallel to each other. There is a pair of lips 50 running edgewise along each leg 48. Blank 52 has edge portions 54 turned at approximately right angles to the central portion of each leg 48 to form the lips 50. In the illustrated embodiment, the following relationships will be noted: legs 48 are symmetrically disposed with respect to the chords, that is, each "V" leg is angled at 45° internally to the chord at its free end; screws 46 of each triplet located at the end of each leg are colinearly arranged along a center line of the side 56 of the chord to which the web is fastened; screws 46*a* (and holes 70*a*) at the feet of legs 48 and screws 46*b* (and holes 70*b*) lie on mutually perpendicular lines 58, 60 while screw 46*c* (hole 70*c*) is centered between screws 46*b*; and screws 46 are equidistant from screws 46*a* on the same leg. Indented leg depressions 62 strengthens the leg against bending forces while tag portion 64 strengthens the web against failure between fastening point 66 and web edge 68. Correct location of screws in a chord of the assembled beam are assured by pre-locating holes 70 in the web blank, stamped from sheet metal during manufacture of the web and locating longitudinal ends 72 of the lips turned down (through the page of FIG. 4) along lines 73 to appropriately abut chord sides 74 so that the web acts as a jig to properly locate the legs during assembly of a beam. Webs of the illustrated embodiment are of galvanized steel, ASTM A446 Gr.A., 16Ga.

Chords 42 of the illustrated embodiment are of galvanized steel tubing, ASTM A513-35Y and sides 76 have exterior cross-dimensions of 1½"×1½". The gauge of steel depends upon the strength requirements of the application for which the beam is to be used. The method for determining the required steel gauge is described below. Screws 46 are sheet metal screws located by holes 70 which are tapped into the metal tubing during assembly of the beam.

It will be appreciated that a beam may be assembled from its component chords and webs by semi-skilled labor, once a web is located in its correct location along the length of a chord it acts as a jig to correctly locate the chord with respect to the web and screws are then tapped and screwed directly into the chord through the pre-located holes of the web.

It will further be appreciated that beam 40 may be supplied as a "kit of parts" including unassembled chords, webs and screws. The beam may thus be shipped and stored compactly and assembled at a building construction site or possibly by a manufacturer prior to shipment.

The preferred embodiment beam is shown in use as part of frames for various building structures. It will be appreciated that in certain contexts the beam is used in place of a conventional stud, joist, etc. but that the beam has additional uses as well.

FIG. 2 illustrates a typical connection of beam 40 installed as a stud in lower horizontal track 78 having bed 80 and walls 82, Screw 84*a* secures the base of the stud chord 42*a* to track wall 82*a* while a second screw, not shown, similarly secures chord 42*b* to wall track 82*b*. Track 78 is fastened directly to a supporting concrete floor, for example, by a concrete anchor. Sheathing such as drywall, rigid foam insulation, etc. may be secured to beam chords in a conventional manner. Drywall screws may be fastened directly into the hollow chords of the preferred embodiment, for example.

Figure 6:
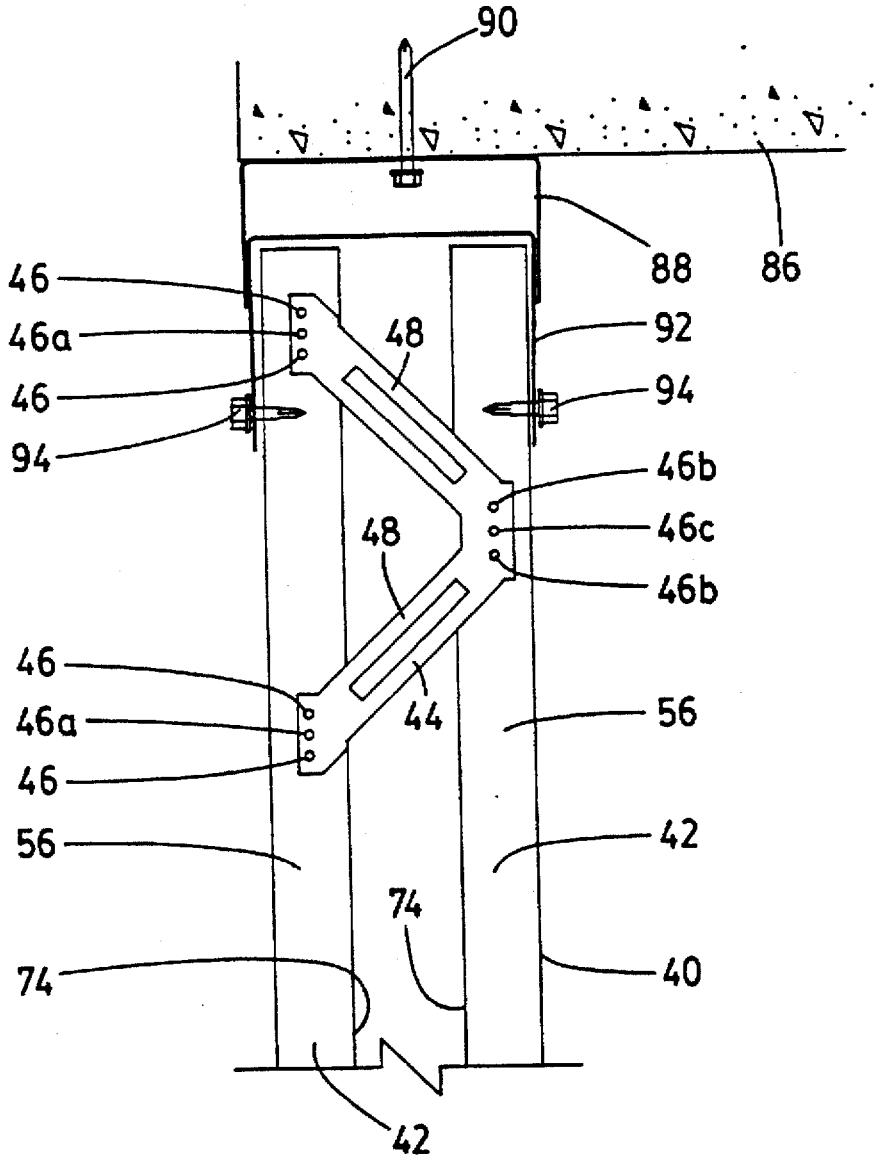
FIG. 6 is an elevation of the upper portion of the beam shown in FIG. 2.

FIG. 6 illustrates beam 40, installed as a stud, connected at its upper end to concrete ceiling 86. Outer track 88 is fastened directly to the ceiling by anchor 90 and the upper end of beam 40 is secured to inner track 92 by sheet metal screws 94 fastened directly to chords 42. Outer track 88 is dimensioned to snugly fit the inner track and beam.

Figure 7A:
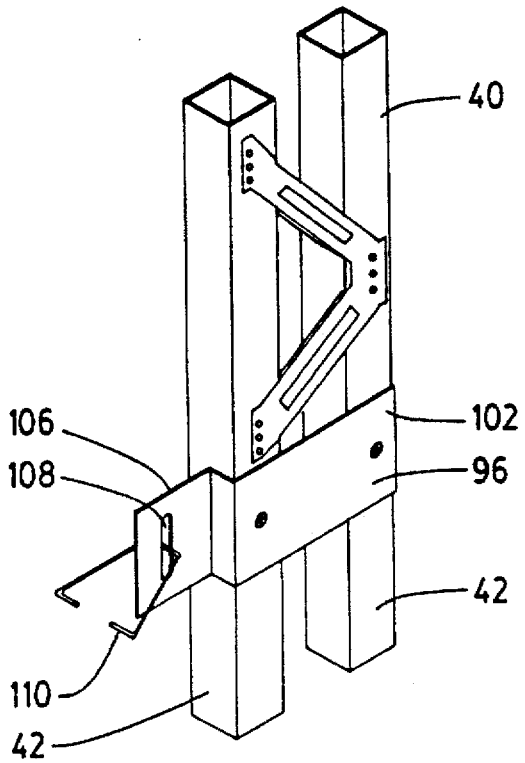
FIGS. 7*a* and 7*b* are isometric and top plan views respectively of the FIG. 1 embodiment showing a brick connector therefor.
Figure 7B:
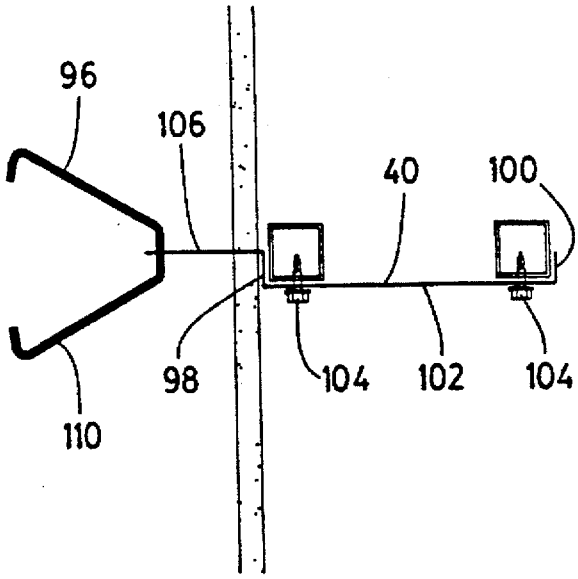

FIGS. 7*a* and 7*b* show a brick connector 96 for beam 40 installed included as a stud as part of a wall frame. Brick connector 96 includes sheet metal trough with walls 98, 100 and base 100 secured to beam 40 by sheet metal screws 104. Lateral extension 106 having aperture 108 for receipt of tie wire 110 provides for connection of a brick veneer wall to the beam in a manner familiar to those skilled in the art, and illustrated further below.

Figure 8:
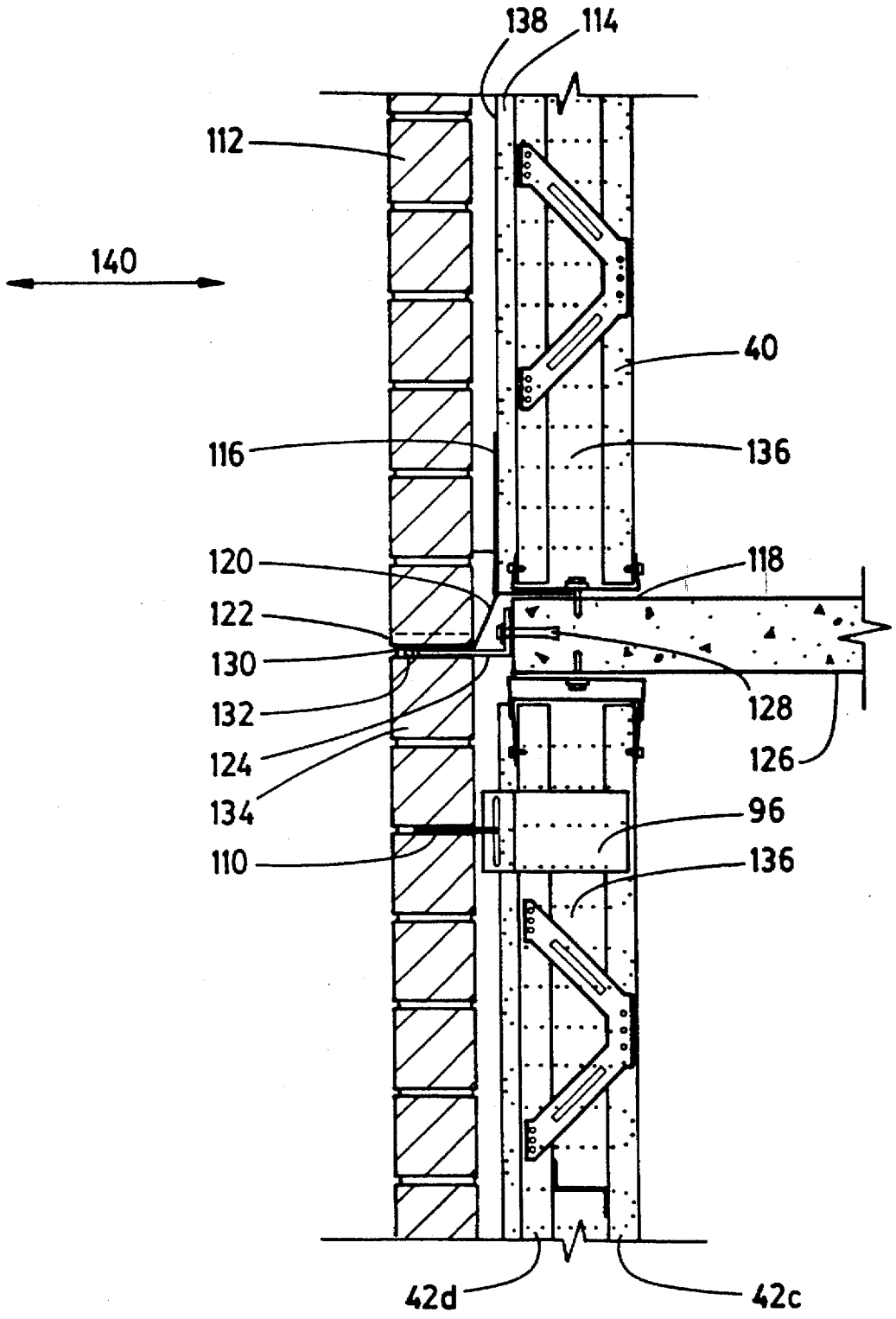
FIG. 8 is a side elevation showing the FIG. 1 embodiment beam installed as part of a frame for an exterior wall having brick veneer facing.

Beam 40 installed as part of an outer wall is illustrated in FIG. 8. In addition to the components detailed above, brick veneer 112 connected to beam 40 of lower story by way of tie wire 110 is shown. The wall includes exterior sheathing 114 which may be fastened directly to beam 40 by conventional means appropriate for the sheathing. Sheathing may include any conventional building component such as rigid insulation fastened by any suitable conventional manner directly to frame beams. Water barrier 116 inhibits ingress of water into the area of wall-floor joint 118 and flashing 120 directs any water flow to weep holes 122. The weep holes are located above angle shelf 124 anchored directly to concrete slab 126 by anchor 128 and elastic sealant 130 and sealant back-up 132 are between upper brick layer 134 and shelf 124. Electrical wiring and other material to be concealed within a wall may be installed to pass between chords of a beam without the need for drilling holes, as with solid beams. Insulation 136 may be located behind sheathing 114, between beams 40 and spaced apart chords 42 of beams of the wall frame. It will be appreciated that webs 44 connecting inner chords 42*c* and outer chords 42*d* act as a reduced thermal bridge between the outer and inner portions of an external wall than if a unitary metal beam were used.

The arrangement of the chords and webs of beam 40 is such that each chord of the beam is strengthened against deflection in directions generally perpendicular to the outer surface 138 of sheathing member 114, as indicated by double-headed arrow 140. The strength of a beam may be tailored to suit a particular framing application: by the use of chords of a particular strength (i.e., tubes of a particular gauge); by the use of webs having a particular size and shape; and by the use of particular screw members and configurations for fastening the webs and chords together. Examples of the manner in which a beam of the preferred embodiment is tailored for particular applications are given below.

Figure 9:
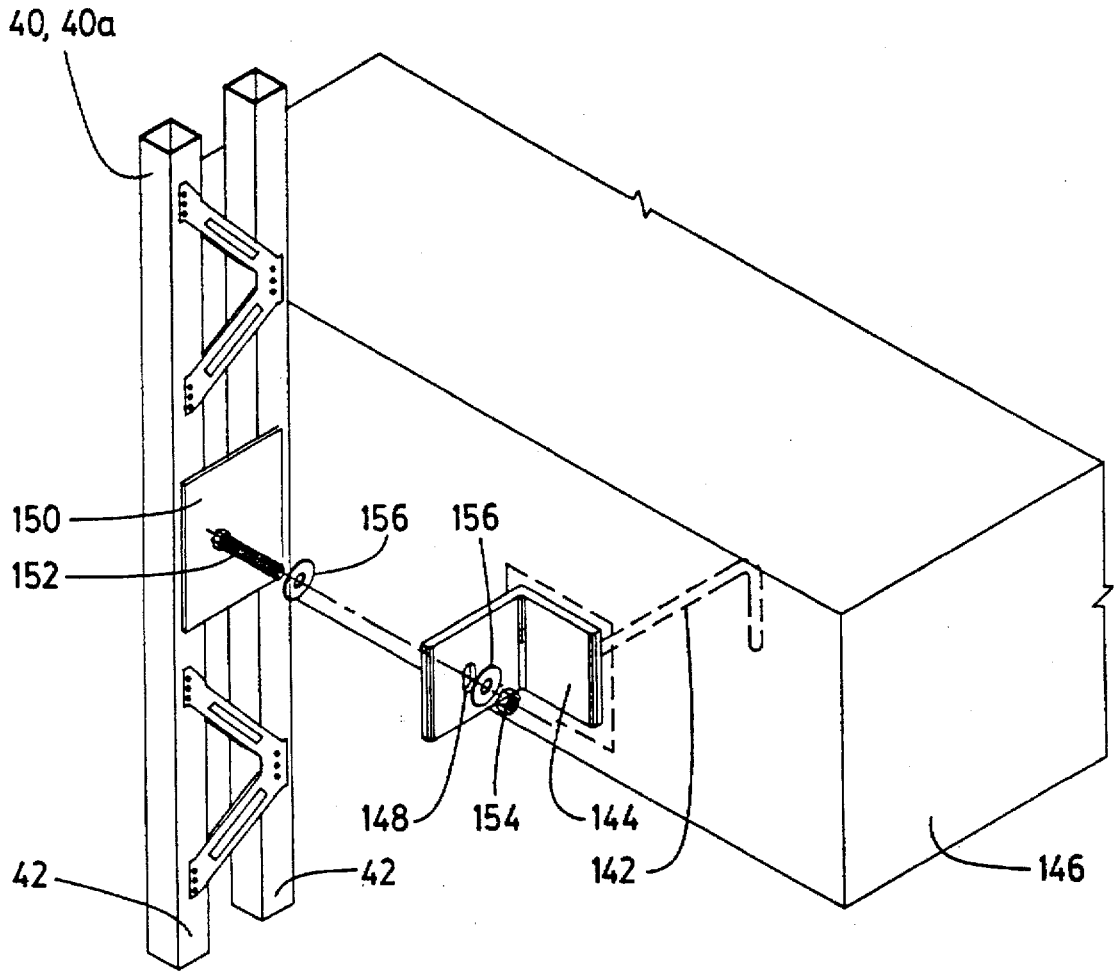
FIG. 9 is an isometric partially exploded view of the FIG. 1 embodiment beam in use as part of a spandrel frame.

Beam 40, may also be installed as an upright member of a spandrel frame as indicated in FIG. 9. Anchor 142 of plate 144 is embedded in concrete slab 146. Plate 144 is "L"-shaped with hole 148 in the leg extending laterally from the slab. Plate 150 is welded to both chords of beam 40a and has a threaded stud 152 located to pass through hole 148 to be fastened in place with nut 154 and washers 156.

Figure 10:
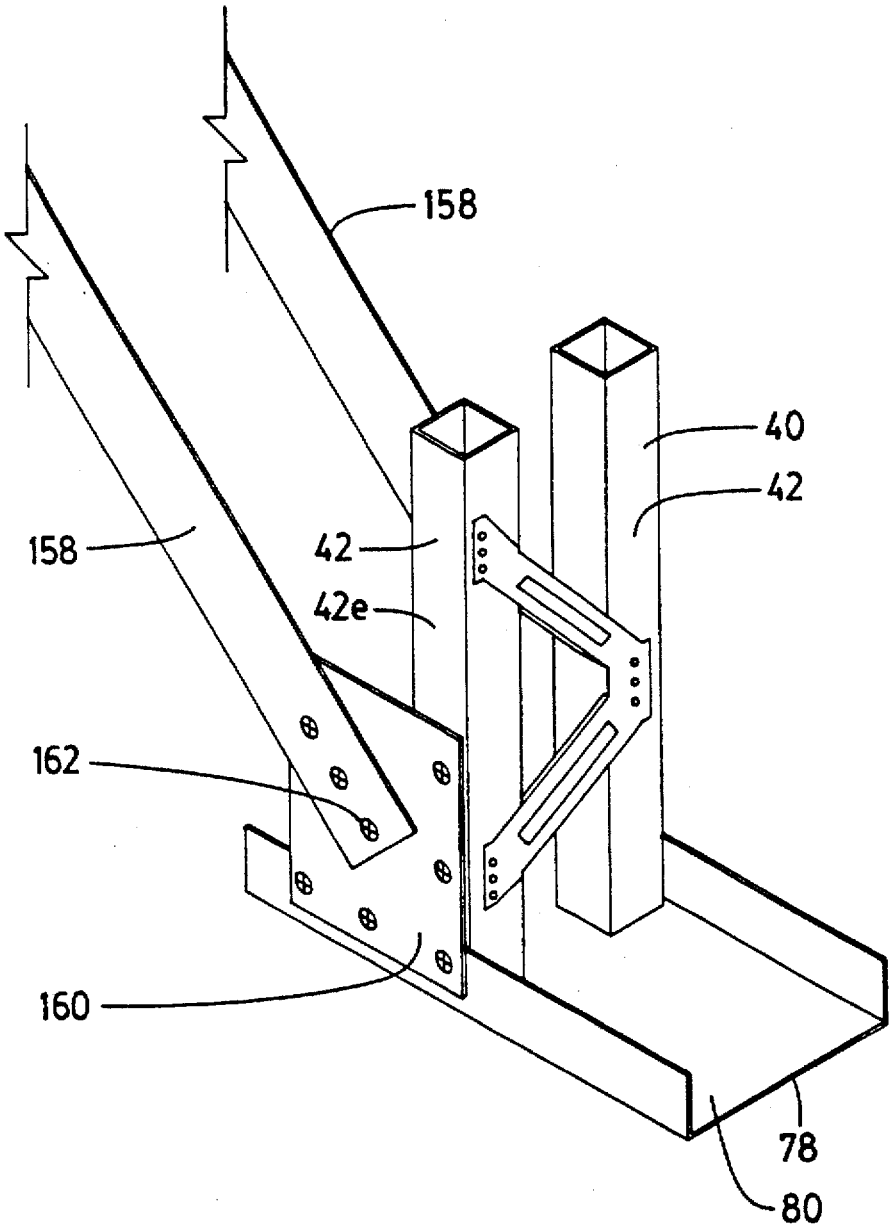
FIG. 10 is an isometric view similar to that of FIG. 2 showing a partial view of a diagonal tension strap included in a wall frame.

A building frame having beams of the present invention may further include one or more diagonal tension straps 158 shown in FIG. 10. The straps are connected, for example, at the base of a stud by means of gusset plate 160 fastened to track and chord 42*e* by means of screws 162.

Figure 11:
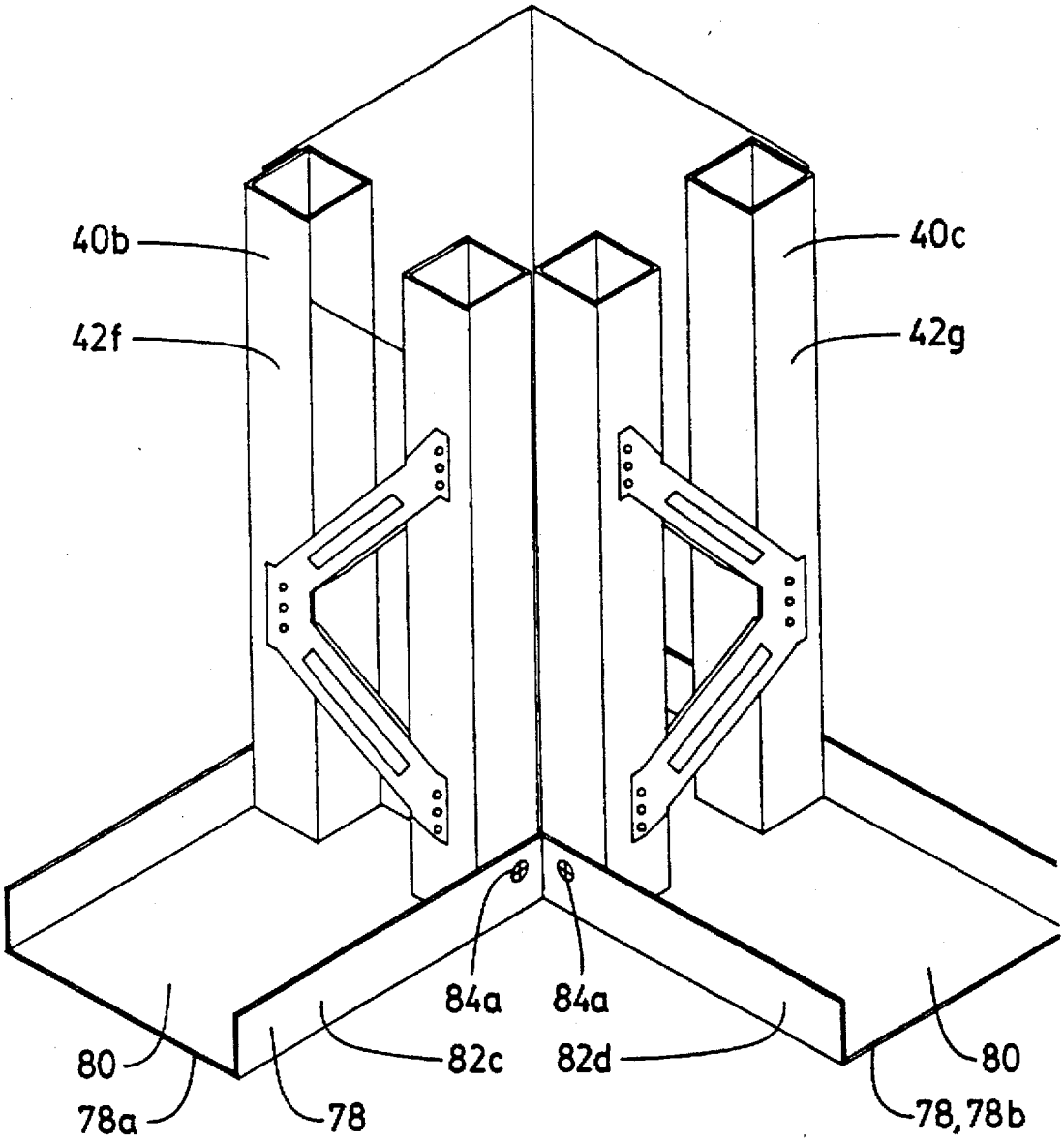
FIG. 11 is an isometric view of a corner detail including the FIG. 1 embodiment beam.

An example of a corner arrangement for wall frame members is shown in FIG. 11. Tracks 78*a*, 78*b* are mitered at a right angle and beams 40*b*, 40*c* are fastened by screws 84*a* to upstanding track walls 82*c*, 82*d*. Right-angled corner plate is fastened to outer chords 42*f*, 42*g* by sheet metal screws, not shown.

Figure 12:
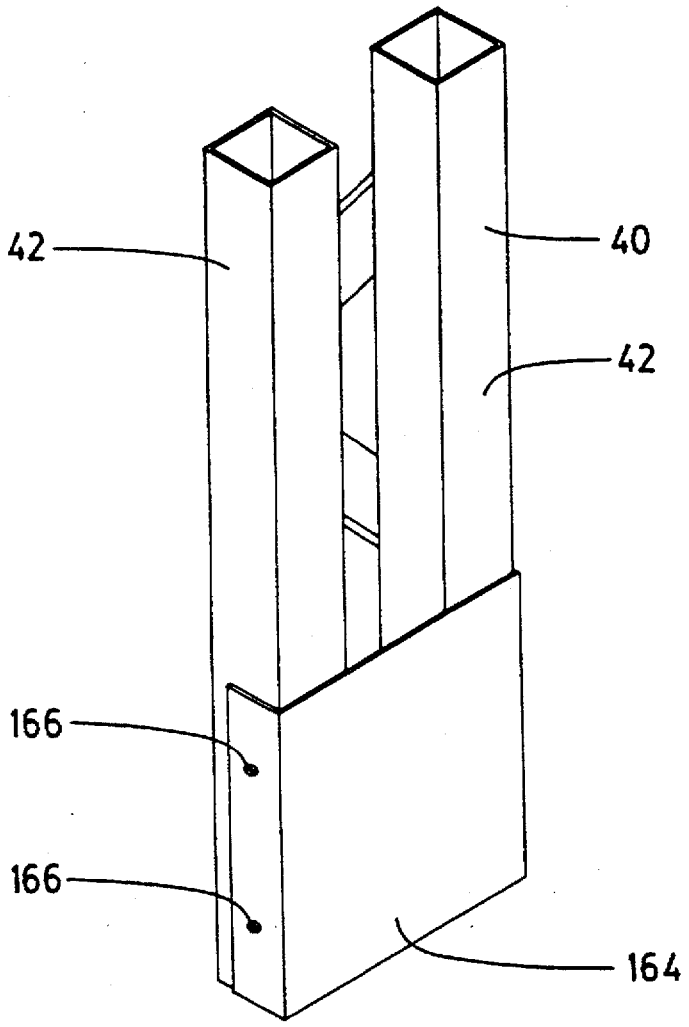
FIG. 12 is an isometric view of a stiffener in use with the FIG. 1 embodiment beam.

An individual beam 40 may be stiffened by installation of a "U"-shaped stiffener track 164 of sheet metal and fastened by screws 166, as illustrated in FIG. 12.

Figure 13:
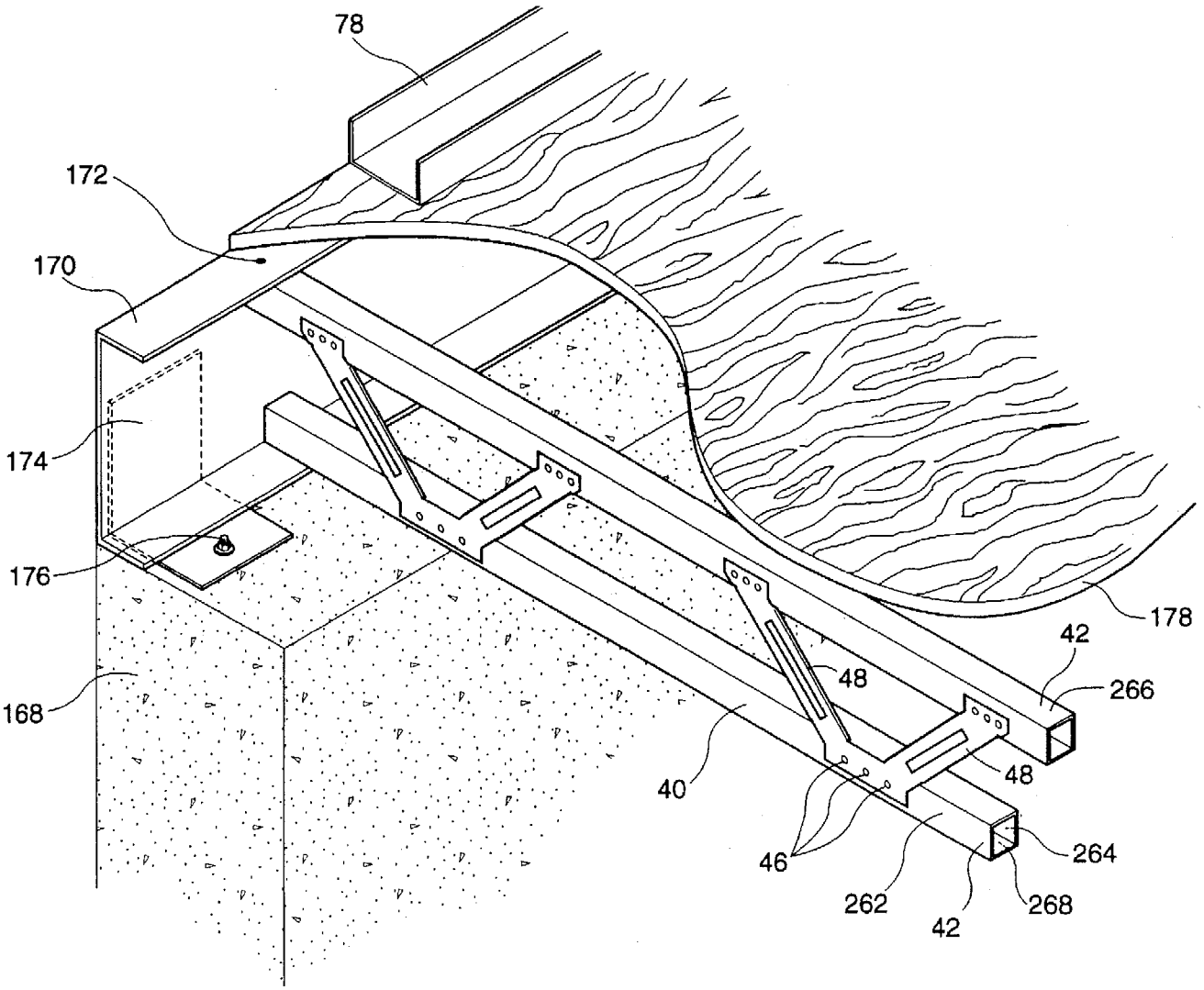
FIGS. 13 and 14 are partial cut-away isometric views of the FIG. 1 embodiment beam in place as a floor joist mounted above a supporting wall, alternative mounting connections being illustrated.

The preferred embodiment beam 40 may also be used as a component of floor joists, various exemplary arrangements being illustrated in FIGS. 13 to 21. Turning to FIG. 13 in particular, horizontally oriented beam 40 is supported at the illustrated end by concrete wall 168. The beam is secured to the wall by means of "U"-shaped metal track 170 to which it is fastened by screw 172. Track 170 is oriented to open inwardly and runs lengthwise along the wall. Track 170 is secured to the top edge of wall 168 by right-angled metal piece 174 to which the track is welded or mechanically fastened and which itself is secured to the wall by bolt 176. Floor sheathing 178 is supported by the beam, and track 78 installed to accept studs as described above.

Figure 14:
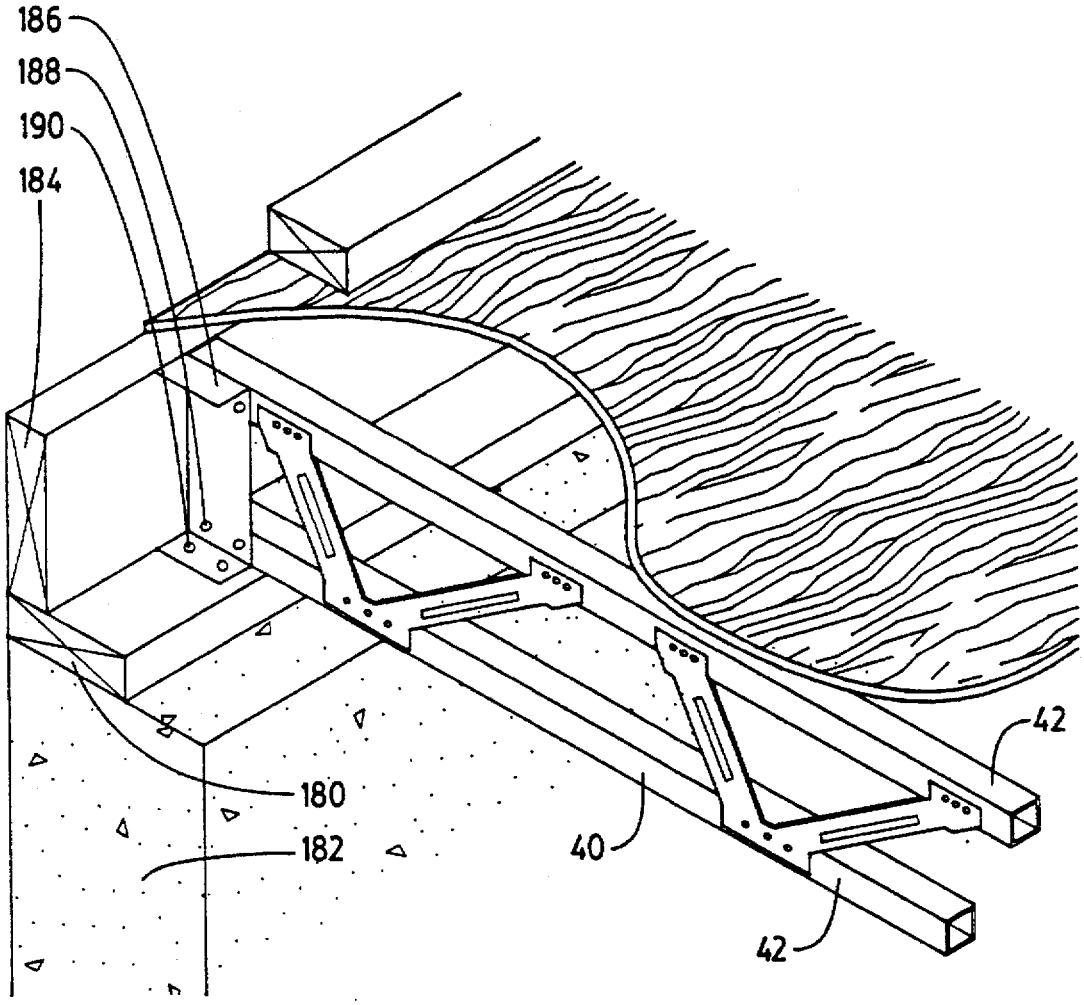

An alternative arrangement for a joist installed atop a concrete wall is illustrated in FIG. 14. Conventional wood beam 180 is secured directly to concrete wall 182 and another wood beam 184 is secured to the first wood beam. Beam 40 is secured with respect to wood beam 180 by "U"-shaped metal piece 186 fastened to wood beam 180 and beam 40 by screws 188, 190 respectively.

Figure 15:
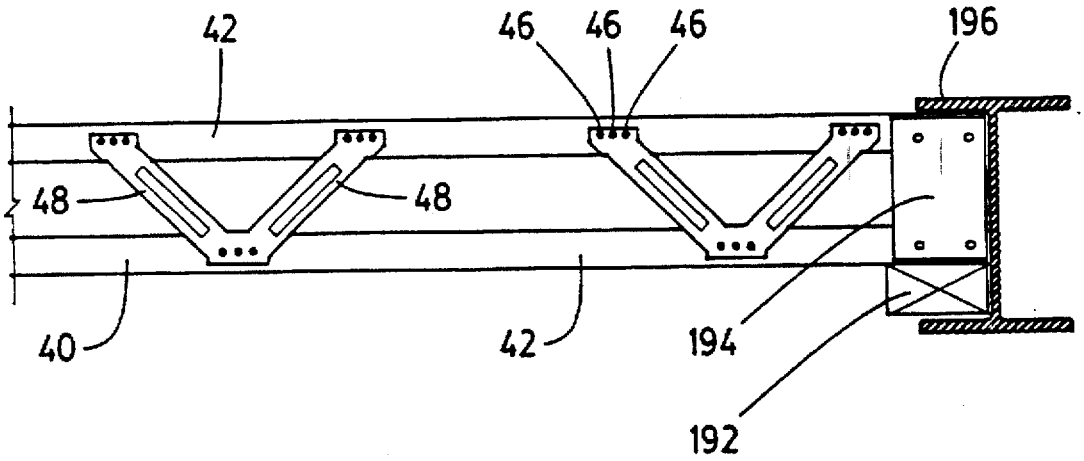
FIG. 15 is a side elevation of the FIG. 1 embodiment beam in place as a floor joist, the joist end mounted to an I-beam.

A floor joist may be secured between the flanges of an I-beam as illustrated in FIG. 15. Wood blocking 192 is secured to beam 40 by angle piece 194, these members being secured between the flanges of transverse I-beam 196 by a friction fit.

Figure 16:
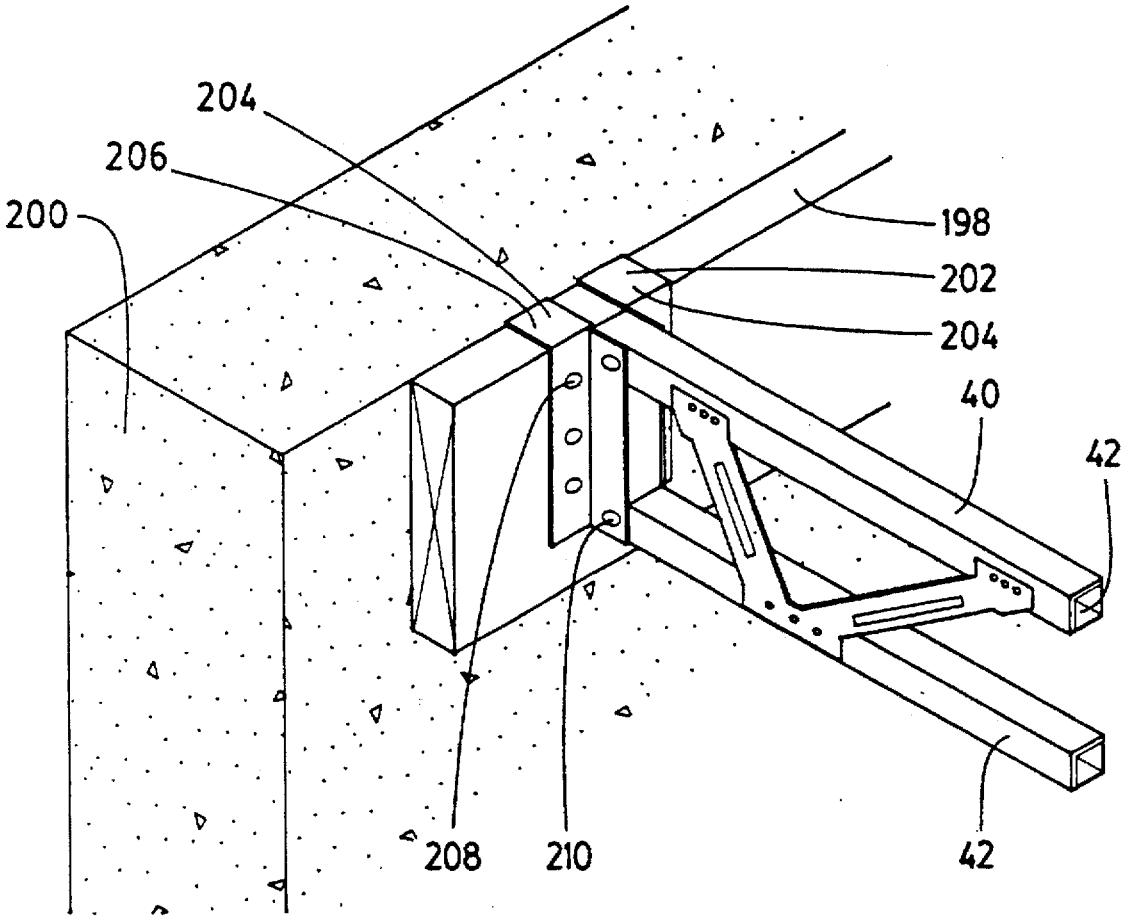
FIGS. 16, 17, and 18 are isometric views of the FIG. 1 embodiment in place as a floor joist having its top edge flush with the top of a supporting wall, alternative mounting connections being illustrated.

A floor joist may be secured to be more or less flush with the top of a support wall. In FIG. 16 wood beam 198 is secured to concrete wall 200. Joist hanger 202 made up of two angled metal pieces 204 with hanger lateral extensions 206 fixes beam 40 with respect to the wall, hanger 202 being secured to the wood beam 198 and beam 40 by screws 208, 210 respectively.

Figure 17:
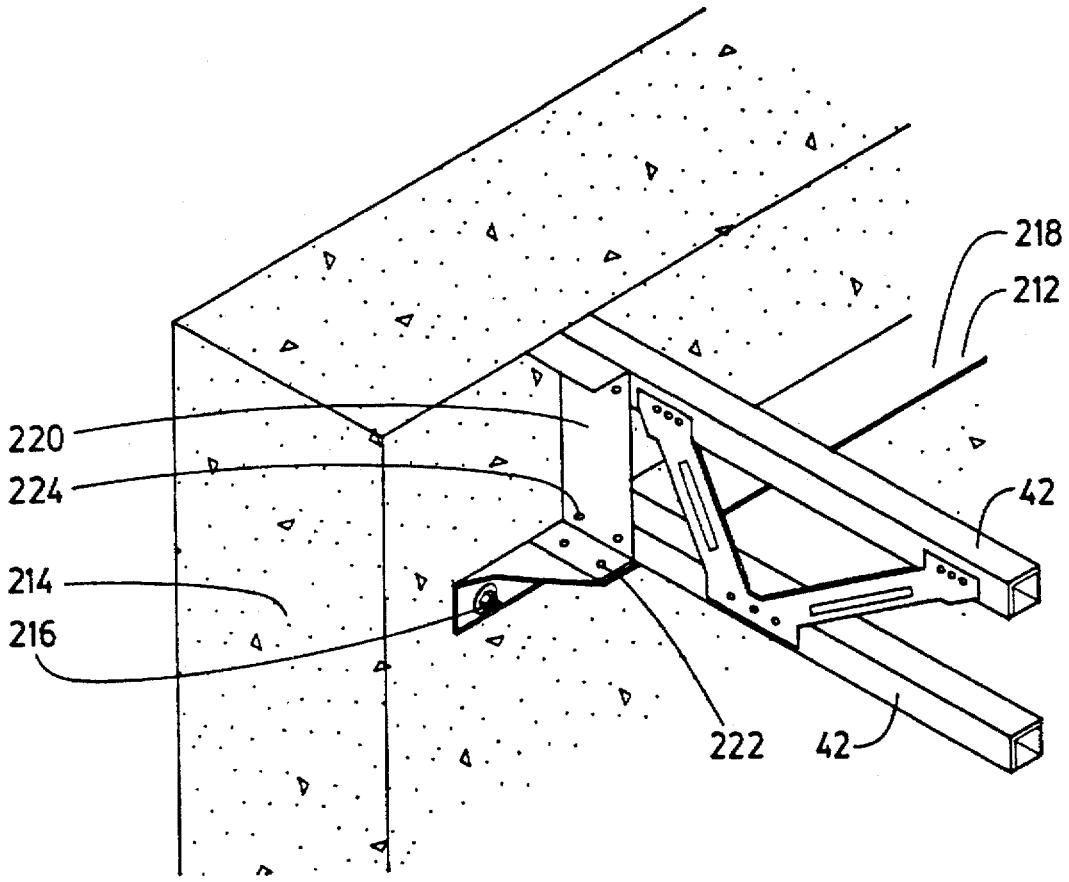

Alternatively, a joist may be supported flush with the top of a wall by a ledger secured beneath the joist. As illustrated in FIG. 17, longitudinal metal ledger 212 is secured to concrete wall 214 by anchor bolts 216, only one of which is illustrated. Beam 40 is supported directly by ledger shelf 218 and is secured thereto by metal stiffener 220 which is fastened to shelf 218 and beam 40 by screws 222, 224 respectively.

Figure 18:
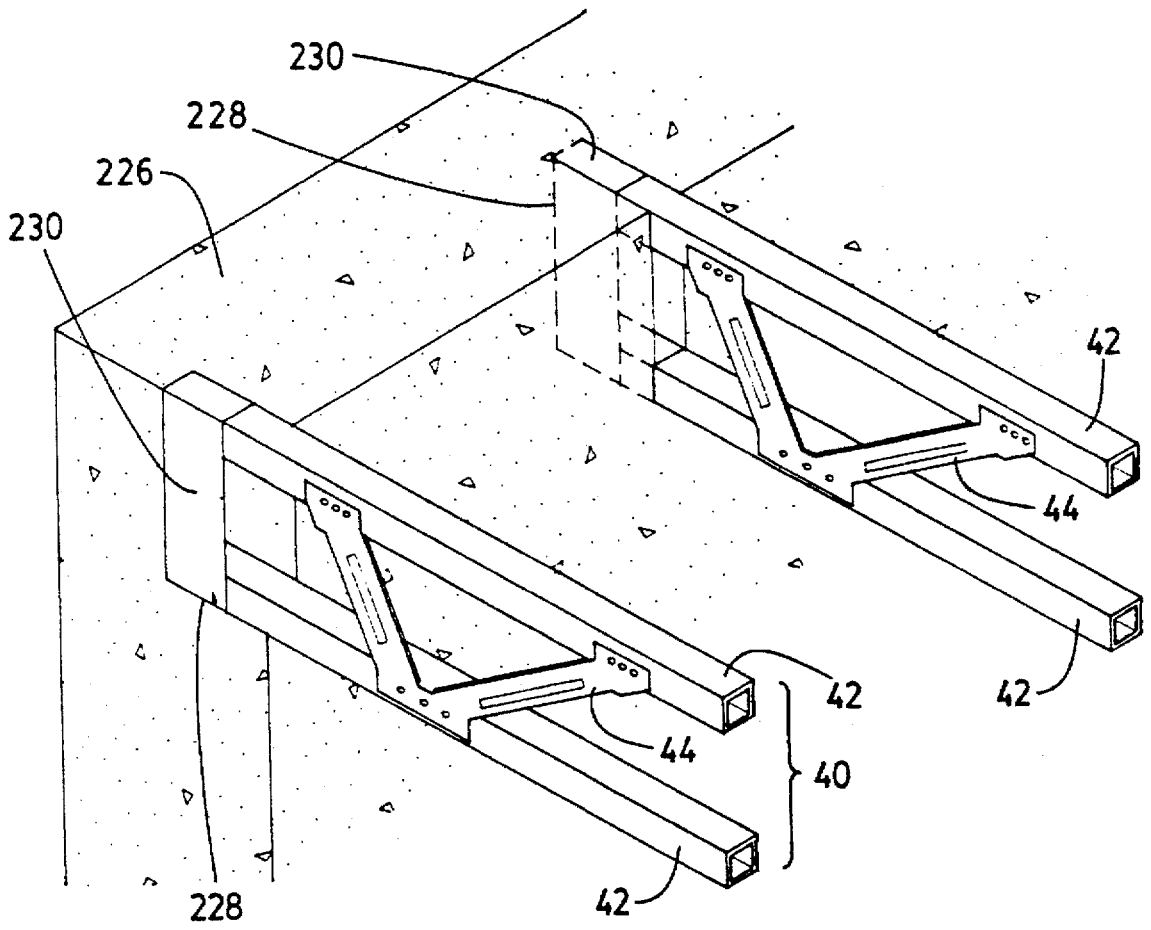

A concrete wall may be prepared with pockets for supporting joists. As shown in FIG. 18, concrete wall 226 includes pockets 228 which receive joists, i.e. horizontal beams 40 which are supported on the lower side of the pocket, not visible. Beams 40 have metal end stiffeners 230 and each beam end is positioned within its pocket.

Figure 19:
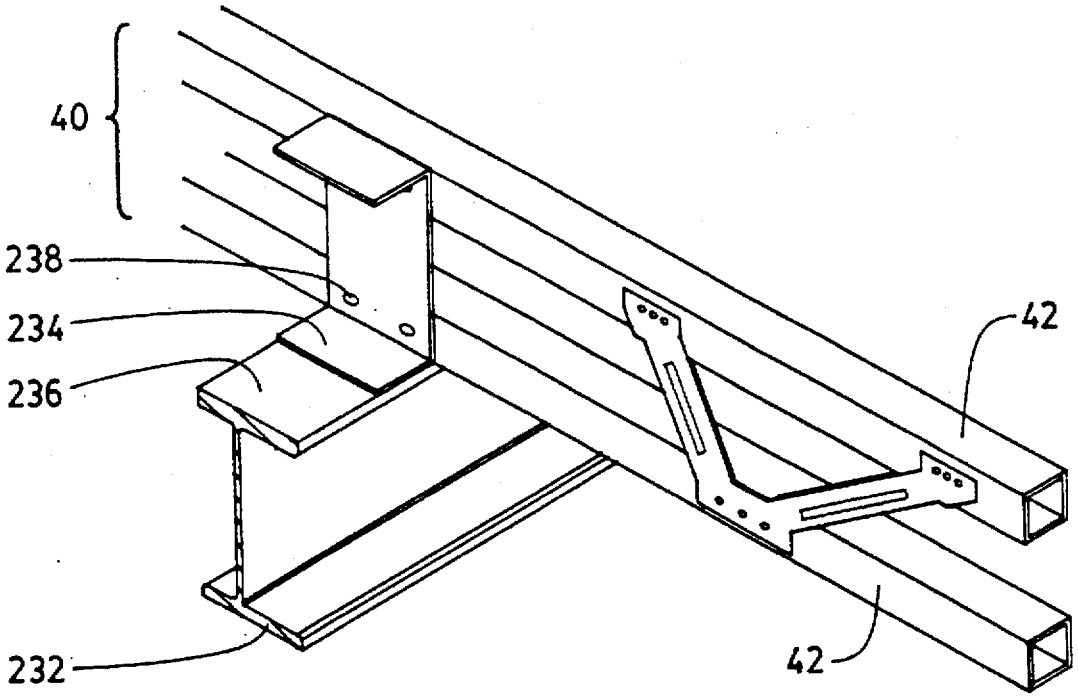
FIG. 19 is an isometric view detailing support of a mid-portion of the FIG. 1 embodiment beam in place as a floor joist.

Mid-portions of joists may require support against downward deflection in use. Turning to FIG. 19, beam 40 is supported at a mid-portion by a cross-beam 232. Metal channel 234 is welded or screwed to upper flange 236 of I-beam 232 and secured to beam 40 by screws 238, the two beams being thus secured with respect to each other.

Figure 20:
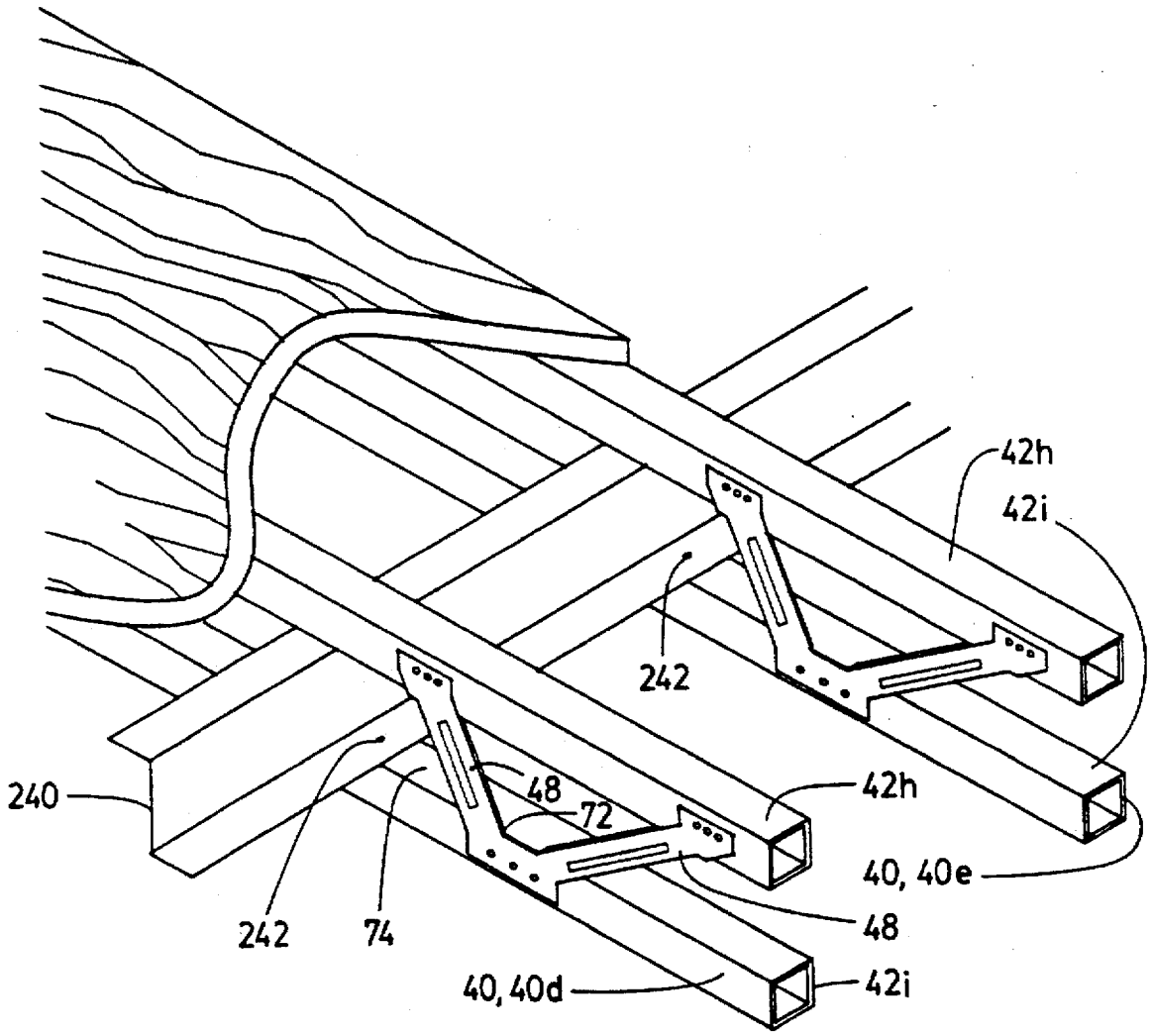
FIG. 20 is an isometric view illustrating bridging support of a mid-portion the FIG. 1 embodiment beam in place as a floor joist.

Alternatively, a mid-portion of a joist may be supported by a bridge passing through the spaced chords of the joist. As shown in FIG. 20, elongate metal bridge 240, having a "Z"-shaped cross-section, is transverse to beams 40*d*, 40*e* and is located in the space between upper and lower chords 42*h*, 42*i* of the respective beams. Bridge 240 is secured directly to the inside of each chord by screws 242 and the bridge thus provides additional support for beams 40 against twisting. The bridge also assists in locating beams parallel to each other during installation.

It will also be apparent that a bridge could be used in conjunction with a beam of the present invention when the beams is part of a wall frame as previously described, or part of a roof frame, described below, or other building frame as the case may be.

Figure 21:
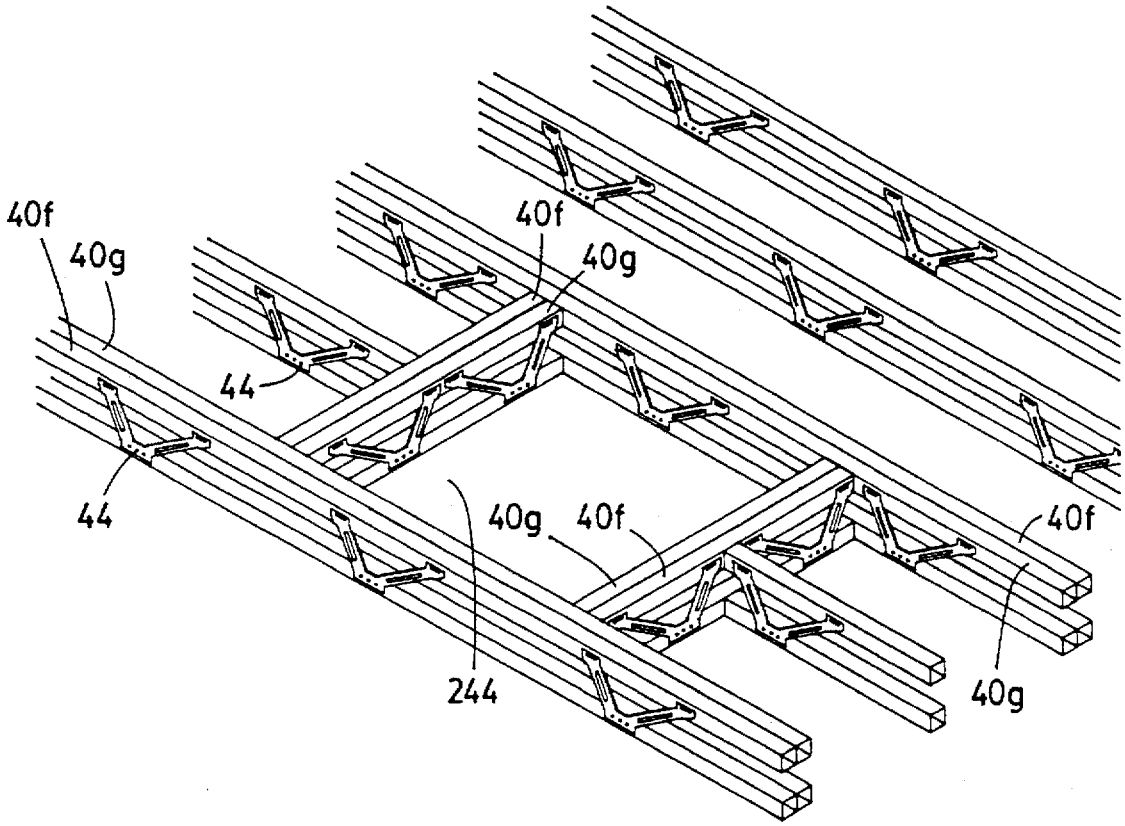
FIG. 21 is an isometric view showing part of a floor frame incorporating beams of the FIG. 1 embodiment.

Beams may also be doubled up to provide extra support against deflection. FIG. 21 illustrates double joisting by pairing of beams 40*f*, 40*g*. This may be needed if a floor is to bear heavier loads such as when one beam is absent to provide, for example, gap 244 for locating a stairwell in a mid-portion of a floor. Such pairing of beams would of course be possible in other types of applications, as needed.

Figure 22:
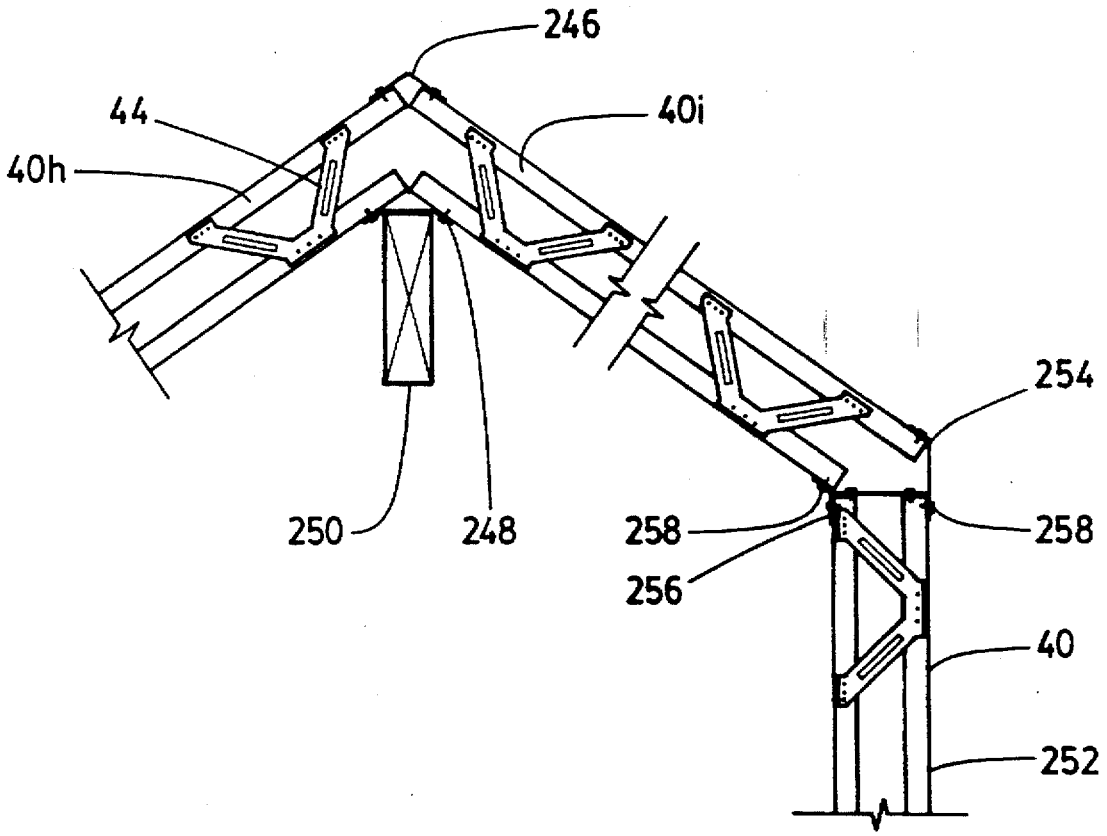
FIG. 22 is a side elevation illustrating beams of the FIG. 1 embodiment in place as roof rafters, and wall stud.

Beams of the present invention may also be included in roof frames as rafters. One example of such an application is illustrated in FIG. 22. Slanted beams 40*h*, 40*i* are fastened by ridge cap 246 and apex clip 248 which may be supported, as required by beam 250, which is in turn suppored conventionally (not illustrated). Each beam is supported by wall stud 252, connection therebetween being provided by rafter end seat 254 and track 256 secured by screws 258.

Figure 23:
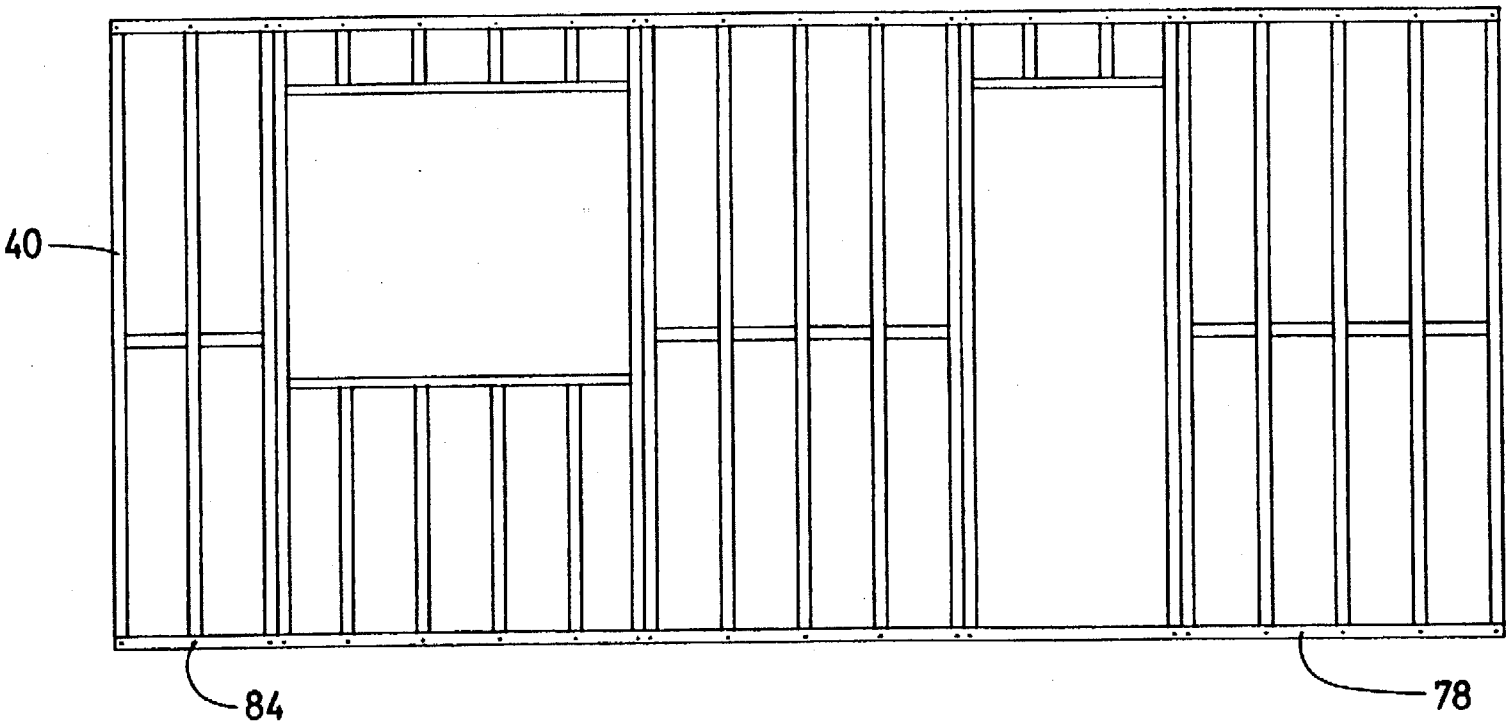
FIGS. 23 and 24 are elevational views of sample wall frames incorporating the beam of the FIG. 1 embodiment.
Figure 24:
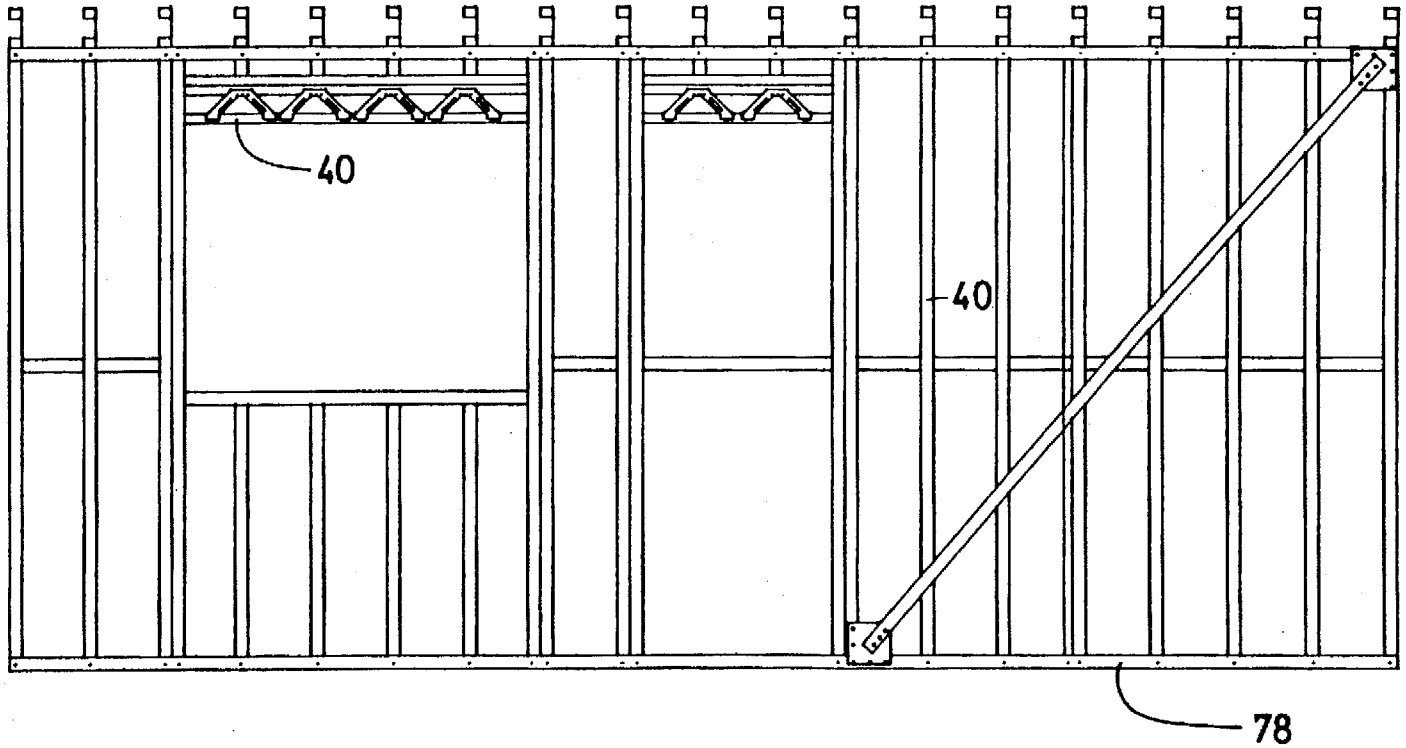

Exemplary wall frames including beams of the present invention are shown in FIGS. 23 and 24, various components being indicated as discussed above.

Figure 25:
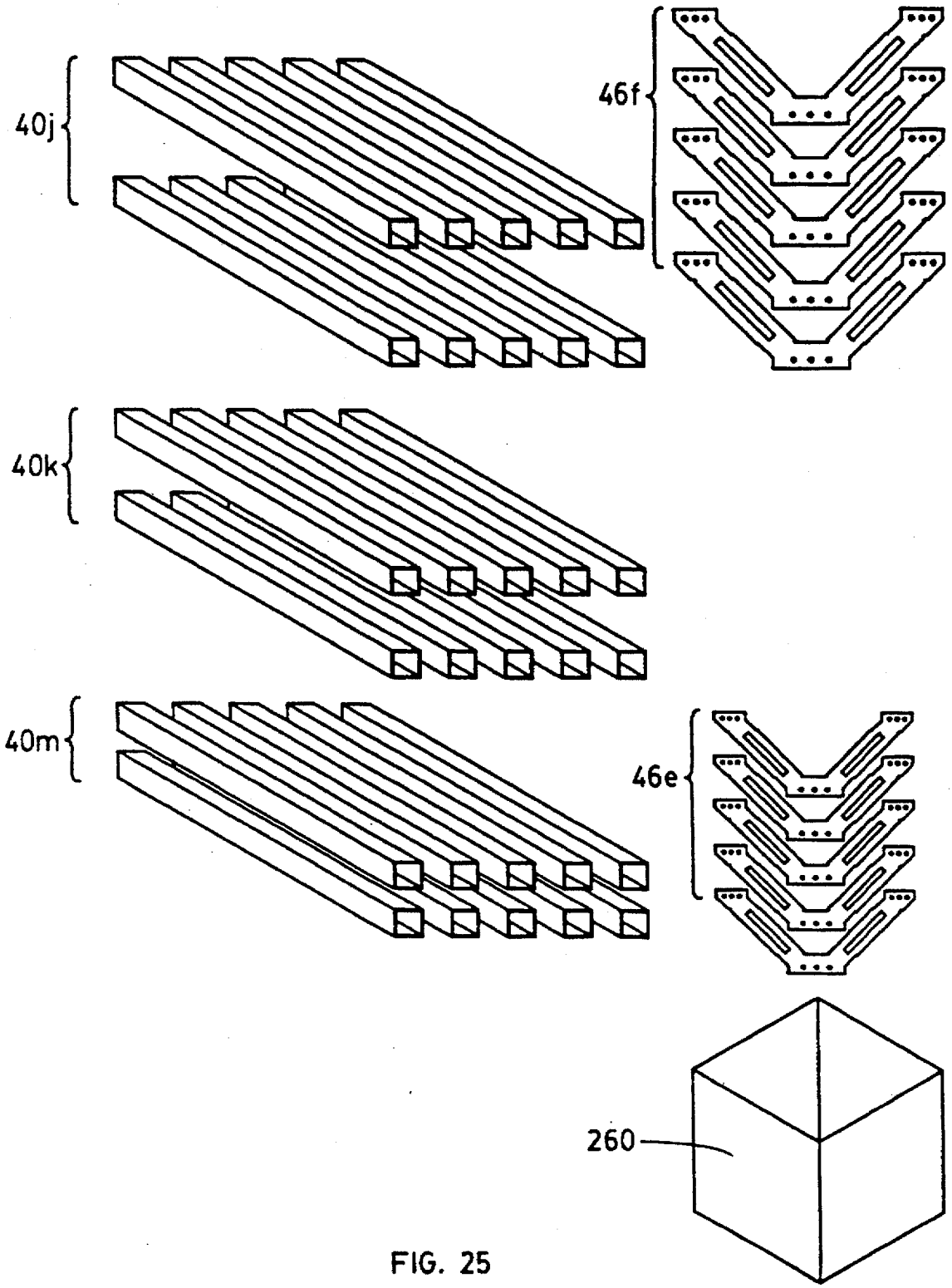
FIG. 25 illustrates a typical beams kit of parts.

A typical example of a beams kit of parts is illustrated diagramatically in FIG. 25. Chords 40*j*, 40*k*, 40*m* represent 18 Ga, 16 Ga and 14 Ga metal standard chords respectively. Webs 46*e*, 46*f* represent standard webs for inclusion in 6" and 8" beams, respectively. A supply of screws 260 may also be provided.

Assembly of a Beam for Use in a Frame

Use of the preferred embodiment of the beam of the present invention, for inclusion in a frame of a building structure, such as a wall or ceiling is now described. For purposes of description, the method of use of the preferred embodiment is divided into two stages: a planning or design stage of a frame to be constructed, followed by an assembly stage.

The planning stage would typically be carried out by an architect, designer or the like. A designer, knowing the length of beams required to be used in a frame, and having calculated or obtained the uniform load to be applied to the structure (wall, floor, etc.), refers to Tables I(a) and I(b) depending upon whether beams having a 6" or 8" depth are required. If an 8" depth is not required, the designer would generally chose the more economical of the two, this usually being the 6" beam.

The designer then enters the row of the chosen table corresponding to the required beam length and moves across the row, first examining the 24" spacing values for each chord gauge, beginning with 18 Ga, then 16 Ga, and finally 14 Ga in order to find the smallest maximum load greater than that to be applied to the system. If none of the maximum loads in the table for 24" spacing exceeds (or at least equals) the required applied load, the designer then examines the 16" spacing values for each chord gauge, again looking for the lowest maximum load which exceeds the applied load. Again, if no maximum load exceeds the required applied load the designer examines the 12" spacing values. The lowest maximum load that exceeds the required applied load is selected from the table and information corresponding to the selection, including the applied load is passed on to the manufacturer. If the structure is also required to bear a load in the axial direction of the frame beams, as in a load-bearing wall, the appropriate one of Tables II(a)–II(c) is checked to ensure that the beam selected is also capable of bearing the required combined bending and axial loads. If the beam is found to be suitable, the information is passed on to the manufacturer. If the beam is not, then a beam capable of bearing a larger uniform load is chosen and similarly checked against Tables II(a)–II(b), this process being repeated until a strong enough beam is found.

Figure 28:
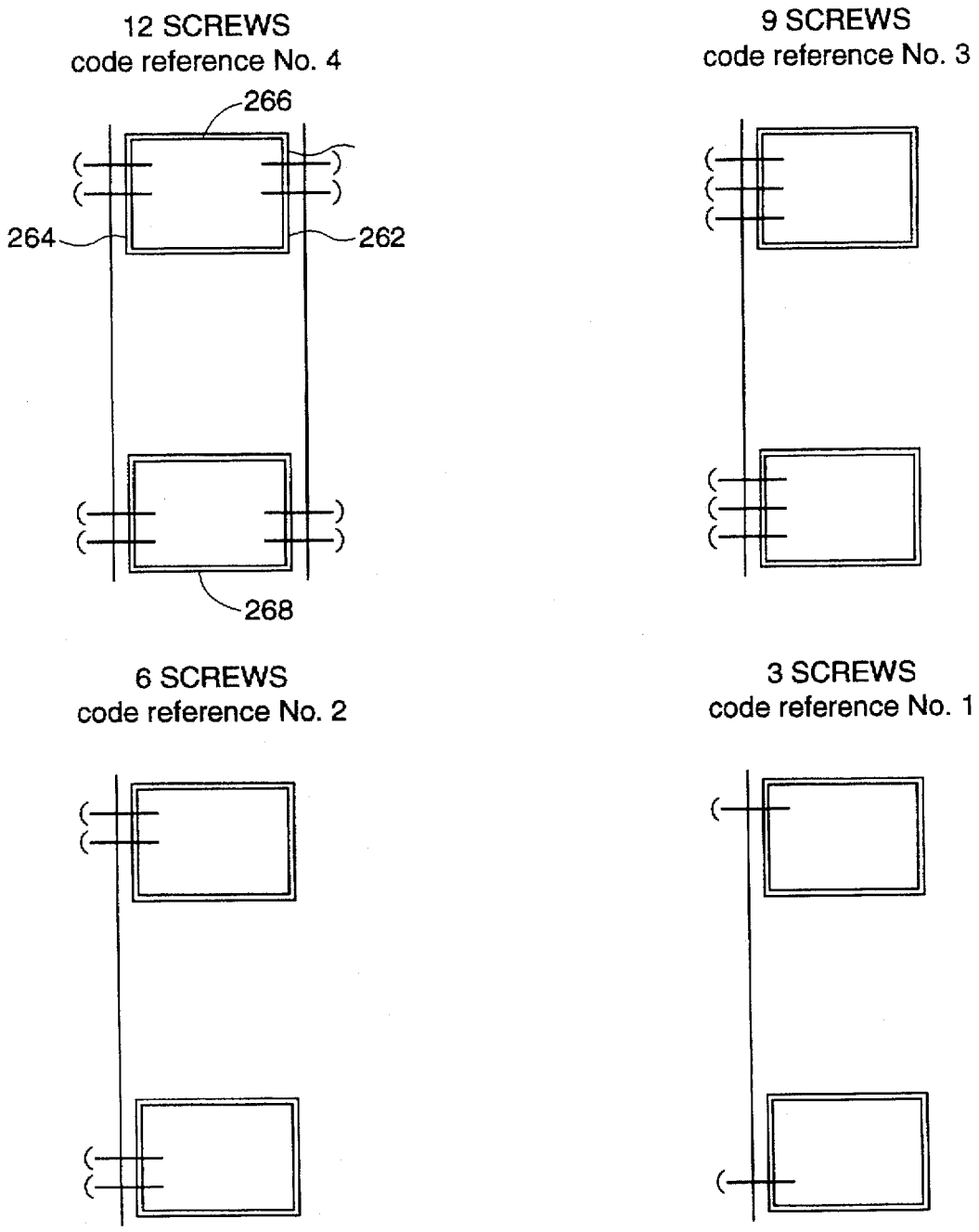
FIG. 28 shows web and screw configurations for each position code contained in Table IV.
Figure 29:
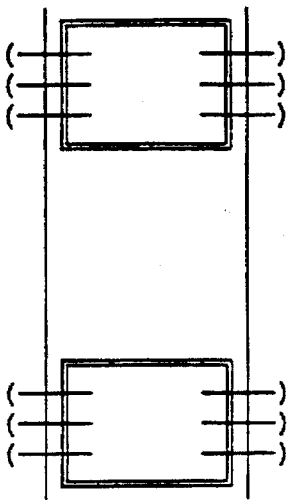
FIG. 29 shows web and screw configurations for each position code contained in Table VIII.
Figure 29:
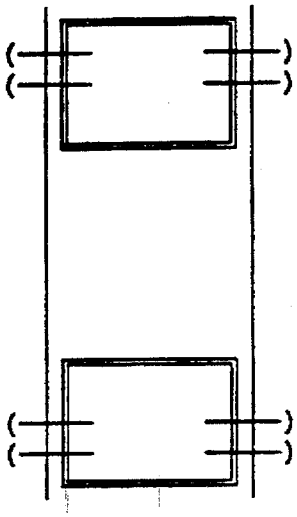
Figure 29:
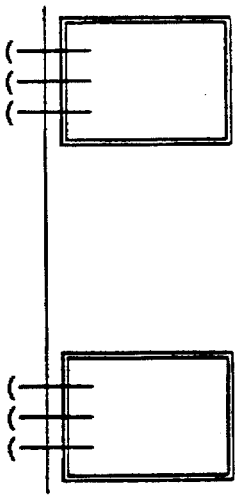
Figure 29:
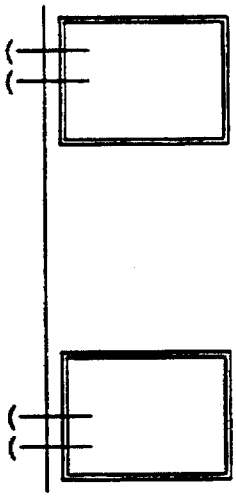
Figure 29:
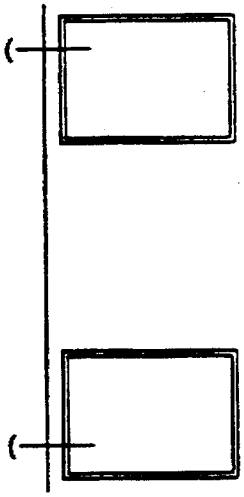
Figure 30:
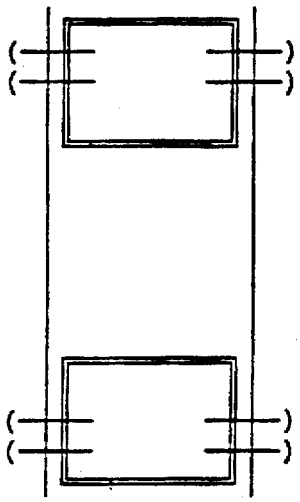
FIG. 30 shows web and screw configurations for each position code contained in Table XII.
Figure 30:
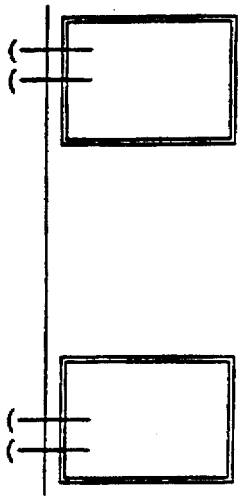
Figure 30:
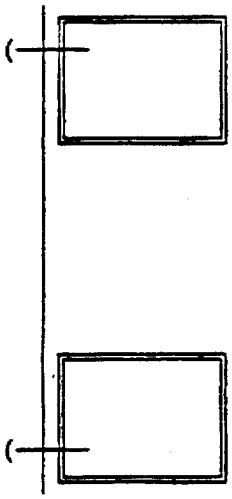

The manufacturer, given the required length, gauge of chord, depth of beam, beam spacing and applied load, enters the appropriate cell in one of Tables III(a), III(b) or III(c). The manufacturer starting at the bottom of the cell, moves up the list of values in the cell until the lowest value that exceeds the applied load is found, and notes the code of the "Connection Type" corresponding to that value. Tables IV(a) to IV(c) are then used to determine the number of webs required and the configuration code of the screws and webs to be used in assembling each beam for the frame. The screw configuration corresponding to each screw configuration code is given FIG. 28. The beam is then assembled by spacing webs evenly along each chord and fastening each web to its pair of chords by installing screws at pre-set locations (holes in each web), the number of screws used and their pattern being in accordance with the screw configurations obtained from FIG. 28. (A detailed explanation of the use of the information contained in FIGS. 28, 29 and 30 is given below.) In general, the webs are spaced evenly along a chord. If a beam is to be installed with a track with which the web may interfere then room is left at the end of the beam for the track, but each web would still be installed so that all webs are equal distances from their neighbouring webs.

It is to be understood that although the above process is divided into stages involving two people, all steps could indeed be carried out by a single person. Alternatively, an architect could specify her needs to an intermediate assembler or manufacturer who could supply assembled beams to the site of frame construction. A beam kit-of-parts could be supplied to the site of frame assembly and beams put together as needed. Using this latter approach, beams would be shipped in a more compact state to the site of use than assembled beams.

Detailed examples of the planning and manufacturing stages for sample beams are given below.

EXAMPLE 1

Wind Bearing Wall

A designer requires a wall frame having 10 foot high studs and the wall is to have a specified wind i.e., bending load of 60 psf. Studs are required to be 6" deep and the deflection requirement is L/600. The load values of Table I(a) are for a deflection limit of L/360, therefore the wind load must be corrected for the required deflection limit:

Deflection load=60 *psf*×600/360=100 *psf*

The applied wind load is calculated: Applied wind load= 60 psf×0.75=45 psf*

* AISI Cold Formed Steel Design Manual, 1986 Edition, Section A4.4

Table 1(a) is for beams which are 6" deep. The row of Table I(a) for 10 foot long beams begins with, moving left to right, load values for beams having chords of 18 Ga metal, followed by 16 Ga and finally 14 Ga. The first entry examined is for beams spaced 24" apart, center to center, (the fewest number of beams) and 18 Ga (the lightest gauge is least expensive and most light-weight).

The first entry, 6"×18 Ga @ 24":

Strength=45 psf=45 psf (required), therefore O.K.

Deflection=101 psf>100 psf (required), therefore O.K.

The designer thus notes this information for use during the next stage: the frame requires 10 foot beams rated for at least a 45 psf applied wind load; 6"×18 Ga @ 24" c/c.

The manufacturer uses the information by entering the appropriate cell of Table III(c), that is the cell for: beams spaced 24" apart in a frame; 10 feet long and 6" in depth; and having chords of 18 Ga steel. Starting at the bottom of the cell the manufacturer works up the column of values until a maximum load value greater than or equal to the specified applied load of 45 psf is found. This turns out to be the value corresponding to connection type code "C". Then, turning to Table IV(a) it is found that a ten foot long beam requires five webs and screw configuration codes for the webs are as follows:

First web: 4

Second web: 2

Third web: 1

Fourth web: 2

Fifth web: 4

The five webs are spaced evenly along the chords, and screws are installed as indicated for each code in FIG. 28.

The first and fifth webs are installed as follows. As indicated in FIG. 28 under the heading "code reference No. 4", there are actually two webs, installed at each of the first and fifth locations. The webs are located opposite to each other, on either side of the beam. Each of the pair of webs is installed using a total of six screws: two screws per triplet of holes in each leg. One of each pair of screws is installed through the center hole of each triplet and the second screw is installed in either of the two remaining holes.

The second and fourth webs are installed as follows. As indicated in FIG. 28 under heading "code reference No. 2", each web is fastened to the chords using a total of six screws: two screws per triplet of holes. Again, one screw is inserted in each center hole and the other screw of each pair is installed through either of the remaining holes of each triplet.

The center web (third web) is installed according to code reference No. 3 of FIG. 28. One screw is installed in the center hole of each of the three triplets of holes in the web.

Generally, webs are installed on the same side of a beam, although each web installed according to Screw Configuration Code 4 will have a web on the other side of the beam also.

The assembled beams would then be included in a wall frame, spaced 24" apart center to center (c/c).

EXAMPLE 2

Wind and Axial Load Bearing Wall

A designer requires a wall frame having 12 foot long studs with a 24" spacing (c/c). The specified wind load is 50 psf and the deflection requirement is L/600. A live specified axial load of 2 kips and a dead specified axial load of 2 kips is required to be supported by the frame of the wall. The beams may be either 6" or 8" deep. The load requirements of the beams are thus:

Deflection load=50×600/360=83.3 *psf*

Applied wind load=50×0.75=37.5 *psf**

Applied axial load=(2.0+2.0)×0.75=3.00 *kips**

*AISI Cold Formed Steel Design Manual, 1986 Edition, Section A4.4

Starting in Table I(a) for 6" deep beams, and alternating with corresponding values in Table I(b) for 8" deep beams, the following is found:

| | | |
|---|---|---|
| 6" × 18Ga @ 24": | strength | = 29 psf < 37.5 psf: no good |
| 8" × 18Ga @ 24": | strength | = 32 psf < 37.5 psf: no good |
| 6" × 16Ga @ 24": | strength | = 37 psf < 37.5 psf: no good |
| 8" × 16Ga @ 24": | strength | = 41 psf < 37.5 psf: O.K. |
| | deflection | = 74 psf < 83.3 psf: no good |
| 6" × 14Ga @ 24": | strength | = 46 psf > 37.5 psf: O.K. |
| | deflection | = 76 psf < 83.3 psf: no good |
| 8" × 14Ga @ 24": | strength | = 51 psf > 37.5 psf: O.K. |
| | deflection | = 88 psf > 83.3 psf: O.K. |

The first choice encountered which satisfies both criteria is thus: a 12 foot beam, 8" deep, 14 Ga @ 24" spacing (c/c). This choice however must additionally be checked to ensure that it is also capable of supporting the required axial load. Turning to Table II(c) for 24" spacing and checking the cell for a 12 foot beam, 14 Ga having an 8" depth, the following is found:

Applied wind load=40.0 psf>37.5 psf.: O.K.

Applied axial load=3.28 kips>3.00 kips O.K.

The beam configuration selected from Table I(b) in the previous step is thus suitable.

Turning to Table III(c) for 12 foot long beams, 8" deep and spaced 24" c/c, indicates the following in the 14 Ga section:

Code E: 24 psf<37.5 psf no good

Code D: 37 psf<37.5 psf no good

Code C: 49 psf>37.5 psf O.K.

The screw and web configuration for a 12 foot beam of Code C is then selected from Table IV and beams assembled accordingly with the aid of the information contained in FIG. 28.

Tables I–III list values as determined according to a "working stress analysis" which is used, for example in the United States and Caribbean countries.

Tables V–VII list values as determined according to a "limit states analysis" which is used, for example in Canada but which is known in the United States as load and resistance analysis. Table VIII and Screw configurations illustrated in the FIG. 29 are used in conjunction with Tables V–VII. Example 3, below illustrates use of tables V–VIII.

EXAMPLE 3

Wind Bearing Wall (Limit States Analysis)

A designer requires a wall frame having 10 foot high studs and the wall is to have a specified wind load of 45 psf. Studs are required to be 6" deep and the deflection requirement is L/600.

The factored wind load is:

1.5×45=67.5 *psf*

Table V(a) is for load values specifying a load limit of L/360. The required load is thus corrected:

45 *psf*×600/360=75 *psf*

In Table V(a) the row for 10 foot long beams begins with beams having chords of the narrowest gauge, 18 Ga and work through 16 Ga and 14 Ga chords. The first entry examined, for 24" spacing (c/c) is:

6"×18 *Ga* @ 24": Strength=65 *psf*<67.5 *psf* (required), therefore, no good

The next entry examined:

6"×16 *Ga* @ 24": Strength=83 *psf*>67.5 *psf* (required), therefore, O.K.

Deflection=124 psf>75 psf (required), therefore O.K.

This information is noted for the beams assembly stage: 10 inch beam rated for 67.5 psf factored wind load, 6"×16 Ga @ 24" c/c.

The manufacturer, with this information enters the appropriate cell of Table VII(c) and finds the following:

| Connection Type | Factored Load |
|---|---|
| B | 83 |
| C | 75 |
| D | 71 |
| E | 48 |
| F | 38 |
| G | 24 |

Working up from the bottom, it can be seen that Connection Type having code "D" is the first type capable of bearing the required load of 67.5 psf.

Turning to Table VIII to find that at 10 foot beam requires webs located at five locations and screw configuration codes for the webs are as follows:

First web: 3

Second web: 2

Third web: 1

Fourth web: 2

Fifth web: 3

These webs are spaced evenly along the chords and screws are installed as indicated for each code in FIG. 30.

If bridging is needed to prevent twisting, a bridge "216" of a light gauge sheet metal may be installed. It is assumed that bending loads are uniformly distributed on frame members and the listed specifications apply to simply supported beams, not to continuously supported beams (i.e. a beam supported continuously along its length). Axial loads are assumed to be concentric and evenly distributed between chords, and it is further assumed that fasteners used to secure the chords and webs do not fail. Sheet metal screws similar to "TEK" self tapping screws have been found to be suitable to pierce and pass through the chord metal, as shown in FIG. 28, for example, and to fasten the webs to the chords.

Each chord thus presents a pair of lengthwise continuous faces 262, 264, to permit location of each web at its required point in accordance with the tables. Faces 262, 264 are generally orthogonal to bearing faces 266, 268 against which flooring sheets, drywall, etc. (see FIGS. 3, 13 and 28, for example) bear and are thus referred to as non-bearing faces.

In the illustrated embodiments non-bearing faces 262, 264 oppose each other such that webs may be attached on opposite sides of the beam. As illustrated in FIGS. 28 to 30, there are certain configurations in which webs are required to be fastened to both of faces 262, 264. It will be appreciated that once installed, beams of the present invention can be strengthened or reinforced so long as access is obtainable to non-bearing faces of the installed beams for placement and fastening of the additional webs. Using the tables disclosed herein, webs can be spaced along and fastened to accessible non-bearing faces of beams so that a structure can meet higher load-bearing requirements than originally desired. The load bearing capacity of a pre-existing structure composed of beams disclosed herein may thus be increased without additional beams. In the case of flooring joists, as for example as shown in Example 13, in which the installed beam is accessible from below the floor, there would generally be no need to disturb the flooring in order to strengthen the load-bearing capacity of the underlying frame structure.

Description of An Alternate Embodiment

Figure 26:
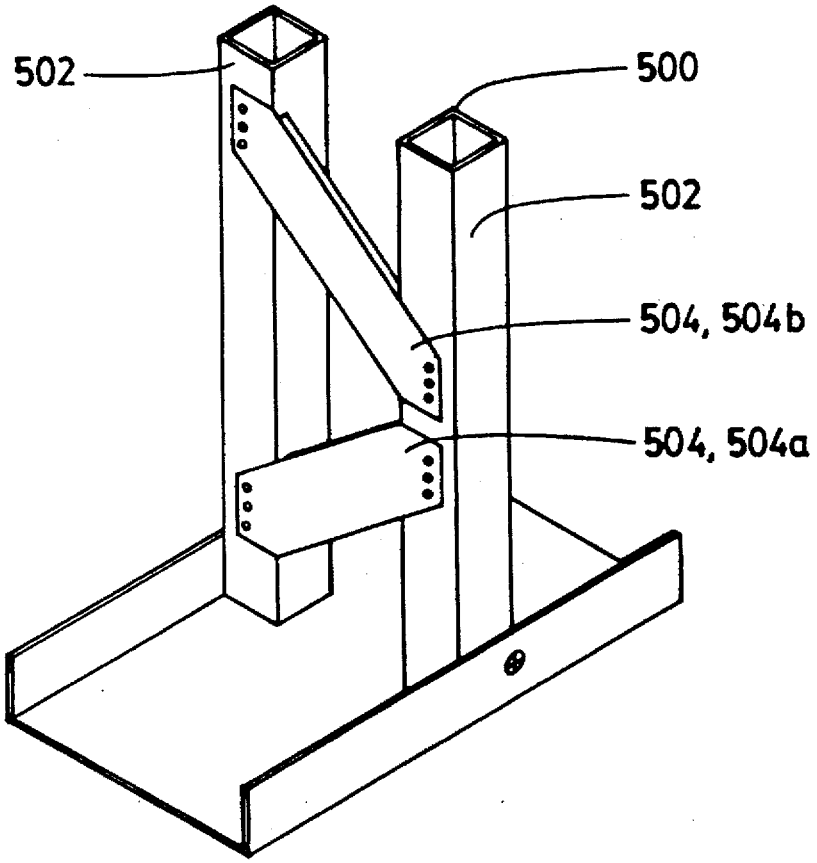
FIG. 26 is an isometric view of part of an alternate embodiment beam of the present invention, in place as a stud.
Figure 27:
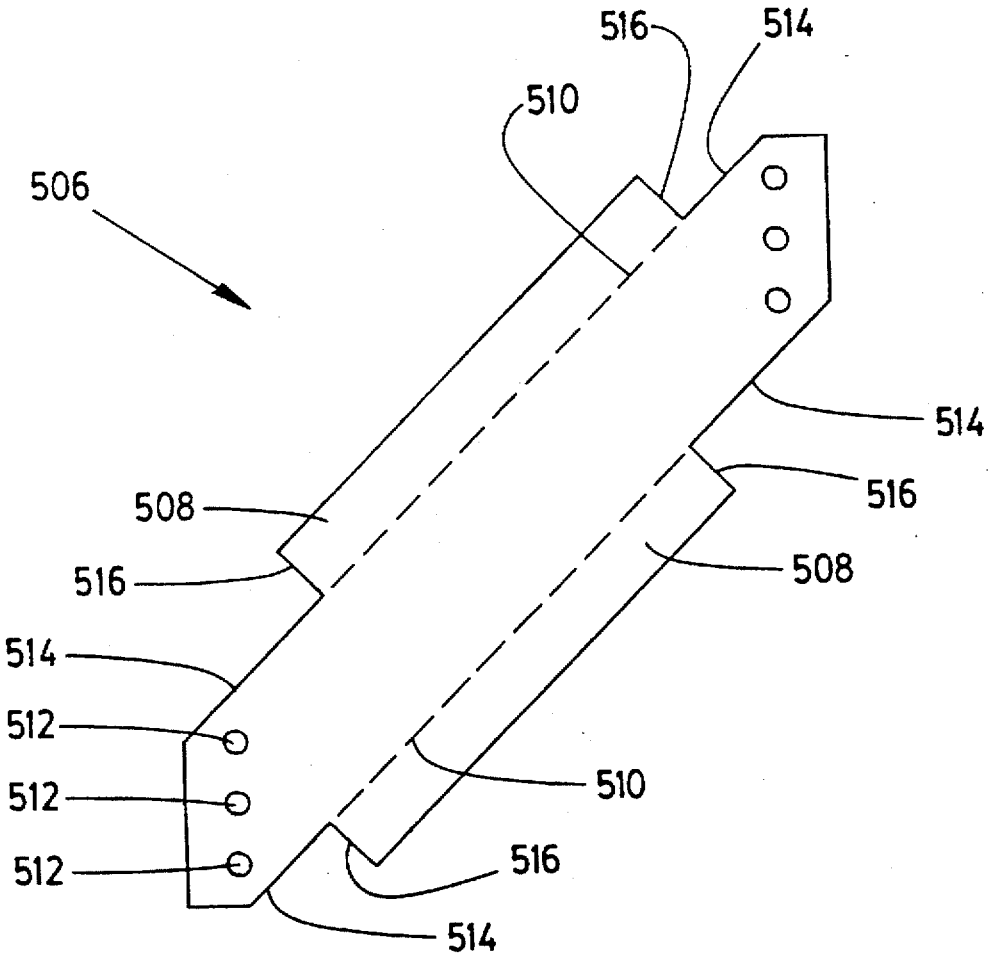
FIG. 27 is a plan view of a sheet metal blank of a web for a beam of the FIG. 26 embodiment.

An alternate embodiment of the present invention is illustrated in FIGS. 26 and 27. Beam 500 positioned for use as a stud is shown in FIG. 26. Beams of the alternate embodiment may be used analagously to those of the preferred embodiment beam. Beam 500 includes chords 502, which are the same as chords 42 described for the preferred embodiment, and single-legged webs 504. A blank 506 for web 504 is shown in FIG. 27. Webs 504*a* and 504*b* may be made from the same blank, but while lips 508 of blank 506 are turned down (through the page as indicated in FIG. 27) along fold lines 510 for web 504*a*, lips 508 are turned up to form web 504*b*. Paired webs 504*a* and 504*b* when assembled with chords 502 are at a right angle to each other.

Fastener holes 512 of each triplet are located so as to be on a center line of the side of the chord to which the web is fastened as part of a beam. The holes of each triplet are evenly spaced being about 0.5 inches apart while the center hole of each triplet is located on a center line of the leg, as defined between its edges 514. Lip ends 516 when bent to shape in the web act as a jig to locate chords with respect to the web, fastener holes being thus properly located, and to locate chords so as to be parallel with each other.

Tables IX to XII (limit states analysis) and FIG. 30 are used in analogy to the way Tables V to VIII and FIG. 29 are used in connection with the preferred embodiment.

Interpreting the Information Contained in FIGS. 28, 29 and 30

FIG. 28, for example, illustrates the configurations of screws for the fastening of a web (or webs) to a pair of beams corresponding to the "code reference number" given for each position listed in Table IV. According to Table IV, beam configuration code "A" for a beam between eight and twelve feet in length requires webs to be installed at five positions. The first and fifth positions (the end positions) have webs installed according to code reference No. 4, the second and fourth positions have webs installed according to code reference No. 2 and the third position (center position) has a web installed according to code reference No. 1.

Under the heading "code reference No. 4" in FIG. 28 is shown diagramtically a beam at the indicated positions (first and fifth positions). The drawing thus indicates that at each position two webs are installed, one on either side of the beam, and two screws are installed in each triplet of holes. Generally speaking, a screw is always installed in the center hole of each triplet and either of the two remaining holes may be used for the second of a pair of screws.

According to code reference No. 2, for installation of webs at the second and fourth positions, only one web is required at each position to fasten the two chords together. Two screws are installed in each triplet of holes, one of the screws being required to be installed in the center hole of the triplet.

According to code reference No. 1, one web is required at the center position of the beam and a screw must be installed in the center hole of each triplet.

FIG. 29 is used in the same way in conjunction with Table VIII while FIG. 30 is correspondingly used with Table XII.

It will be evident from the foregoing that the present invention provides, at least as practised according to the disclosed embodiments, a number of advantages.

By using a beam tailored to the requirements of a particular application the cost and weight of material may be reduced along with labor. The strength of a beam can be varied by altering the gauge of the tubing, i.e. chord, used and/or by changing the number of screws used to fasten the chords and beams together without altering the overall dimension of the beam. Further, beams of the disclosed embodiments are generally light-weight enough for handling by one or two people without the use of lifting equipment.

The size of the web may be changed to alter the load-bearing capacity of a beam. The strength of a frame may be varied by altering the spacing of beams, if necessary.

A frame may be strengthened in a particular region by double beaming or possibly by using beams of increased strength in that region.

It would be possible to strengthen the weak transverse axis of an individual beam of the present invention by assembling a beam incorporating four chords, arranged in a square array and joined by preferred webs disclosed above. In this way, a beam with greater resistance to twisting forces than beams having only two chords can be obtained, and be used outside of a frame-supporting surface, as a single column for example.

The foregoing description of the preferred embodiment describes the best mode for practising the invention known to the inventor and it is not intended to limit the scope of protection for the invention, which is defined by the claims which follow.

TABLE I(a)

6" BEAM WIND LOAD TABLE
MAXIMUM UNIFORMLY DISTRIBUTED SINGLE BEAM LOAD (psf)
"Working Stress"
Strength Loads and Deflection Loads are Specified

| Beam Length Ft. | Strength or Deflection | Beam Spacing (in; c/c) 6" × 18GA 12 | 16 | 24 | 6" × 16GA 12 | 16 | 24 | 6" × 14GA 12 | 16 | 24 |
|---|---|---|---|---|---|---|---|---|---|---|
| 8 | STRENGTH | 171 | 128 | 85 | 220 | 165 | 110 | 273 | 204 | 136 |
| | L/360 | 468 | 351 | 234 | 556 | 417 | 278 | 636 | 477 | 318 |
| 8½ | STRENGTH | 144 | 108 | 72 | 186 | 139 | 93 | 230 | 172 | 115 |
| | L/360 | 373 | 280 | 187 | 443 | 332 | 222 | 516 | 387 | 258 |
| 9 | STRENGTH | 124 | 93 | 62 | 160 | 120 | 80 | 198 | 149 | 99 |
| | L/360 | 300 | 225 | 150 | 362 | 272 | 181 | 417 | 313 | 209 |
| 9½ | STRENGTH | 105 | 78 | 52 | 135 | 101 | 68 | 167 | 125 | 83 |
| | L/360 | 244 | 183 | 122 | 296 | 222 | 148 | 348 | 261 | 174 |
| 10 | STRENGTH | 90 | 68 | 45 | 116 | 87 | 58 | 149 | 112 | 74 |
| | L/360 | 202 | 152 | 101 | 247 | 185 | 124 | 290 | 218 | 145 |
| 10½ | STRENGTH | 82 | 61 | 44 | 105 | 79 | 53 | 130 | 98 | 65 |
| | L/360 | 168 | 126 | 84 | 206 | 155 | 103 | 243 | 182 | 122 |
| 11 | STRENGTH | 70 | 53 | 35 | 93 | 70 | 47 | 115 | 86 | 58 |
| | L/360 | 142 | 106 | 71 | 175 | 131 | 87 | 206 | 155 | 103 |
| 11½ | STRENGTH | 63 | 48 | 32 | 82 | 61 | 41 | 101 | 76 | 51 |
| | L/360 | 121 | 90 | 60 | 149 | 112 | 74 | 177 | 132 | 88 |
| 12 | STRENGTH | 58 | 43 | 29 | 74 | 56 | 37 | 92 | 69 | 46 |
| | L/360 | 103 | 77 | 52 | 128 | 96 | 64 | 152 | 114 | 76 |
| 13 | STRENGTH | 53 | 40 | 27 | 69 | 52 | 34 | 85 | 64 | 43 |
| | L/360 | 117 | 88 | 59 | 148 | 111 | 74 | 171 | 129 | 86 |
| 14 | STRENGTH | 44 | 33 | 22 | 57 | 43 | 29 | 71 | 53 | 35 |
| | L/360 | 90 | 68 | 45 | 112 | 84 | 56 | 133 | 100 | 67 |
| 15 | STRENGTH | 38 | 28 | 19 | 49 | 37 | 24 | 60 | 45 | 30 |
| | L/360 | 71 | 53 | 35 | 88 | 66 | 44 | 106 | 79 | 53 |
| 16 | STRENGTH | 32 | 24 | 16 | 42 | 31 | 21 | 52 | 39 | 26 |
| | L/360 | 57 | 43 | 28 | 71 | 53 | 35 | 85 | 64 | 42 |
| 17 | STRENGTH | 31 | 23 | 15 | 40 | 30 | 20 | 50 | 37 | 25 |
| | L/360 | 59 | 44 | 29 | 74 | 55 | 37 | 88 | 66 | 44 |
| 18 | STRENGTH | 27 | 20 | 13 | 35 | 26 | 17 | 43 | 32 | 22 |
| | L/360 | 48 | 36 | 24 | 61 | 45 | 30 | 73 | 55 | 36 |
| 19 | STRENGTH | 24 | 18 | 12 | 31 | 23 | 15 | 38 | 28 | 19 |
| | L/360 | 40 | 30 | 20 | 51 | 38 | 25 | 61 | 46 | 30 |
| 20 | STRENGTH | 23 | 17 | 11 | 30 | 22 | 15 | 37 | 27 | 18 |
| | L/360 | 42 | 32 | 21 | 53 | 40 | 27 | 64 | 48 | 32 |
| 22 | STRENGTH | 18 | 14 | 9 | 24 | 18 | 12 | 29 | 22 | 15 |
| | L/360 | 31 | 23 | 15 | 39 | 29 | 19 | 47 | 35 | 23 |
| 24 | STRENGTH | 16 | 12 | 8 | 21 | 16 | 10 | 26 | 19 | 13 |
| | L/360 | 27 | 20 | 13 | 34 | 25 | 17 | 41 | 31 | 20 |

TABLE I(b)

8" BEAM WIND LOAD TABLE
MAXIMUM UNIFORMLY DISTRIBUTED SINGLE BEAM LOAD (psf)
"Working Stress"
Strength Loads and Deflection Loads are Specified

| Beam Length Ft. | Strength or Deflection | Beam Spacing (in; c/c) 8" × 18GA 12 | 8" × 18GA 16 | 8" × 18GA 24 | 8" × 16GA 12 | 8" × 16GA 16 | 8" × 16GA 24 | 8" × 14GA 12 | 8" × 14GA 16 | 8" × 14GA 24 |
|---|---|---|---|---|---|---|---|---|---|---|
| 8 | STRENGTH | 194 | 146 | 97 | 251 | 188 | 126 | 310 | 233 | 155 |
| | L/360 | 607 | 455 | 303 | 721 | 541 | 360 | 809 | 607 | 405 |
| 8½ | STRENGTH | 163 | 122 | 82 | 210 | 158 | 105 | 260 | 195 | 130 |
| | L/360 | 473 | 354 | 236 | 556 | 417 | 278 | 644 | 483 | 322 |
| 9 | STRENGTH | 140 | 105 | 70 | 180 | 135 | 90 | 224 | 168 | 112 |
| | L/360 | 371 | 278 | 186 | 449 | 337 | 225 | 518 | 389 | 259 |
| 9½ | STRENGTH | 117 | 88 | 59 | 151 | 113 | 76 | 187 | 140 | 94 |
| | L/360 | 299 | 224 | 150 | 360 | 270 | 180 | 423 | 317 | 211 |
| 10 | STRENGTH | 105 | 79 | 52 | 135 | 101 | 68 | 167 | 125 | 84 |
| | L/360 | 244 | 183 | 122 | 295 | 221 | 148 | 347 | 260 | 174 |
| 10½ | STRENGTH | 91 | 68 | 46 | 117 | 88 | 59 | 145 | 109 | 73 |
| | L/360 | 200 | 150 | 100 | 245 | 184 | 122 | 290 | 217 | 145 |
| 11 | STRENGTH | 81 | 60 | 40 | 104 | 78 | 52 | 128 | 96 | 64 |
| | L/360 | 167 | 125 | 83 | 205 | 154 | 103 | 243 | 182 | 122 |
| 11½ | STRENGTH | 70 | 53 | 35 | 91 | 68 | 45 | 112 | 84 | 56 |
| | L/360 | 141 | 105 | 70 | 174 | 130 | 87 | 206 | 155 | 103 |
| 12 | STRENGTH | 64 | 48 | 32 | 82 | 62 | 41 | 101 | 76 | 51 |
| | L/360 | 120 | 90 | 60 | 148 | 111 | 74 | 176 | 132 | 88 |
| 13 | STRENGTH | 62 | 46 | 31 | 80 | 60 | 40 | 98 | 74 | 49 |
| | L/360 | 147 | 110 | 74 | 181 | 135 | 90 | 214 | 160 | 107 |
| 14 | STRENGTH | 51 | 38 | 25 | 65 | 49 | 33 | 81 | 61 | 40 |
| | L/360 | 111 | 84 | 56 | 138 | 103 | 69 | 164 | 123 | 82 |
| 15 | STRENGTH | 43 | 32 | 22 | 55 | 41 | 28 | 69 | 52 | 35 |
| | L/360 | 86 | 65 | 43 | 107 | 80 | 54 | 128 | 96 | 64 |
| 16 | STRENGTH | 37 | 28 | 18 | 47 | 35 | 24 | 58 | 44 | 29 |
| | L/360 | 68 | 51 | 34 | 85 | 64 | 43 | 102 | 76 | 51 |
| 17 | STRENGTH | 36 | 27 | 18 | 46 | 35 | 23 | 57 | 43 | 29 |
| | L/360 | 76 | 57 | 38 | 94 | 71 | 47 | 113 | 85 | 57 |
| 18 | STRENGTH | 31 | 23 | 16 | 40 | 30 | 20 | 50 | 37 | 25 |
| | L/360 | 62 | 46 | 31 | 77 | 58 | 39 | 92 | 69 | 46 |
| 19 | STRENGTH | 28 | 21 | 14 | 36 | 27 | 18 | 44 | 33 | 22 |
| | L/360 | 51 | 38 | 25 | 64 | 48 | 32 | 76 | 57 | 38 |
| 20 | STRENGTH | 27 | 20 | 13 | 35 | 26 | 17 | 43 | 32 | 21 |
| | L/360 | 57 | 43 | 28 | 71 | 53 | 36 | 85 | 64 | 43 |
| 22 | STRENGTH | 21 | 16 | 11 | 28 | 21 | 14 | 34 | 26 | 17 |
| | L/360 | 41 | 30 | 20 | 51 | 38 | 25 | 61 | 46 | 31 |
| 24 | STRENGTH | 19 | 14 | 10 | 25 | 19 | 12 | 31 | 23 | 15 |
| | L/360 | 37 | 28 | 18 | 46 | 35 | 23 | 56 | 42 | 28 |

TABLE II(a)

BEAM COMBINED WIND AND AXIAL LOAD TABLE
MAXIMUM SPECIFIED AXIAL LOAD (kips)
12" c/c "Working Stress"

| DEPTH in. | GAUGE | WIND psf | LENGTH 8'-0" | 8'-6" | 9'-0" | 9'-6" | 10'-0" | 10'-6" | 11'-0" | 11'-6" | 12'-0" |
|---|---|---|---|---|---|---|---|---|---|---|---|
| 6 | 18 | 10 | 7.52 | 7.36 | 7.22 | 7.02 | 6.84 | 6.70 | 6.46 | 6.30 | 6.12 |
| | | 20 | 6.82 | 6.58 | 6.32 | 6.00 | 5.68 | 5.46 | 5.08 | 4.80 | 4.52 |
| | | 30 | 6.20 | 5.86 | 5.54 | 5.10 | 4.68 | 4.38 | 3.90 | 3.52 | 3.16 |
| | | 40 | 5.64 | 5.22 | 4.82 | 4.28 | 3.78 | 3.42 | 2.82 | 2.38 | 1.94 |
| | | 50 | 5.10 | 4.62 | 4.14 | 3.52 | 2.94 | 2.52 | 1.84 | 1.32 | 0.80 |
| | 16 | 10 | 10.02 | 9.86 | 9.70 | 9.50 | 9.28 | 9.14 | 8.94 | 8.70 | 8.52 |
| | | 20 | 9.28 | 9.00 | 8.74 | 8.38 | 8.04 | 7.80 | 7.46 | 7.06 | 6.76 |
| | | 30 | 8.62 | 8.24 | 7.88 | 7.40 | 6.94 | 6.62 | 6.20 | 5.68 | 5.28 |
| | | 40 | 8.00 | 7.54 | 7.10 | 6.52 | 5.96 | 5.58 | 5.04 | 4.42 | 3.94 |
| | | 50 | 7.44 | 6.88 | 6.38 | 5.70 | 5.04 | 4.60 | 3.98 | 3.26 | 2.70 |
| | 14 | 10 | 12.72 | 12.56 | 12.40 | 12.16 | 12.00 | 11.78 | 11.58 | 11.30 | 11.10 |
| | | 20 | 11.94 | 11.64 | 11.36 | 10.96 | 10.70 | 10.34 | 9.98 | 9.54 | 9.22 |
| | | 30 | 11.24 | 10.82 | 10.44 | 9.92 | 9.56 | 9.08 | 8.60 | 8.04 | 7.60 |
| | | 40 | 10.58 | 10.08 | 9.60 | 8.96 | 8.52 | 7.94 | 7.36 | 6.68 | 6.16 |
| | | 50 | 9.96 | 9.38 | 8.82 | 8.08 | 7.56 | 6.88 | 6.22 | 5.44 | 4.82 |
| 8 | 18 | 10 | 7.56 | 7.42 | 7.28 | 7.08 | 6.96 | 6.76 | 6.60 | 6.38 | 6.22 |

TABLE II(a)-continued

BEAM COMBINED WIND AND AXIAL LOAD TABLE
MAXIMUM SPECIFIED AXIAL LOAD (kips)
12" c/c "Working Stress"

| DEPTH | | WIND | LENGTH | | | | | | | | |
|---|---|---|---|---|---|---|---|---|---|---|---|
| in. | GAUGE | psf | 8'-0" | 8'-6" | 9'-0" | 9'-6" | 10'-0" | 10'-6" | 11'-0" | 11'-6" | 12'-0" |
| | | 20 | 6.92 | 6.68 | 6.44 | 6.12 | 5.90 | 5.62 | 5.32 | 4.98 | 4.72 |
| | | 30 | 6.34 | 6.02 | 5.70 | 5.28 | 5.00 | 4.62 | 4.24 | 3.80 | 3.46 |
| | | 40 | 5.82 | 5.42 | 5.04 | 4.54 | 4.18 | 3.72 | 3.28 | 2.74 | 2.34 |
| | | 50 | 5.32 | 4.86 | 4.42 | 3.84 | 3.44 | 2.90 | 2.40 | 1.78 | 1.30 |
| | 16 | 10 | 10.06 | 9.90 | 9.76 | 9.56 | 9.42 | 9.22 | 9.02 | 8.80 | 8.62 |
| | | 20 | 9.38 | 9.10 | 8.84 | 8.50 | 8.26 | 7.90 | 7.64 | 7.26 | 6.96 |
| | | 30 | 8.76 | 8.40 | 8.04 | 7.60 | 7.28 | 6.86 | 6.44 | 5.94 | 5.58 |
| | | 40 | 8.18 | 7.74 | 7.32 | 6.76 | 6.40 | 5.88 | 5.38 | 4.78 | 4.34 |
| | | 50 | 7.66 | 7.14 | 6.64 | 6.00 | 5.56 | 4.98 | 4.40 | 3.72 | 3.20 |
| | 14 | 10 | 12.76 | 12.60 | 12.44 | 12.22 | 12.08 | 11.86 | 11.66 | 11.40 | 11.20 |
| | | 20 | 12.04 | 11.74 | 11.48 | 11.10 | 10.84 | 10.48 | 10.14 | 9.74 | 9.42 |
| | | 30 | 11.36 | 10.98 | 10.62 | 10.10 | 9.76 | 9.30 | 8.86 | 8.32 | 7.90 |
| | | 40 | 10.76 | 10.28 | 9.82 | 9.22 | 8.80 | 8.24 | 7.70 | 7.06 | 6.56 |
| | | 50 | 10.08 | 9.62 | 9.10 | 8.38 | 7.92 | 7.26 | 6.64 | 5.90 | 5.32 |

TABLE II(b)

BEAM COMBINED WIND AND AXIAL LOAD TABLE
MAXIMUM SPECIFIED AXIAL LOAD (kips)
16" c/c "Working Stress"

| DEPTH | | WIND | LENGTH | | | | | | | | |
|---|---|---|---|---|---|---|---|---|---|---|---|
| in. | GAUGE | psf | 8'-0" | 8'-6" | 9'-0" | 9'-6" | 10'-0" | 10'-6" | 11'-0" | 11'-6" | 12'-0" |
| 6 | 18 | 10 | 5.64 | 5.52 | 5.41 | 5.26 | 5.13 | 5.02 | 4.84 | 4.72 | 4.59 |
| | | 20 | 5.11 | 4.93 | 4.74 | 4.50 | 4.26 | 4.09 | 3.81 | 3.60 | 3.39 |
| | | 30 | 4.65 | 4.39 | 4.15 | 3.82 | 3.51 | 3.28 | 2.92 | 2.64 | 2.37 |
| | | 40 | 4.23 | 3.91 | 3.61 | 3.21 | 2.83 | 2.56 | 2.11 | 1.78 | 1.45 |
| | | 50 | 3.82 | 3.46 | 3.10 | 2.64 | 2.20 | 1.89 | 1.38 | 0.99 | 0.60 |
| | 16 | 10 | 7.51 | 7.39 | 7.27 | 7.12 | 6.96 | 6.85 | 6.70 | 6.52 | 6.39 |
| | | 20 | 6.96 | 6.75 | 6.55 | 6.28 | 6.03 | 5.85 | 5.59 | 5.29 | 5.07 |
| | | 30 | 6.46 | 6.18 | 5.91 | 5.55 | 5.20 | 4.96 | 4.65 | 4.26 | 3.96 |
| | | 40 | 6.00 | 5.65 | 5.32 | 4.89 | 4.47 | 4.18 | 3.78 | 3.31 | 2.95 |
| | | 50 | 5.58 | 5.16 | 4.78 | 4.27 | 3.78 | 3.45 | 2.98 | 2.44 | 2.02 |
| | 14 | 10 | 9.54 | 9.42 | 9.30 | 9.12 | 9.00 | 8.83 | 8.68 | 8.47 | 8.32 |
| | | 20 | 8.95 | 8.73 | 8.52 | 8.22 | 8.02 | 7.75 | 7.48 | 7.15 | 6.91 |
| | | 30 | 8.43 | 8.11 | 7.83 | 7.44 | 7.17 | 6.81 | 6.45 | 6.03 | 5.70 |
| | | 40 | 7.93 | 7.56 | 7.20 | 6.72 | 6.39 | 5.95 | 5.52 | 5.01 | 4.62 |
| | | 50 | 7.47 | 7.03 | 6.61 | 6.06 | 5.67 | 5.16 | 4.66 | 4.08 | 3.61 |
| 8 | 18 | 10 | 5.67 | 5.56 | 5.46 | 5.31 | 5.22 | 5.07 | 4.95 | 4.78 | 4.66 |
| | | 20 | 5.19 | 5.01 | 4.83 | 4.59 | 4.42 | 4.21 | 3.99 | 3.73 | 3.54 |
| | | 30 | 4.75 | 4.51 | 4.27 | 3.96 | 3.75 | 3.46 | 3.18 | 2.85 | 2.59 |
| | | 40 | 4.36 | 4.06 | 3.78 | 3.40 | 3.13 | 2.79 | 2.46 | 2.05 | 1.75 |
| | | 50 | 3.99 | 3.64 | 3.31 | 2.88 | 2.58 | 2.17 | 1.80 | 1.33 | 0.97 |
| | 16 | 10 | 7.54 | 7.42 | 7.32 | 7.17 | 7.06 | 6.91 | 6.76 | 6.60 | 6.46 |
| | | 20 | 7.03 | 6.82 | 6.63 | 6.37 | 6.19 | 5.92 | 5.73 | 5.44 | 5.22 |
| | | 30 | 6.57 | 6.30 | 6.03 | 5.70 | 5.46 | 5.14 | 4.83 | 4.45 | 4.18 |
| | | 40 | 6.13 | 5.80 | 5.49 | 5.07 | 4.80 | 4.41 | 4.03 | 3.58 | 3.25 |
| | | 50 | 5.74 | 5.35 | 4.98 | 4.50 | 4.17 | 3.73 | 3.30 | 2.79 | 2.40 |
| | 14 | 10 | 9.57 | 9.45 | 9.33 | 9.16 | 9.06 | 8.89 | 8.74 | 8.55 | 8.40 |
| | | 20 | 9.03 | 8.80 | 8.61 | 8.32 | 8.13 | 7.86 | 7.60 | 7.30 | 7.06 |
| | | 30 | 8.52 | 8.23 | 7.96 | 7.57 | 7.32 | 6.97 | 6.64 | 6.24 | 5.92 |
| | | 40 | 8.07 | 7.71 | 7.36 | 6.91 | 6.60 | 6.18 | 5.77 | 5.29 | 4.92 |
| | | 50 | 7.56 | 7.21 | 6.82 | 6.28 | 5.94 | 5.44 | 4.98 | 4.42 | 3.99 |

TABLE II(c)

BEAM COMBINED WIND AND AXIAL LOAD TABLE
MAXIMUM SPECIFIED AXIAL LOAD (kips)
24" c/c "Working Stress"

| DEPTH | | WIND | LENGTH | | | | | | | | |
|---|---|---|---|---|---|---|---|---|---|---|---|
| in. | GAUGE | psf | 8'-0" | 8'-6" | 9'-0" | 9'-6" | 10'-0" | 10'-6" | 11'-0" | 11'-6" | 12'-0" |
| 6 | 18 | 10 | 3.76 | 3.68 | 3.61 | 3.51 | 3.42 | 3.35 | 3.23 | 3.15 | 3.06 |
| | | 20 | 3.41 | 3.29 | 3.16 | 3.00 | 2.84 | 2.73 | 2.54 | 2.40 | 2.26 |
| | | 30 | 3.10 | 2.93 | 2.77 | 2.55 | 2.34 | 2.19 | 1.95 | 1.76 | 1.58 |
| | | 40 | 2.82 | 2.61 | 2.41 | 2.14 | 1.89 | 1.71 | 1.41 | 1.19 | 0.97 |
| | | 50 | 2.55 | 2.31 | 2.07 | 1.76 | 1.47 | 1.26 | 0.92 | 0.66 | 0.40 |
| | 16 | 10 | 5.01 | 4.93 | 4.85 | 4.75 | 4.64 | 4.57 | 4.47 | 4.35 | 4.26 |
| | | 20 | 4.64 | 4.50 | 4.37 | 4.19 | 4.02 | 3.90 | 3.73 | 3.53 | 3.38 |
| | | 30 | 4.31 | 4.12 | 3.94 | 3.70 | 3.47 | 3.31 | 3.10 | 2.84 | 2.64 |
| | | 40 | 4.00 | 3.77 | 3.55 | 3.26 | 2.98 | 2.79 | 2.52 | 2.21 | 1.97 |
| | | 50 | 3.72 | 3.44 | 3.19 | 2.85 | 2.52 | 2.30 | 1.99 | 1.63 | 1.35 |
| | 14 | 10 | 6.36 | 6.28 | 6.20 | 6.68 | 6.00 | 5.89 | 5.79 | 5.65 | 5.55 |
| | | 20 | 5.97 | 5.82 | 5.68 | 5.48 | 5.35 | 5.17 | 4.99 | 4.77 | 4.61 |
| | | 30 | 5.62 | 5.41 | 5.22 | 4.96 | 4.78 | 4.54 | 4.30 | 4.02 | 3.80 |
| | | 40 | 5.29 | 5.04 | 4.80 | 4.48 | 4.26 | 3.97 | 3.68 | 3.34 | 3.08 |
| | | 50 | 4.98 | 4.69 | 4.41 | 4.04 | 3.78 | 3.44 | 3.11 | 2.72 | 2.41 |
| 8 | 18 | 10 | 3.78 | 3.71 | 3.64 | 3.54 | 3.48 | 3.38 | 3.30 | 3.19 | 3.11 |
| | | 20 | 3.46 | 3.34 | 3.22 | 3.06 | 2.95 | 2.81 | 2.66 | 2.49 | 2.36 |
| | | 30 | 3.17 | 3.01 | 2.85 | 2.64 | 2.50 | 2.31 | 2.12 | 1.90 | 1.73 |
| | | 40 | 2.91 | 2.71 | 2.52 | 2.27 | 2.09 | 1.86 | 1.64 | 1.37 | 1.17 |
| | | 50 | 2.66 | 2.43 | 2.21 | 1.92 | 1.72 | 1.45 | 1.20 | 0.89 | 0.65 |
| | 16 | 10 | 5.03 | 4.95 | 4.88 | 4.78 | 4.71 | 4.61 | 4.51 | 4.40 | 4.31 |
| | | 20 | 4.69 | 4.55 | 4.42 | 4.25 | 4.13 | 3.95 | 3.82 | 3.63 | 3.48 |
| | | 30 | 4.38 | 4.20 | 4.02 | 3.80 | 3.64 | 3.43 | 3.22 | 2.97 | 2.79 |
| | | 40 | 4.09 | 3.87 | 3.66 | 3.38 | 3.20 | 2.94 | 2.69 | 2.39 | 2.17 |
| | | 50 | 3.83 | 3.57 | 3.32 | 3.00 | 2.78 | 2.49 | 2.20 | 1.86 | 1.60 |
| | 14 | 10 | 6.38 | 6.30 | 6.22 | 6.11 | 6.04 | 5.93 | 5.83 | 5.70 | 5.60 |
| | | 20 | 6.02 | 5.87 | 5.74 | 5.55 | 5.42 | 5.24 | 5.07 | 4.87 | 4.71 |
| | | 30 | 5.68 | 5.49 | 5.31 | 5.05 | 4.88 | 4.65 | 4.43 | 4.16 | 3.95 |
| | | 40 | 5.38 | 5.14 | 4.91 | 4.61 | 4.40 | 4.12 | 3.85 | 3.53 | 3.28 |
| | | 50 | 5.04 | 4.81 | 4.55 | 4.19 | 3.96 | 3.63 | 3.32 | 2.95 | 2.66 |

TABLE III(a)

LIMITING LOAD FOR SCREW FASTENER CONFIGURATIONS
12" Spacing "Working Stress"

| Specified Load (psf) | | | | | | | | | | | |
|---|---|---|---|---|---|---|---|---|---|---|---|
| Beam | | Connection | Beam Length (ft) | | | | | | | | |
| Description | | Type | 8 | 8½ | 9 | 9½ | 10 | 10½ | 11 | 11½ | 12 |
| 6" | 18Ga | A | — | — | — | — | — | — | — | — | — |
| | | B | 171 | — | — | — | — | — | — | — | — |
| | | C | 163 | 144 | 124 | 105 | 90 | 82 | 70 | 63 | 58 |
| | | D | 135 | 116 | 104 | 92 | 82 | 74 | 68 | 62 | 57 |
| | | E | 81 | 72 | 64 | 58 | 52 | 47 | 43 | 39 | 36 |
| | 16Ga | A | 220 | 186 | 160 | — | — | — | — | — | — |
| | | B | 192 | 170 | 152 | 135 | 116 | 105 | 93 | 82 | — |
| | | C | 169 | 149 | 133 | 120 | 108 | 97 | 89 | 81 | 74 |
| | | D | 140 | 121 | 108 | 96 | 85 | 77 | 70 | 64 | 59 |
| | | E | 84 | 74 | 67 | 60 | 54 | 49 | 44 | 40 | 37 |
| | 14Ga | A | 273 | 230 | 198 | 167 | 149 | 130 | 115 | 101 | 92 |
| | | B | 192 | 170 | 152 | 136 | 123 | 111 | 101 | 92 | 85 |
| | | C | 178 | 157 | 141 | 126 | 114 | 103 | 94 | 85 | 79 |
| | | D | 148 | 127 | 114 | 121 | 90 | 81 | 74 | 68 | 62 |
| | | E | 89 | 79 | 70 | 63 | 57 | 51 | 47 | 43 | 39 |
| 8" | 18Ga | A | — | — | — | — | — | — | — | — | — |
| | | B | — | — | — | — | — | — | — | — | — |
| | | C | 194 | 163 | 140 | 117 | 105 | 91 | 81 | — | — |
| | | D | 157 | 138 | 123 | 109 | 98 | 89 | 80 | 70 | 64 |
| | | E | 101 | 89 | 79 | 71 | 64 | 58 | 53 | 49 | 44 |
| | 16Ga | A | 251 | 210 | — | — | — | — | — | — | |
| | | B | 234 | 206 | 180 | 151 | 135 | — | — | — | |
| | | C | 209 | 184 | 165 | 147 | 133 | 117 | 104 | 91 | 81 |
| | | D | 163 | 143 | 127 | 113 | 101 | 92 | 83 | 76 | 70 |
| | | E | 104 | 92 | 82 | 74 | 67 | 60 | 55 | 50 | 46 |
| | 14Ga | A | 310 | 260 | 224 | 187 | 167 | 145 | 128 | — | — |

TABLE III(a)-continued

LIMITING LOAD FOR SCREW FASTENER CONFIGURATIONS
12" Spacing "Working Stress"

| | | | | | | | | | | |
|---|---|---|---|---|---|---|---|---|---|---|
| B | 234 | 206 | 184 | 165 | 149 | 135 | 123 | 112 | 101 |
| C | 221 | 194 | 174 | 156 | 141 | 127 | 116 | 106 | 97 |
| D | 172 | 151 | 134 | 119 | 107 | 97 | 88 | 80 | 74 |
| E | 110 | 97 | 87 | 78 | 70 | 64 | 58 | 53 | 49 |

Specified Load (psf)

| Beam Description | | Connection Type | Beam Length (ft) 13 | 14 | 15 | 16 | 17 | 18 | 19 | 20 | 22 | 24 |
|---|---|---|---|---|---|---|---|---|---|---|---|---|
| 6" | 18Ga | A | — | — | — | — | — | — | — | — | — | — |
| | | B | — | — | — | — | — | — | — | — | — | — |
| | | C | 53 | 44 | 38 | 32 | 31 | — | — | — | — | — |
| | | D | 49 | 42 | 37 | 32 | 30 | 27 | 24 | 23 | 18 | 16 |
| | | E | 36 | 31 | 27 | 23 | 23 | 21 | 19 | 19 | 16 | 14 |
| | 16Ga | A | — | — | — | — | — | — | — | — | — | — |
| | | B | — | — | — | — | — | — | — | — | — | — |
| | | C | 69 | 57 | 49 | 42 | 40 | 35 | 31 | 30 | 24 | 21 |
| | | D | 51 | 44 | 38 | 33 | 31 | 28 | 25 | 24 | 20 | 18 |
| | | E | 37 | 32 | 28 | 24 | 24 | 22 | 19 | 20 | 16 | 15 |
| | 14Ga | A | 85 | — | — | — | — | — | — | — | — | — |
| | | B | 84 | 71 | 60 | 52 | — | — | — | — | — | — |
| | | C | 78 | 67 | 58 | 51 | 50 | 43 | 38 | 37 | 29 | 26 |
| | | D | 54 | 46 | 40 | 35 | 33 | 30 | 26 | 26 | 21 | 19 |
| | | E | 39 | 33 | 29 | 26 | 26 | 23 | 21 | 21 | 17 | 16 |
| 8" | 18Ga | A | — | — | — | — | — | — | — | — | — | — |
| | | B | — | — | — | — | — | — | — | — | — | — |
| | | C | 62 | 51 | | — | — | — | — | — | — | — |
| | | D | 59 | 50 | 43 | 36 | 36 | 31 | 28 | 27 | 21 | — |
| | | E | 44 | 38 | 33 | 29 | 30 | 26 | 26 | 24 | 20 | 19 |
| | 16Ga | A | — | — | — | — | — | — | — | — | | — |
| | | B | — | — | — | — | — | — | — | — | | — |
| | | C | 80 | 65 | 55 | 47 | 46 | 40 | 36 | 35 | 28 | 25 |
| | | D | 61 | 52 | 45 | 40 | 37 | 33 | 30 | 29 | 24 | 22 |
| | | E | 46 | 40 | 34 | 30 | 31 | 27 | 27 | 25 | 21 | 19 |
| | 14Ga | A | — | — | — | — | — | — | — | — | | — |
| | | B | 98 | — | — | — | — | — | — | — | | — |
| | | C | 97 | 81 | 69 | 58 | 57 | 50 | 44 | 43 | 34 | 31 |
| | | D | 64 | 55 | 48 | 42 | 39 | 35 | 31 | 30 | 25 | 23 |
| | | E | 49 | 42 | 36 | 32 | 32 | 29 | 29 | 26 | 22 | 20 |

TABLE III(b)

LIMITING LOAD FOR SCREW FASTENER CONFIGURATIONS
16" Spacing "Working Stress"

Specified Load (psf)

| Beam Description | | Connection Type | Beam Length (ft) 8 | 8½ | 9 | 9½ | 10 | 10½ | 11 | 11½ | 12 |
|---|---|---|---|---|---|---|---|---|---|---|---|
| 6" | 18Ga | A | — | — | — | — | — | — | — | — | — |
| | | B | 128 | — | — | — | — | — | — | — | — |
| | | C | 122 | 108 | 93 | 79 | 68 | 62 | 53 | 47 | 44 |
| | | D | 101 | 87 | 78 | 69 | 62 | 56 | 51 | 46 | 43 |
| | | E | 61 | 54 | 48 | 43 | 39 | 35 | 32 | 29 | 27 |
| | 16Ga | A | 165 | 140 | 120 | — | — | — | — | — | — |
| | | B | 144 | 127 | 114 | 101 | 87 | 79 | 70 | 62 | — |
| | | C | 127 | 112 | 100 | 90 | 81 | 73 | 66 | 61 | 56 |
| | | D | 105 | 91 | 81 | 72 | 64 | 58 | 53 | 48 | 44 |
| | | E | 63 | 56 | 50 | 45 | 40 | 36 | 33 | 30 | 28 |
| | 14Ga | A | 205 | 173 | 149 | 125 | 112 | 98 | 86 | 76 | 69 |
| | | B | 144 | 127 | 114 | 102 | 92 | 83 | 76 | 69 | 64 |
| | | C | 134 | 118 | 106 | 95 | 85 | 78 | 70 | 64 | 59 |
| | | D | 111 | 96 | 85 | 76 | 68 | 61 | 55 | 51 | 47 |
| | | E | 67 | 59 | 53 | 47 | 43 | 38 | 35 | 32 | 29 |
| 8" | 18Ga | A | — | — | — | — | — | — | — | — | — |
| | | B | — | — | — | — | — | — | — | — | — |
| | | C | 146 | 122 | 105 | 88 | 79 | 68 | 61 | — | — |
| | | D | 118 | 103 | 92 | 82 | 73 | 67 | 60 | 53 | 48 |
| | | E | 76 | 67 | 60 | 53 | 48 | 44 | 40 | 36 | 33 |

TABLE III(b)-continued

LIMITING LOAD FOR SCREW FASTENER CONFIGURATIONS
16" Spacing "Working Stress"

| | | | | | | | | | | | |
|---|---|---|---|---|---|---|---|---|---|---|---|
| | 16Ga | A | 188 | 158 | — | — | — | — | — | — | |
| | | B | 176 | 155 | 135 | 113 | 101 | — | — | — | |
| | | C | 157 | 138 | 124 | 111 | 100 | 88 | 78 | 68 | 62 |
| | | D | 122 | 107 | 95 | 85 | 76 | 69 | 62 | 57 | 53 |
| | | E | 78 | 69 | 62 | 55 | 50 | 45 | 41 | 38 | 35 |
| | 14Ga | A | 233 | 195 | 168 | 140 | 125 | 109 | 96 | — | — |
| | | B | 176 | 155 | 138 | 124 | 112 | 101 | 92 | 84 | 76 |
| | | C | 165 | 146 | 130 | 117 | 106 | 96 | 87 | 80 | 73 |
| | | D | 129 | 113 | 101 | 89 | 90 | 73 | 66 | 60 | 55 |
| | | E | 83 | 73 | 65 | 58 | 53 | 48 | 44 | 40 | 36 |

Specified Load (psf)

| Beam Description | | Connection Type | Beam Length (ft) 13 | 14 | 15 | 16 | 17 | 18 | 19 | 20 | 22 | 24 |
|---|---|---|---|---|---|---|---|---|---|---|---|---|
| 6" | 18Ga | A | — | — | — | — | — | — | — | — | — | — |
| | | B | — | — | — | — | — | — | — | — | — | — |
| | | C | 40 | 33 | 29 | — | — | — | — | — | — | — |
| | | D | 37 | 32 | 28 | 24 | 23 | 20 | 18 | 17 | 14 | 12 |
| | | E | 27 | 23 | 20 | 18 | 18 | 16 | 14 | 14 | 12 | 11 |
| | 16Ga | A | — | — | — | — | — | — | — | — | — | — |
| | | B | — | — | — | — | — | — | — | — | — | — |
| | | C | 52 | 43 | 36 | 32 | 30 | 26 | 23 | 23 | 18 | 16 |
| | | D | 38 | 33 | 29 | 25 | 24 | 19 | 19 | 18 | 15 | 14 |
| | | E | 28 | 24 | 21 | 18 | 18 | 15 | 15 | 15 | 12 | 11 |
| | 14Ga | A | 64 | — | — | — | — | — | — | — | — | — |
| | | B | 63 | 53 | 45 | 39 | — | — | — | — | — | — |
| | | C | 58 | 50 | 44 | 38 | 38 | 32 | 29 | 28 | 22 | 20 |
| | | D | 40 | 35 | 30 | 27 | 25 | 22 | 20 | 19 | 16 | 14 |
| | | E | 29 | 25 | 22 | 19 | 19 | 17 | 15 | 16 | 13 | 12 |
| 8" | 18Ga | A | — | — | — | — | — | — | — | — | — | — |
| | | B | — | — | — | — | — | — | — | — | — | — |
| | | C | 47 | 38 | | — | — | — | — | — | — | — |
| | | D | 44 | 38 | 32 | 28 | 27 | 23 | 21 | 20 | 16 | — |
| | | E | 33 | 29 | 25 | 22 | 22 | 20 | 20 | 18 | 15 | 14 |
| | 16Ga | A | — | — | — | — | — | — | — | | — | |
| | | B | — | — | — | — | — | — | — | — | | — |
| | | C | 60 | 49 | 41 | 35 | 35 | 30 | 27 | 26 | 21 | 19 |
| | | D | 46 | 39 | 34 | 30 | 28 | 25 | 22 | 22 | 18 | 16 |
| | | E | 35 | 30 | 26 | 23 | 23 | 21 | 20 | 19 | 15 | 14 |
| | 14Ga | A | — | — | — | — | — | — | — | — | | — |
| | | B | 74 | — | — | — | — | — | — | — | | — |
| | | C | 73 | 61 | 52 | 44 | 43 | 38 | 33 | 32 | 26 | 23 |
| | | D | 48 | 41 | 36 | 31 | 29 | 26 | 23 | 23 | 19 | 17 |
| | | E | 36 | 31 | 27 | 24 | 24 | 22 | 20 | 20 | 16 | 15 |

TABLE III(c)

LIMITING LOAD FOR SCREW FASTENER CONFIGURATIONS
24" Spacing "Working Stress"

Specified Load (psf)

| Beam Description | | Connection Type | Beam Length (ft) 8 | 8½ | 9 | 9½ | 10 | 10½ | 11 | 11½ | 12 |
|---|---|---|---|---|---|---|---|---|---|---|---|
| 6" | 18Ga | A | — | — | — | — | — | — | — | — | — |
| | | B | 86 | — | — | — | — | — | — | — | — |
| | | C | 81 | 72 | 62 | 53 | 45 | 41 | 35 | 32 | 29 |
| | | D | 68 | 58 | 52 | 46 | 41 | 37 | 34 | 31 | 28 |
| | | E | 41 | 36 | 32 | 29 | 26 | 23 | 21 | 20 | 18 |
| | 16Ga | A | 110 | 93 | 80 | — | — | — | — | — | — |
| | | B | 96 | 85 | 76 | 68 | 58 | 53 | 47 | 41 | — |
| | | C | 84 | 74 | 67 | 60 | 54 | 49 | 44 | 40 | 37 |
| | | D | 70 | 60 | 54 | 48 | 43 | 38 | 35 | 32 | 29 |
| | | E | 42 | 37 | 33 | 30 | 27 | 24 | 22 | 20 | 19 |
| | 14Ga | A | 137 | 115 | 99 | 54 | 75 | 65 | 58 | 51 | 46 |
| | | B | 96 | 85 | 76 | 68 | 61 | 55 | 51 | 46 | 42 |
| | | C | 89 | 79 | 70 | 63 | 57 | 51 | 47 | 43 | 39 |
| | | D | 74 | 64 | 57 | 51 | 45 | 41 | 37 | 34 | 31 |

TABLE III(c)-continued

LIMITING LOAD FOR SCREW FASTENER CONFIGURATIONS
24" Spacing "Working Stress"

| | | | | | | | | | | | |
|---|---|---|---|---|---|---|---|---|---|---|---|
| | | E | 45 | 39 | 35 | 32 | 28 | 26 | 23 | 21 | 20 |
| 8" | 18Ga | A | — | — | — | — | — | — | — | — | — |
| | | B | — | — | — | — | — | — | — | — | — |
| | | C | 97 | 82 | 70 | 59 | 53 | 46 | 41 | — | — |
| | | D | 78 | 69 | 61 | 54 | 49 | 44 | 40 | 35 | 32 |
| | | E | 50 | 44 | 40 | 36 | 32 | 29 | 27 | 24 | 22 |
| | 16Ga | A | 126 | 105 | — | — | — | — | — | | |
| | | B | 117 | 103 | 90 | 76 | 68 | — | — | — | |
| | | C | 104 | 92 | 82 | 74 | 67 | 59 | 52 | 46 | 41 |
| | | D | 81 | 71 | 64 | 56 | 51 | 46 | 42 | 38 | 35 |
| | | E | 52 | 46 | 41 | 37 | 33 | 30 | 28 | 25 | 23 |
| | 14Ga | A | 155 | 130 | 112 | 94 | 84 | 73 | 64 | — | — |
| | | B | 117 | 103 | 92 | 83 | 75 | 68 | 62 | 56 | 51 |
| | | C | 110 | 97 | 87 | 78 | 70 | 64 | 58 | 53 | 49 |
| | | D | 86 | 75 | 67 | 60 | 54 | 49 | 44 | 40 | 37 |
| | | E | 55 | 49 | 43 | 39 | 35 | 32 | 29 | 27 | 24 |

Specified Load (psf)

| Beam Description | | Connection Type | Beam Length (ft) 13 | 14 | 15 | 16 | 17 | 18 | 19 | 20 | 22 | 24 |
|---|---|---|---|---|---|---|---|---|---|---|---|---|
| 6" | 18Ga | A | — | — | — | — | — | — | — | — | — | — |
| | | B | — | — | — | — | — | — | — | — | — | — |
| | | C | 27 | 22 | 19 | 16 | 16 | — | — | — | — | — |
| | | D | 25 | 21 | 18 | 16 | 15 | 14 | 12 | 12 | 9 | 8 |
| | | E | 18 | 15 | 13 | 12 | 12 | 10 | 9 | 9 | 8 | 7 |
| | 16Ga | A | — | — | — | — | — | — | — | — | — | — |
| | | B | — | — | — | — | — | — | — | — | — | — |
| | | C | 35 | 29 | 25 | 21 | 20 | 18 | 16 | 15 | 12 | 11 |
| | | D | 26 | 22 | 19 | 17 | 16 | 14 | 13 | 12 | 10 | 9 |
| | | E | 18 | 16 | 14 | 12 | 12 | 11 | 10 | 10 | 8 | 7 |
| | 14Ga | A | 43 | — | — | — | — | — | — | — | — | — |
| | | B | 42 | 36 | 30 | — | — | — | — | — | — | — |
| | | C | 39 | 33 | 29 | 26 | 25 | 22 | 19 | 19 | 15 | 13 |
| | | D | 27 | 23 | 20 | 18 | 17 | 15 | 13 | 13 | 11 | 10 |
| | | E | 19 | 17 | 15 | 13 | 13 | 11 | 10 | 10 | 9 | 8 |
| 8" | 18Ga | A | — | — | — | — | — | — | — | — | — | — |
| | | B | — | — | — | — | — | — | — | — | — | — |
| | | C | 31 | 26 | | — | — | — | — | — | — | — |
| | | D | 29 | 25 | 22 | 19 | 18 | 16 | 14 | 14 | 11 | — |
| | | E | 22 | 19 | 17 | 15 | 15 | 13 | 13 | 12 | 10 | 10 |
| | 16Ga | A | — | — | — | — | — | — | — | — | | — |
| | | B | — | — | — | — | — | — | — | — | | — |
| | | C | 40 | 33 | 28 | 24 | 23 | 20 | 18 | 18 | 14 | 13 |
| | | D | 30 | 26 | 23 | 20 | 19 | 17 | 15 | 14 | 12 | 11 |
| | | E | 23 | 20 | 17 | 15 | 15 | 14 | 14 | 12 | 10 | 10 |
| | 14Ga | A | — | — | — | — | — | — | — | — | | — |
| | | B | — | — | — | — | — | — | — | — | | — |
| | | C | 49 | 41 | 35 | 29 | 29 | 25 | 22 | 22 | 17 | 16 |
| | | D | 32 | 28 | 24 | 21 | 20 | 18 | 16 | 15 | 13 | 11 |
| | | E | 24 | 21 | 18 | 16 | 16 | 14 | 14 | 13 | 11 | 10 |

TABLE IV

SCREW AND WEB CONFIGURATIONS

| Beam Configuration Code | First Position | Second Position | Third Position | Fourth Position | Fifth Position | Sixth Position | Seventh Position | Eighth Position | Ninth Position |
|---|---|---|---|---|---|---|---|---|---|
| FOR BEAMS 8'-0" TO 12'-0" (5 WEBS) Screw and Web Configuration Codes | | | | | | | | | |
| A | 4 | 2 | 1 | 2 | 4 | | | | |
| B | 3 | 2 | 1 | 2 | 3 | | | | |
| C | 2 | 2 | 1 | 2 | 2 | | | | |
| D | 2 | 1 | 1 | 1 | 2 | | | | |
| E | 1 | 1 | 1 | 1 | 1 | | | | |

TABLE IV-continued

| Beam Configuration Code | First Position | Second Position | Third Position | Fourth Position | Fifth Position | Sixth Position | Seventh Position | Eighth Position | Ninth Position |
|---|---|---|---|---|---|---|---|---|---|
| | | SCREW AND WEB CONFIGURATIONS | | | | | | | |
| | | FOR BEAMS 13'-0" TO 16'-0" (6 WEBS) Screw and Web Configuration Codes | | | | | | | |
| A | 4 | 2 | 1 | 1 | 2 | 4 | | | |
| B | 3 | 2 | 1 | 1 | 2 | 3 | | | |
| C | 2 | 2 | 1 | 1 | 2 | 2 | | | |
| D | 2 | 1 | 1 | 1 | 1 | 2 | | | |
| E | 1 | 1 | 1 | 1 | 1 | 1 | | | |
| | | FOR BEAMS 17'-0" TO 19'-0" (7 WEBS) Screw and Web Configuration Codes | | | | | | | |
| A | 4 | 2 | 1 | 1 | 1 | 2 | 4 | | |
| B | 3 | 2 | 1 | 1 | 1 | 2 | 3 | | |
| C | 2 | 2 | 1 | 1 | 1 | 2 | 2 | | |
| D | 2 | 1 | 1 | 1 | 1 | 1 | 2 | | |
| E | 1 | 1 | 1 | 1 | 1 | 1 | 1 | | |
| | | FOR BEAMS 20'-0" AND 22'-0" (8 WEBS) Screw and Web Configuration Codes | | | | | | | |
| A | 4 | 2 | 1 | 1 | 1 | 1 | 2 | 4 | |
| B | 3 | 2 | 1 | 1 | 1 | 1 | 2 | 3 | |
| C | 2 | 2 | 1 | 1 | 1 | 1 | 2 | 2 | |
| D | 2 | 1 | 1 | 1 | 1 | 1 | 1 | 2 | |
| E | 1 | 1 | 1 | 1 | 1 | 1 | 1 | 1 | |
| | | FOR BEAM 24'-0" Screw and Web Configuration Codes | | | | | | | |
| A | 4 | 2 | 1 | 1 | 1 | 1 | 1 | 2 | 4 |
| B | 3 | 2 | 1 | 1 | 1 | 1 | 1 | 2 | 3 |
| C | 2 | 2 | 1 | 1 | 1 | 1 | 1 | 2 | 2 |
| D | 2 | 1 | 1 | 1 | 1 | 1 | 1 | 1 | 2 |
| E | 1 | 1 | 1 | 1 | 1 | 1 | 1 | 1 | 1 |

TABLE V(a)

6" BEAM WIND LOAD TABLE
MAXIMUM UNIFORMLY DISTRIBUTED SINGLE BEAM LOAD (psf)
"Limit States"
Strength Loads are Factored Deflection Loads are Specified

| Beam Length Ft. | Strength or Deflection | Beam Spacing (in) 6" × 18GA 12 | 16 | 24 | 6" × 16GA 12 | 16 | 24 | 6" × 14GA 12 | 16 | 24 |
|---|---|---|---|---|---|---|---|---|---|---|
| 8 | STRENGTH | 239 | 179 | 119 | 309 | 232 | 155 | 392 | 294 | 196 |
| | L/360 | 470 | 352 | 235 | 563 | 422 | 282 | 645 | 484 | 323 |
| 8½ | STRENGTH | 201 | 151 | 101 | 260 | 195 | 130 | 321 | 241 | 161 |
| | L/360 | 373 | 282 | 188 | 452 | 339 | 226 | 524 | 393 | 262 |
| 9 | STRENGTH | 173 | 129 | 86 | 224 | 168 | 112 | 278 | 208 | 139 |
| | L/360 | 302 | 226 | 151 | 365 | 273 | 183 | 424 | 318 | 212 |
| 9½ | STRENGTH | 147 | 110 | 74 | 191 | 143 | 95 | 236 | 177 | 118 |
| | L/360 | 246 | 185 | 123 | 300 | 225 | 150 | 351 | 263 | 176 |
| 10 | STRENGTH | 129 | 97 | 65 | 167 | 125 | 83 | 206 | 154 | 103 |
| | L/360 | 203 | 152 | 102 | 248 | 186 | 124 | 292 | 219 | 146 |
| 10½ | STRENGTH | 114 | 86 | 57 | 147 | 110 | 74 | 182 | 136 | 91 |
| | L/360 | 169 | 127 | 85 | 208 | 156 | 104 | 246 | 185 | 123 |
| 11 | STRENGTH | 99 | 74 | 50 | 129 | 97 | 65 | 159 | 119 | 80 |
| | L/360 | 142 | 107 | 71 | 176 | 132 | 88 | 208 | 156 | 104 |
| 11½ | STRENGTH | 89 | 66 | 44 | 114 | 86 | 57 | 144 | 108 | 72 |
| | L/360 | 121 | 91 | 61 | 150 | 113 | 75 | 178 | 134 | 89 |
| 12 | STRENGTH | 80 | 60 | 40 | 102 | 77 | 51 | 128 | 96 | 64 |
| | L/360 | 103 | 78 | 52 | 128 | 96 | 64 | 153 | 115 | 77 |
| 13 | STRENGTH | 75 | 56 | 38 | 98 | 73 | 49 | 122 | 91 | 61 |
| | L/360 | 118 | 89 | 59 | 146 | 109 | 73 | 173 | 129 | 87 |
| 14 | STRENGTH | 63 | 47 | 32 | 81 | 61 | 41 | 101 | 75 | 50 |
| | L/360 | 90 | 68 | 45 | 112 | 84 | 56 | 134 | 100 | 67 |
| 15 | STRENGTH | 53 | 39 | 26 | 69 | 52 | 35 | 84 | 63 | 42 |
| | L/360 | 71 | 53 | 36 | 88 | 66 | 44 | 106 | 80 | 53 |

TABLE V(a)-continued

6" BEAM WIND LOAD TABLE
MAXIMUM UNIFORMLY DISTRIBUTED SINGLE BEAM LOAD (psf)
"Limit States"
Strength Loads are Factored Deflection Loads are Specified

| Beam Length Ft. | Strength or Deflection | Beam Spacing (in) 6" × 18GA 12 | 16 | 24 | 6" × 16GA 12 | 16 | 24 | 6" × 14GA 12 | 16 | 24 |
|---|---|---|---|---|---|---|---|---|---|---|
| 16 | STRENGTH | 45 | 34 | 23 | 59 | 44 | 29 | 72 | 54 | 36 |
| | L/360 | 56 | 42 | 28 | 71 | 53 | 36 | 85 | 64 | 43 |
| 17 | STRENGTH | 44 | 33 | 22 | 57 | 43 | 29 | 71 | 53 | 35 |
| | L/360 | 59 | 44 | 30 | 74 | 55 | 37 | 89 | 66 | 45 |
| 18 | STRENGTH | 38 | 28 | 19 | 50 | 37 | 25 | 62 | 46 | 31 |
| | L/360 | 48 | 36 | 24 | 60 | 45 | 30 | 73 | 55 | 37 |
| 19 | STRENGTH | 33 | 25 | 17 | 44 | 33 | 22 | 54 | 41 | 27 |
| | L/360 | 40 | 30 | 20 | 50 | 37 | 25 | 61 | 46 | 31 |
| 20 | STRENGTH | 33 | 25 | 17 | 42 | 32 | 21 | 53 | 39 | 26 |
| | L/360 | 42 | 32 | 21 | 53 | 39 | 27 | 64 | 48 | 32 |
| 22 | STRENGTH | 26 | 19 | 13 | 33 | 25 | 17 | 42 | 32 | 21 |
| | L/360 | 30 | 23 | 15 | 38 | 28 | 19 | 47 | 35 | 24 |
| 24 | STRENGTH | 23 | 17 | 11 | 30 | 23 | 15 | 36 | 27 | 18 |
| | L/360 | 26 | 19 | 13 | 33 | 25 | 17 | 40 | 30 | 20 |

TABLE V(b)

8" BEAM WIND LOAD TABLE
MAXIMUM UNIFORMLY DISTRIBUTED SINGLE BEAM LOAD (psf)
"Limit States"
Strength Loads are Factored Deflection Loads are Specified

| Beam Length Ft. | Strength or Deflection | Beam Spacing (in) 8" × 18GA 12 | 16 | 24 | 8" × 16GA 12 | 16 | 24 | 8" × 14GA 12 | 16 | 24 |
|---|---|---|---|---|---|---|---|---|---|---|
| 8 | STRENGTH | 266 | 199 | 133 | 363 | 272 | 182 | 447 | 335 | 224 |
| | L/360 | 615 | 461 | 308 | 727 | 546 | 364 | 833 | 624 | 417 |
| 8½ | STRENGTH | 224 | 168 | 112 | 288 | 216 | 144 | 356 | 267 | 178 |
| | L/360 | 477 | 358 | 239 | 566 | 424 | 283 | 653 | 489 | 327 |
| 9 | STRENGTH | 192 | 144 | 96 | 248 | 186 | 124 | 306 | 230 | 153 |
| | L/360 | 375 | 281 | 188 | 454 | 341 | 227 | 529 | 397 | 265 |
| 9½ | STRENGTH | 162 | 122 | 81 | 210 | 158 | 105 | 260 | 195 | 130 |
| | L/360 | 300 | 225 | 150 | 365 | 273 | 183 | 427 | 321 | 214 |
| 10 | STRENGTH | 141 | 106 | 71 | 182 | 136 | 91 | 225 | 169 | 113 |
| | L/360 | 245 | 183 | 123 | 299 | 224 | 150 | 352 | 264 | 176 |
| 10½ | STRENGTH | 125 | 93 | 62 | 161 | 120 | 80 | 198 | 149 | 99 |
| | L/360 | 201 | 151 | 101 | 247 | 186 | 124 | 291 | 218 | 146 |
| 11 | STRENGTH | 108 | 81 | 54 | 140 | 105 | 70 | 177 | 133 | 89 |
| | L/360 | 167 | 125 | 84 | 206 | 154 | 103 | 245 | 183 | 123 |
| 11½ | STRENGTH | 98 | 73 | 49 | 126 | 95 | 63 | 156 | 117 | 78 |
| | L/360 | 141 | 106 | 71 | 174 | 131 | 87 | 207 | 155 | 104 |
| 12 | STRENGTH | 87 | 65 | 44 | 114 | 86 | 57 | 141 | 106 | 71 |
| | L/360 | 120 | 90 | 60 | 148 | 111 | 74 | 177 | 133 | 89 |
| 13 | STRENGTH | 86 | 64 | 43 | 110 | 82 | 55 | 137 | 102 | 68 |
| | L/360 | 148 | 111 | 74 | 182 | 136 | 91 | 215 | 161 | 108 |
| 14 | STRENGTH | 71 | 53 | 35 | 92 | 69 | 46 | 113 | 84 | 56 |
| | L/360 | 112 | 84 | 56 | 138 | 104 | 69 | 165 | 124 | 83 |
| 15 | STRENGTH | 59 | 44 | 29 | 77 | 57 | 38 | 95 | 71 | 47 |
| | L/360 | 86 | 64 | 43 | 107 | 80 | 54 | 128 | 96 | 64 |
| 16 | STRENGTH | 50 | 37 | 25 | 65 | 48 | 32 | 81 | 61 | 41 |
| | L/360 | 69 | 52 | 35 | 85 | 64 | 43 | 102 | 77 | 51 |
| 17 | STRENGTH | 50 | 37 | 25 | 65 | 48 | 32 | 80 | 60 | 40 |
| | L/360 | 76 | 57 | 38 | 95 | 71 | 48 | 113 | 84 | 57 |
| 18 | STRENGTH | 44 | 33 | 22 | 56 | 42 | 28 | 69 | 52 | 35 |
| | L/360 | 61 | 46 | 31 | 77 | 57 | 39 | 92 | 69 | 46 |
| 19 | STRENGTH | 38 | 28 | 19 | 50 | 37 | 25 | 60 | 45 | 30 |
| | L/360 | 50 | 37 | 25 | 63 | 47 | 32 | 76 | 57 | 38 |
| 20 | STRENGTH | 38 | 28 | 19 | 50 | 37 | 25 | 60 | 45 | 30 |
| | L/360 | 57 | 43 | 29 | 71 | 53 | 36 | 85 | 64 | 43 |
| 22 | STRENGTH | 30 | 23 | 15 | 39 | 29 | 20 | 48 | 36 | 24 |
| | L/360 | 40 | 30 | 20 | 51 | 38 | 26 | 61 | 46 | 31 |
| 24 | STRENGTH | 27 | 20 | 14 | 35 | 26 | 17 | 42 | 32 | 21 |

TABLE V(b)-continued

8" BEAM WIND LOAD TABLE
MAXIMUM UNIFORMLY DISTRIBUTED SINGLE BEAM LOAD (psf)
"Limit States"
Strength Loads are Factored Deflection Loads are Specified

| Beam Length Ft. | Strength or Deflection | Beam Spacing (in) 8" × 18GA 12 | 16 | 24 | 8" × 16GA 12 | 16 | 24 | 8" × 14GA 12 | 16 | 24 |
|---|---|---|---|---|---|---|---|---|---|---|
| | L/360 | 36 | 27 | 18 | 46 | 35 | 23 | 56 | 42 | 28 |

TABLE VI(a)

BEAM COMBINED WIND AND AXIAL LOAD TABLE MAXIMUM FACTORED AXIAL LOAD (kips)
12" c/c "Limit States"

| DEPTH in. | GAUGE | WIND SPEC* psf. | WIND FACT+ psf. | LENGTH 8'-0" | 8'-6" | 9'-0" | 9'-6" | 10'-0" | 10'-6" | 11'-0" | 11'-6" | 12'-0" |
|---|---|---|---|---|---|---|---|---|---|---|---|---|
| 6 | 18 | 10 | 15 | 12.88 | 12.73 | 12.57 | 12.37 | 12.17 | 11.97 | 11.73 | 11.48 | 11.23 |
| | | 20 | 30 | 12.08 | 11.77 | 11.46 | 11.07 | 10.67 | 10.26 | 9.77 | 9.28 | 8.79 |
| | | 30 | 45 | 11.28 | 10.82 | 10.35 | 9.76 | 9.16 | 8.55 | 7.82 | 7.08 | 6.34 |
| | | 40 | 60 | 10.48 | 9.87 | 9.24 | 8.45 | 7.66 | 6.85 | 5.87 | 4.88 | 3.90 |
| | | 50 | 75 | 9.68 | 8.91 | 8.13 | 7.15 | 6.15 | 5.14 | 3.92 | 2.69 | 1.45 |
| | 16 | 10 | 15 | 17.01 | 16.86 | 16.70 | 16.50 | 16.30 | 16.10 | 15.85 | 15.60 | 15.35 |
| | | 20 | 30 | 16.21 | 15.90 | 15.58 | 15.18 | 14.78 | 14.37 | 13.88 | 13.38 | 12.88 |
| | | 30 | 45 | 15.40 | 14.93 | 14.46 | 13.86 | 13.26 | 12.65 | 11.90 | 11.16 | 10.41 |
| | | 40 | 60 | 14.59 | 13.97 | 13.34 | 12.55 | 11.74 | 10.92 | 9.93 | 8.94 | 7.94 |
| | | 50 | 75 | 13.79 | 13.01 | 12.22 | 11.23 | 10.22 | 9.20 | 7.96 | 6.72 | 5.47 |
| | 14 | 10 | 15 | 21.48 | 21.33 | 21.17 | 20.97 | 20.76 | 20.55 | 20.30 | 20.05 | 19.80 |
| | | 20 | 30 | 20.67 | 20.35 | 20.03 | 19.63 | 19.22 | 18.81 | 18.31 | 17.81 | 17.30 |
| | | 30 | 45 | 19.85 | 19.38 | 18.90 | 18.30 | 17.68 | 17.06 | 16.31 | 15.56 | 14.80 |
| | | 40 | 60 | 19.03 | 18.41 | 17.77 | 16.96 | 16.15 | 15.31 | 14.31 | 13.31 | 12.30 |
| | | 50 | 75 | 18.22 | 17.43 | 16.64 | 15.63 | 14.61 | 13.57 | 12.32 | 11.07 | 9.79 |
| 8 | 18 | 10 | 15 | 12.94 | 12.80 | 12.65 | 12.47 | 12.28 | 12.09 | 11.85 | 11.66 | 11.38 |
| | | 20 | 30 | 12.21 | 11.92 | 11.63 | 11.25 | 10.87 | 10.49 | 10.03 | 9.64 | 9.09 |
| | | 30 | 45 | 11.47 | 11.04 | 10.60 | 10.04 | 9.47 | 8.90 | 8.20 | 7.62 | 6.79 |
| | | 40 | 60 | 10.74 | 10.16 | 9.58 | 8.82 | 8.07 | 7.30 | 6.37 | 5.60 | 4.50 |
| | | 50 | 75 | 10.00 | 9.28 | 8.55 | 7.61 | 6.66 | 5.71 | 4.55 | 3.58 | 2.20 |
| | 16 | 10 | 15 | 17.08 | 16.93 | 16.78 | 16.59 | 16.40 | 16.21 | 15.97 | 15.78 | 15.50 |
| | | 20 | 30 | 16.33 | 16.04 | 15.75 | 15.37 | 14.98 | 14.60 | 14.13 | 13.74 | 13.18 |
| | | 30 | 45 | 15.59 | 15.16 | 14.71 | 14.14 | 13.57 | 12.99 | 12.28 | 11.70 | 10.86 |
| | | 40 | 60 | 14.85 | 14.27 | 13.68 | 12.91 | 12.15 | 11.38 | 10.44 | 9.66 | 8.54 |
| | | 50 | 75 | 14.11 | 13.38 | 12.64 | 11.69 | 10.73 | 9.77 | 8.59 | 7.62 | 6.22 |
| | 14 | 10 | 15 | 21.59 | 21.40 | 21.25 | 21.06 | 20.86 | 20.67 | 20.47 | 20.23 | 19.99 |
| | | 20 | 30 | 20.88 | 20.50 | 20.20 | 19.82 | 19.43 | 19.04 | 18.64 | 18.16 | 17.68 |
| | | 30 | 45 | 20.18 | 19.60 | 19.15 | 18.58 | 17.99 | 17.41 | 16.82 | 16.09 | 15.37 |
| | | 40 | 60 | 19.47 | 18.70 | 18.10 | 17.34 | 16.55 | 15.78 | 14.99 | 14.03 | 13.07 |
| | | 50 | 75 | 18.76 | 17.80 | 17.06 | 16.10 | 15.12 | 14.15 | 13.16 | 11.96 | 10.76 |

*SPEC = specified wind load
+FACT = factored wind load

TABLE VI(b)

BEAM COMBINED WIND AND AXIAL LOAD TABLE MAXIMUM FACTORED AXIAL LOAD (kips)
16" c/c "Limit States"

| DEPTH in. | GAUGE | WIND SPEC* psf. | WIND FACT+ psf. | LENGTH 8'-0" | 8'-6" | 9'-0" | 9'-6" | 10'-0" | 10'-6" | 11'-0" | 11'-6" | 12'-0" |
|---|---|---|---|---|---|---|---|---|---|---|---|---|
| 6 | 18 | 10 | 15 | 9.66 | 9.54 | 9.43 | 9.28 | 9.13 | 8.98 | 8.80 | 8.61 | 8.43 |
| | | 20 | 30 | 9.06 | 8.83 | 8.60 | 8.30 | 8.00 | 7.70 | 7.33 | 6.96 | 6.59 |
| | | 30 | 45 | 8.46 | 8.11 | 7.76 | 7.32 | 6.87 | 6.42 | 5.87 | 5.31 | 4.76 |
| | | 40 | 60 | 7.86 | 7.40 | 6.93 | 6.34 | 5.74 | 5.13 | 4.40 | 3.66 | 2.92 |
| | | 50 | 75 | 7.26 | 6.68 | 6.10 | 5.36 | 4.62 | 3.85 | 2.94 | 2.01 | 1.09 |
| | 16 | 10 | 15 | 12.76 | 12.65 | 12.53 | 12.38 | 12.23 | 12.07 | 11.89 | 11.70 | 11.51 |

TABLE VI(b)-continued

BEAM COMBINED WIND AND AXIAL LOAD TABLE MAXIMUM FACTORED AXIAL LOAD (kips)
16" c/c "Limit States"

| DEPTH | | WIND SPEC* | WIND FACT+ | LENGTH | | | | | | | | |
|---|---|---|---|---|---|---|---|---|---|---|---|---|
| in. | GAUGE | psf. | psf. | 8'-0" | 8'-6" | 9'-0" | 9'-6" | 10'-0" | 10'-6" | 11'-0" | 11'-6" | 12'-0" |
| | | 20 | 30 | 12.15 | 11.92 | 11.69 | 11.39 | 11.09 | 10.78 | 10.41 | 10.03 | 9.66 |
| | | 30 | 45 | 11.55 | 11.20 | 10.85 | 10.40 | 9.95 | 9.48 | 8.93 | 8.37 | 7.81 |
| | | 40 | 60 | 10.94 | 10.48 | 10.01 | 9.41 | 8.81 | 8.19 | 7.45 | 6.70 | 5.96 |
| | | 50 | 75 | 10.34 | 9.76 | 9.17 | 8.42 | 7.67 | 6.90 | 5.97 | 5.04 | 4.10 |
| | 14 | 10 | 15 | 16.11 | 15.99 | 15.88 | 15.72 | 15.57 | 15.42 | 15.23 | 15.04 | 14.85 |
| | | 20 | 30 | 15.51 | 15.26 | 15.03 | 14.72 | 14.42 | 14.11 | 13.73 | 13.35 | 12.97 |
| | | 30 | 45 | 14.89 | 14.53 | 14.18 | 13.72 | 13.26 | 12.80 | 12.23 | 11.67 | 11.10 |
| | | 40 | 60 | 14.28 | 13.80 | 13.33 | 12.72 | 12.11 | 11.49 | 10.74 | 9.98 | 9.22 |
| | | 50 | 75 | 13.66 | 13.07 | 12.48 | 11.72 | 10.96 | 10.18 | 9.24 | 8.30 | 7.35 |
| 8 | 18 | 10 | 15 | 9.71 | 9.60 | 9.49 | 9.35 | 9.21 | 9.06 | 8.89 | 8.75 | 8.54 |
| | | 20 | 30 | 9.16 | 8.94 | 8.72 | 8.44 | 8.16 | 7.87 | 7.52 | 7.23 | 6.82 |
| | | 30 | 45 | 8.60 | 8.28 | 7.95 | 7.53 | 7.10 | 6.67 | 6.15 | 5.72 | 5.10 |
| | | 40 | 60 | 8.05 | 7.62 | 7.18 | 6.62 | 6.05 | 5.48 | 4.78 | 4.20 | 3.37 |
| | | 50 | 75 | 7.50 | 6.96 | 6.42 | 5.71 | 5.00 | 4.28 | 3.41 | 2.69 | 1.65 |
| | 16 | 10 | 15 | 12.81 | 12.70 | 12.59 | 12.45 | 12.30 | 12.16 | 11.98 | 11.83 | 11.63 |
| | | 20 | 30 | 12.25 | 12.03 | 11.81 | 11.53 | 11.24 | 10.95 | 10.60 | 10.30 | 9.89 |
| | | 30 | 45 | 11.69 | 11.37 | 11.04 | 10.61 | 10.18 | 9.74 | 9.21 | 8.77 | 8.15 |
| | | 40 | 60 | 11.14 | 10.70 | 10.26 | 9.69 | 9.11 | 8.53 | 7.83 | 7.24 | 6.41 |
| | | 50 | 75 | 10.58 | 10.03 | 9.48 | 8.77 | 8.05 | 7.32 | 6.44 | 5.71 | 4.67 |
| | 14 | 10 | 15 | 16.19 | 16.05 | 15.94 | 15.79 | 15.65 | 15.50 | 15.35 | 15.17 | 14.99 |
| | | 20 | 30 | 15.66 | 15.38 | 15.15 | 14.86 | 14.57 | 14.28 | 13.98 | 13.62 | 13.26 |
| | | 30 | 45 | 15.13 | 14.70 | 14.36 | 13.93 | 13.49 | 13.06 | 12.61 | 12.07 | 11.53 |
| | | 40 | 60 | 14.60 | 14.03 | 13.58 | 13.00 | 12.42 | 11.83 | 11.24 | 10.52 | 9.80 |
| | | 50 | 75 | 14.07 | 13.35 | 12.79 | 12.07 | 11.34 | 10.61 | 9.87 | 8.97 | 8.07 |

*SPEC = specified wind load
+FACT = factored wind load

TABLE VI(c)

BEAM COMBINED WIND AND AXIAL LOAD TABLE MAXIMUM FACTORED AXIAL LOAD (kips)
24" c/c "Limit States"

| DEPTH | | WIND SPEC* | WIND FACT+ | LENGTH | | | | | | | | |
|---|---|---|---|---|---|---|---|---|---|---|---|---|
| in. | GAUGE | psf. | psf. | 8'-0" | 8'-6" | 9'-0" | 9'-6" | 10'-0" | 10'-6" | 11'-0" | 11'-6" | 12'-0" |
| 6 | 18 | 10 | 15 | 6.44 | 6.36 | 6.29 | 6.19 | 6.09 | 5.99 | 5.86 | 5.74 | 5.62 |
| | | 20 | 30 | 6.04 | 5.89 | 5.73 | 5.53 | 5.33 | 5.13 | 4.89 | 4.64 | 4.39 |
| | | 30 | 45 | 5.64 | 5.41 | 5.18 | 4.88 | 4.58 | 4.28 | 3.91 | 3.54 | 3.17 |
| | | 40 | 60 | 5.24 | 4.93 | 4.62 | 4.23 | 3.83 | 3.42 | 2.93 | 2.44 | 1.95 |
| | | 50 | 75 | 4.84 | 4.46 | 4.07 | 3.57 | 3.08 | 2.57 | 1.96 | 1.34 | 0.73 |
| | 16 | 10 | 15 | 8.51 | 8.43 | 8.35 | 8.25 | 8.15 | 8.05 | 7.92 | 7.80 | 7.68 |
| | | 20 | 30 | 8.10 | 7.95 | 7.79 | 7.59 | 7.39 | 7.19 | 6.94 | 6.69 | 6.44 |
| | | 30 | 45 | 7.70 | 7.47 | 7.23 | 6.93 | 6.63 | 6.33 | 5.95 | 5.58 | 5.21 |
| | | 40 | 60 | 7.30 | 6.99 | 6.67 | 6.27 | 5.87 | 5.46 | 4.97 | 4.47 | 3.97 |
| | | 50 | 75 | 6.89 | 6.50 | 6.11 | 5.61 | 5.11 | 4.60 | 3.98 | 3.36 | 2.74 |
| | 14 | 10 | 15 | 10.74 | 10.66 | 10.58 | 10.48 | 10.38 | 10.28 | 10.15 | 10.03 | 9.90 |
| | | 20 | 30 | 10.33 | 10.18 | 10.02 | 9.82 | 9.61 | 9.40 | 9.15 | 8.90 | 8.65 |
| | | 30 | 45 | 9.93 | 9.69 | 9.45 | 9.15 | 8.84 | 8.53 | 8.16 | 7.78 | 7.40 |
| | | 40 | 60 | 9.52 | 9.20 | 8.88 | 8.48 | 8.07 | 7.66 | 7.16 | 6.66 | 6.15 |
| | | 50 | 75 | 9.11 | 8.72 | 8.32 | 7.81 | 7.30 | 6.78 | 6.16 | 5.53 | 4.90 |
| 8 | 18 | 10 | 15 | 6.47 | 6.40 | 6.33 | 6.23 | 6.14 | 6.04 | 5.93 | 5.83 | 5.69 |
| | | 20 | 30 | 6.10 | 5.96 | 5.81 | 5.63 | 5.44 | 5.25 | 5.01 | 4.82 | 4.54 |
| | | 30 | 45 | 5.74 | 5.52 | 5.30 | 5.02 | 4.74 | 4.45 | 4.10 | 3.81 | 3.40 |
| | | 40 | 60 | 5.37 | 5.08 | 4.79 | 4.41 | 4.03 | 3.65 | 3.19 | 2.80 | 2.25 |
| | | 50 | 75 | 5.00 | 4.64 | 4.28 | 3.80 | 3.33 | 2.85 | 2.27 | 1.79 | 1.10 |
| | 16 | 10 | 15 | 8.54 | 8.47 | 8.39 | 8.30 | 8.20 | 8.10 | 7.99 | 7.89 | 7.75 |
| | | 20 | 30 | 8.17 | 8.02 | 7.87 | 7.68 | 7.49 | 7.30 | 7.06 | 6.87 | 6.59 |
| | | 30 | 45 | 7.80 | 7.58 | 7.36 | 7.07 | 6.78 | 6.49 | 6.14 | 5.85 | 5.43 |
| | | 40 | 60 | 7.42 | 7.13 | 6.84 | 6.46 | 6.07 | 5.69 | 5.22 | 4.83 | 4.27 |
| | | 50 | 75 | 7.05 | 6.69 | 6.32 | 5.84 | 5.37 | 4.88 | 4.30 | 3.81 | 3.11 |
| | 14 | 10 | 15 | 10.80 | 10.70 | 10.63 | 10.53 | 10.43 | 10.33 | 10.24 | 10.12 | 10.00 |
| | | 20 | 30 | 10.44 | 10.25 | 10.10 | 9.91 | 9.71 | 9.52 | 9.32 | 9.08 | 8.84 |
| | | 30 | 45 | 10.09 | 9.80 | 9.58 | 9.29 | 9.00 | 8.70 | 8.41 | 8.05 | 7.69 |
| | | 40 | 60 | 9.73 | 9.35 | 9.05 | 8.67 | 9.28 | 7.89 | 7.49 | 7.01 | 6.53 |

TABLE VI(c)-continued

BEAM COMBINED WIND AND AXIAL LOAD TABLE MAXIMUM FACTORED AXIAL LOAD (kips)
24" c/c "Limit States"

| DEPTH | | WIND SPEC* | WIND FACT+ | LENGTH | | | | | | | | |
|---|---|---|---|---|---|---|---|---|---|---|---|---|
| in. | GAUGE | psf. | psf. | 8'-0" | 8'-6" | 9'-0" | 9'-6" | 10'-0" | 10'-6" | 11'-0" | 11'-6" | 12'-0" |
| | | 50 | 75 | 9.38 | 8.90 | 8.53 | 8.05 | 7.56 | 6.58 | 5.98 | 5.38 | |

*SPEC = specified wind load
+FACT = factored wind load

TABLE VII(a)

LIMITING LOAD FOR SCREW FASTENER CONFIGURATIONS
12" Spacing "Limit States"

Factored Load (psf)

| Beam Description | | Connection Type | Beam Length (ft) 8 | 8-½ | 9 | 9-½ | 10 | 10-½ | 11 | 11-½ | 12 |
|---|---|---|---|---|---|---|---|---|---|---|---|
| 6" | 18Ga | A | — | — | — | — | — | — | — | — | — |
| | | B | — | — | — | — | — | — | — | — | — |
| | | C | 239 | 201 | 173 | — | — | — | — | — | — |
| | | D | 215 | 190 | 170 | 147 | 129 | 114 | 99 | 89 | 80 |
| | | E | 144 | 127 | 114 | 102 | 92 | 83 | 76 | 69 | 63 |
| | | F | 119 | 103 | 92 | 82 | 73 | 66 | 60 | 55 | 50 |
| | | G | 72 | 63 | 57 | 51 | 47 | 41 | 38 | 34 | 32 |
| | 16Ga | A | 309 | — | — | — | — | — | — | — | — |
| | | B | 298 | 260 | 224 | 191 | 167 | 147 | 129 | — | — |
| | | C | 248 | 213 | 190 | 170 | 151 | 136 | 124 | 114 | 102 |
| | | D | 224 | 198 | 177 | 159 | 143 | 129 | 118 | 107 | 100 |
| | | E | 149 | 132 | 118 | 106 | 95 | 86 | 78 | 72 | 66 |
| | | F | 124 | 107 | 95 | 85 | 75 | 68 | 62 | 57 | 52 |
| | | G | 75 | 66 | 59 | 53 | 48 | 43 | 39 | 36 | 33 |
| | 14Ga | A | 392 | 321 | 278 | 236 | 206 | — | — | — | — |
| | | B | 315 | 278 | 249 | 223 | 201 | 182 | 159 | 144 | 128 |
| | | C | 261 | 225 | 201 | 179 | 159 | 144 | 131 | 120 | 110 |
| | | D | 236 | 209 | 187 | 168 | 151 | 136 | 124 | 113 | 104 |
| | | E | 158 | 139 | 125 | 112 | 101 | 91 | 83 | 76 | 70 |
| | | F | 131 | 113 | 101 | 90 | 80 | 72 | 65 | 60 | 55 |
| | | G | 79 | 70 | 62 | 56 | 50 | 45 | 41 | 38 | 35 |
| 8" | 18Ga | A | — | — | — | — | — | — | — | — | — |
| | | B | — | — | — | — | — | — | — | — | — |
| | | C | — | — | — | — | — | — | — | — | — |
| | | D | 266 | 224 | 192 | 162 | 141 | 125 | 108 | 98 | 87 |
| | | E | 178 | 157 | 140 | 126 | 114 | 103 | 94 | 86 | 78 |
| | | F | 139 | 122 | 108 | 96 | 86 | 78 | 71 | 65 | 60 |
| | | G | 89 | 78 | 70 | 63 | 57 | 51 | 47 | 43 | 39 |
| | 16Ga | A | — | — | — | — | — | — | — | — | — |
| | | B | 363 | 288 | 248 | 210 | 182 | — | — | — | — |
| | | C | 287 | 253 | 225 | 200 | 179 | 161 | — | — | — |
| | | D | 277 | 244 | 218 | 195 | 177 | 160 | 140 | 126 | 114 |
| | | E | 185 | 163 | 146 | 130 | 118 | 107 | 97 | 89 | 81 |
| | | F | 144 | 126 | 113 | 100 | 90 | 81 | 74 | 67 | 62 |
| | | G | 92 | 81 | 73 | 65 | 59 | 53 | 49 | 45 | 41 |
| | 14Ga | A | 447 | 356 | — | — | — | — | — | — | — |
| | | B | 390 | 344 | 306 | 260 | 225 | 198 | 177 | 156 | 141 |
| | | C | 304 | 267 | 238 | 211 | 189 | 172 | 156 | 142 | 131 |
| | | D | 292 | 258 | 231 | 206 | 187 | 169 | 154 | 141 | 129 |
| | | E | 195 | 172 | 154 | 138 | 125 | 113 | 103 | 94 | 86 |
| | | F | 152 | 133 | 119 | 105 | 95 | 86 | 78 | 71 | 65 |
| | | G | 98 | 86 | 77 | 69 | 62 | 56 | 51 | 47 | 43 |

Factored Load (psf)

| Beam Description | | Connection Type | Beam Length (ft) 13 | 14 | 15 | 16 | 17 | 18 | 19 | 20 | 22 | 24 |
|---|---|---|---|---|---|---|---|---|---|---|---|---|
| 6" | 18Ga | A | — | — | — | — | — | — | — | — | — | — |
| | | B | — | — | — | — | — | — | — | — | — | — |
| | | C | 75 | 63 | 53 | 45 | 44 | 38 | — | — | — | — |

TABLE VII(a)-continued

LIMITING LOAD FOR SCREW FASTENER CONFIGURATIONS
12" Spacing "Limit States"

| | | | | | | | | | | | | |
|---|---|---|---|---|---|---|---|---|---|---|---|---|
| | | D | 63 | 54 | 47 | 41 | 41 | 37 | 33 | 33 | 26 | 23 |
| | | E | 44 | 38 | 32 | 29 | 27 | 24 | 21 | 21 | 17 | 15 |
| | | F | 31 | 27 | 23 | 21 | 21 | 18 | 17 | 17 | 14 | 13 |
| | 16Ga | A | — | — | — | — | — | — | — | — | — | — |
| | | B | 98 | 81 | 69 | — | — | 57 | 50 | 44 | — | — |
| | | C | 90 | 78 | 67 | 59 | 54 | 48 | 42 | 42 | 33 | 30 |
| | | D | 65 | 56 | 49 | 43 | 43 | 38 | 34 | 35 | 28 | 23 |
| | | E | 45 | 39 | 34 | 30 | 28 | 24 | 22 | 21 | 18 | 16 |
| | | F | 33 | 28 | 24 | 21 | 21 | 19 | 17 | 17 | 14 | 13 |
| | 14Ga | A | 122 | 101 | 84 | 72 | 71 | 62 | — | — | — | — |
| | | B | 103 | 89 | 77 | 68 | 68 | 61 | 54 | 53 | 42 | 36 |
| | | C | 95 | 82 | 71 | 63 | 57 | 50 | 45 | 45 | 37 | 34 |
| | | D | 69 | 59 | 51 | 45 | 45 | 40 | 36 | 37 | 30 | 25 |
| | | E | 48 | 41 | 36 | 31 | 29 | 26 | 23 | 23 | 19 | 17 |
| | | F | 34 | 30 | 26 | 23 | 23 | 20 | 18 | 18 | 15 | 14 |
| 8" | 18Ga | A | — | — | — | — | — | — | — | — | — | — |
| | | B | — | — | — | — | — | — | — | — | — | — |
| | | C | 86 | 71 | — | — | — | — | — | — | — | — |
| | | D | 78 | 67 | 59 | 50 | 50 | 44 | 38 | 38 | 30 | 27 |
| | | E | 52 | 45 | 38 | 34 | 32 | 28 | 25 | 25 | 20 | 18 |
| | | F | 39 | 34 | 29 | 26 | 26 | 23 | 23 | 21 | 18 | 16 |
| | 16Ga | A | — | — | — | — | — | — | — | — | — | — |
| | | B | 110 | — | — | — | — | 65 | — | — | — | — |
| | | C | 108 | 92 | 77 | 65 | 63 | 56 | 50 | 50 | 39 | 35 |
| | | D | 81 | 70 | 61 | 53 | 54 | 48 | 48 | 41 | 33 | 28 |
| | | E | 54 | 46 | 40 | 35 | 33 | 29 | 26 | 25 | 21 | 19 |
| | | F | 41 | 35 | 30 | 27 | 27 | 24 | 24 | 22 | 18 | 17 |
| | 14Ga | A | 137 | 113 | — | — | — | — | — | — | — | — |
| | | B | 129 | 111 | 95 | 81 | 80 | 69 | 60 | 60 | 48 | 42 |
| | | C | 114 | 98 | 84 | 74 | 67 | 59 | 53 | 54 | 44 | 40 |
| | | D | 86 | 74 | 64 | 56 | 57 | 51 | 51 | 43 | 35 | 29 |
| | | E | 57 | 49 | 42 | 37 | 35 | 31 | 28 | 26 | 22 | 20 |
| | | F | 43 | 37 | 32 | 28 | 29 | 26 | 25 | — | — | 18 |

TABLE VII(b)

LIMITING LOAD FOR SCREW FASTENER CONFIGURATIONS
16" Spacing "Limit States"

| Factored Load (psf) | | | | | | | | | | | |
|---|---|---|---|---|---|---|---|---|---|---|---|
| Beam | | Connection | Beam Length (ft) | | | | | | | | |
| Description | | Type | 8 | 8-½ | 9 | 9-½ | 10 | 10-½ | 11 | 11-½ | 12 |
| 6" | 18Ga | A | — | — | — | — | — | — | — | — | — |
| | | B | — | — | — | — | — | — | — | — | — |
| | | C | 179 | 151 | 129 | — | — | — | — | — | — |
| | | b | 162 | 143 | 128 | 110 | 97 | 86 | 74 | 66 | 60 |
| | | E | 108 | 95 | 85 | 76 | 69 | 62 | 57 | 52 | 48 |
| | | F | 89 | 77 | 69 | 61 | 55 | 49 | 45 | 41 | 38 |
| | | G | 54 | 48 | 43 | 38 | 34 | 31 | 28 | 26 | 24 |
| | 16Ga | A | 232 | — | — | — | — | — | — | — | — |
| | | B | 224 | 195 | 168 | 143 | 125 | 110 | 97 | 86 | — |
| | | C | 186 | 160 | 143 | 127 | 113 | 102 | 93 | 85 | 77 |
| | | D | 168 | 148 | 133 | 119 | 107 | 96 | 88 | 80 | 74 |
| | | E | 112 | 99 | 88 | 79 | 71 | 64 | 59 | 54 | 49 |
| | | F | 93 | 80 | 71 | 64 | 57 | 51 | 46 | 43 | 39 |
| | | G | 56 | 49 | 44 | 40 | 36 | 32 | 29 | 27 | 25 |
| | 14Ga | A | 294 | 241 | 208 | 177 | 154 | — | — | — | — |
| | | B | 236 | 209 | 187 | 168 | 151 | 136 | 119 | 108 | 96 |
| | | C | 196 | 169 | 151 | 134 | 120 | 107 | 98 | 90 | 82 |
| | | D | 177 | 156 | 140 | 126 | 113 | 102 | 93 | 85 | 78 |
| | | E | 118 | 104 | 93 | 84 | 75 | 68 | 62 | 57 | 52 |
| | | F | 98 | 85 | 75 | 67 | 60 | 54 | 49 | 45 | 41 |
| | | G | 59 | 52 | 47 | 42 | 38 | 34 | 31 | 28 | 26 |
| 8" | 18Ga | A | — | — | — | — | — | — | — | — | — |
| | | B | — | — | — | — | — | — | — | — | — |
| | | C | — | — | — | — | — | — | — | — | — |
| | | D | 199 | 168 | 144 | 122 | 106 | 93 | 81 | 73 | 65 |
| | | E | 134 | 118 | 105 | 94 | 85 | 77 | 70 | 64 | 59 |
| | | F | 104 | 91 | 81 | 72 | 65 | 59 | 53 | 49 | 45 |
| | | G | 67 | 59 | 53 | 47 | 43 | 39 | 35 | 32 | 29 |

TABLE VII(b)-continued

LIMITING LOAD FOR SCREW FASTENER CONFIGURATIONS
16" Spacing "Limit States"

| | | | | | | | | | | |
|---|---|---|---|---|---|---|---|---|---|---|
| 16Ga | A | — | — | — | — | — | — | — | — | — |
| | B | 272 | 216 | 186 | 158 | 136 | — | — | — | — |
| | C | 216 | 190 | 169 | 150 | 135 | — | — | — | — |
| | D | 208 | 183 | 164 | 147 | 133 | 120 | 105 | 95 | 86 |
| | E | 139 | 122 | 109 | 98 | 88 | 80 | 73 | 67 | 61 |
| | F | 108 | 95 | 84 | 75 | 67 | 61 | 55 | 50 | 46 |
| | G | 69 | 61 | 55 | 49 | 44 | 40 | 37 | 33 | 31 |
| 14Ga | A | 335 | 267 | — | — | — | — | — | — | — |
| | B | 293 | 258 | 230 | 195 | 169 | 149 | 133 | 117 | 106 |
| | C | 228 | 200 | 178 | 158 | 142 | 129 | 117 | 107 | 98 |
| | D | 220 | 194 | 173 | 155 | 140 | 127 | 116 | 106 | 97 |
| | E | 146 | 129 | 115 | 103 | 93 | 85 | 77 | 71 | 65 |
| | F | 114 | 100 | 89 | 79 | 71 | 65 | 58 | 53 | 49 |
| | G | 73 | 65 | 58 | 52 | 47 | 42 | 39 | 35 | 32 |

Factored Load (psf)

| Beam Description | | Connection Type | Beam Length (ft) 13 | 14 | 15 | 16 | 17 | 18 | 19 | 20 | 22 | 24 |
|---|---|---|---|---|---|---|---|---|---|---|---|---|
| 6" | 18Ga | A | — | — | — | — | — | — | — | — | — | — |
| | | B | — | — | — | — | — | — | — | — | — | — |
| | | C | 56 | 47 | 39 | 34 | 33 | — | — | — | — | — |
| | | D | 47 | 40 | 35 | 31 | 31 | 28 | 25 | 25 | 19 | 17 |
| | | E | 33 | 28 | 24 | 21 | 20 | 18 | 16 | 16 | 13 | 12 |
| | | F | 24 | 20 | 18 | 15 | 16 | 14 | 12 | 13 | 10 | 10 |
| | 16Ga | A | — | — | — | — | — | — | — | — | — | — |
| | | B | 73 | 61 | 52 | — | 43 | 37 | 33 | — | — | — |
| | | C | 68 | 58 | 50 | 44 | 40 | 36 | 32 | 32 | 25 | 23 |
| | | D | 49 | 42 | 37 | 32 | 32 | 29 | 26 | 26 | 21 | 18 |
| | | E | 34 | 29 | 25 | 22 | 20 | 19 | 17 | 17 | 13 | 12 |
| | | F | 24 | 21 | 18 | 16 | 16 | 14 | 13 | 13 | 11 | 10 |
| | 14Ga | A | 91 | 75 | 61 | 54 | 53 | — | — | — | — | — |
| | | B | 77 | 67 | 58 | 51 | 51 | 46 | 41 | 39 | 32 | 27 |
| | | C | 72 | 62 | 53 | 47 | 43 | 38 | 34 | 34 | 28 | 25 |
| | | D | 52 | 44 | 39 | 34 | 34 | 30 | 27 | 27 | 22 | 19 |
| | | E | 36 | 31 | 27 | 23 | 22 | 19 | 18 | 17 | 14 | 13 |
| | | F | 26 | 22 | 19 | 17 | 17 | 15 | 14 | 14 | 11 | 10 |
| 8" | 18Ga | A | — | — | — | — | — | — | — | — | — | — |
| | | B | — | — | — | — | — | — | — | — | — | — |
| | | C | 64 | 53 | — | — | — | — | — | — | — | — |
| | | D | 59 | 51 | 44 | 37 | 37 | 33 | 28 | 28 | 23 | 20 |
| | | E | 39 | 33 | 29 | 25 | 24 | 21 | 19 | 18 | 15 | 14 |
| | | F | 29 | 25 | 22 | 19 | 20 | 17 | 17 | 16 | 13 | 12 |
| | 16Ga | A | — | — | — | — | — | — | — | — | — | — |
| | | B | 82 | — | — | — | 48 | — | — | — | — | — |
| | | C | 81 | 69 | 57 | 48 | 47 | 42 | 37 | 37 | 29 | 26 |
| | | D | 61 | 52 | 46 | 40 | 41 | 36 | 36 | 31 | 25 | 21 |
| | | E | 40 | 35 | 30 | 26 | 25 | 22 | 20 | 19 | 16 | 14 |
| | | F | 31 | 26 | 23 | 20 | 20 | 18 | 18 | 17 | 14 | 13 |
| | 14Ga | A | 102 | 84 | — | — | — | — | — | — | — | — |
| | | B | 97 | 83 | 71 | 61 | 60 | 52 | 45 | 45 | 36 | 32 |
| | | C | 85 | 73 | 63 | 56 | 50 | 44 | 40 | 40 | 33 | 30 |
| | | D | 65 | 55 | 48 | 42 | 43 | 38 | 38 | 32 | 27 | 22 |
| | | E | 43 | 37 | 32 | 28 | 26 | 23 | 21 | 20 | 17 | 15 |
| | | F | 32 | 28 | 24 | 21L | 22 | 19 | 19 | 17 | 14 | 13 |

TABLE VII(c)

LIMITING LOAD FOR SCREW FASTENER CONFIGURATIONS
24" Spacing "Limit States"

Factored Load (psf)

| Beam Description | | Connection Type | Beam Length (ft) 8 | 8-½ | 9 | 9-½ | 10 | 10-½ | 11 | 11-½ | 12 |
|---|---|---|---|---|---|---|---|---|---|---|---|
| 6" | 18Ga | A | — | — | — | — | — | — | — | — | — |
| | | B | — | — | — | — | — | — | — | — | — |
| | | C | 119 | 101 | 86 | — | — | — | — | — | — |
| | | D | 108 | 95 | 85 | 74 | 65 | 57 | 50 | 44 | 40 |

TABLE VII(c)-continued

LIMITING LOAD FOR SCREW FASTENER CONFIGURATIONS
24" Spacing "Limit States"

| | | | | | | | | | | | |
|---|---|---|---|---|---|---|---|---|---|---|---|
| | | E | 72 | 63 | 57 | 51 | 46 | 41 | 38 | 34 | 32 |
| | | F | 60 | 51 | 46 | 41 | 36 | 33 | 30 | 27 | 25 |
| | | G | 36 | 32 | 28 | 25 | 23 | 21 | 19 | 17 | 16 |
| | 16Ga | A | 155 | — | — | — | — | — | — | — | — |
| | | B | 149 | 130 | 112 | 95 | 83 | 74 | 65 | — | — |
| | | C | 124 | 107 | 95 | 85 | 75 | 68 | 62 | 57 | 51 |
| | | D | 112 | 99 | 88 | 79 | 71 | 65 | 59 | 54 | 49 |
| | | E | 75 | 66 | 59 | 53 | 48 | 43 | 39 | 36 | 33 |
| | | F | 62 | 53 | 48 | 42 | 38 | 34 | 31 | 28 | 26 |
| | | G | 37 | 33 | 29 | 26 | 24 | 21 | 20 | 18 | 16 |
| | 14Ga | A | 196 | 161 | 139 | 118 | 103 | — | — | — | — |
| | | B | 158 | 139 | 125 | 112 | 101 | 91 | 80 | 72 | 64 |
| | | C | 131 | 113 | 101 | 90 | 80 | 72 | 65 | 60 | 55 |
| | | D | 118 | 104 | 93 | 84 | 75 | 68 | 62 | 57 | 52 |
| | | E | 79 | 70 | 62 | 56 | 50 | 45 | 41 | 38 | 35 |
| | | F | 65 | 56 | 50 | 45 | 40 | 36 | 33 | 30 | 27 |
| | | G | 39 | 35 | 31 | 28 | 25 | 23 | 21 | 19 | 17 |
| 8" | 18Ga | A | — | — | — | — | — | — | — | — | — |
| | | B | — | — | — | — | — | — | — | — | — |
| | | C | — | — | — | — | — | — | — | — | — |
| | | D | 133 | 112 | 96 | 81 | 71 | 62 | 54 | 49 | 44 |
| | | E | 89 | 78 | 70 | 63 | 57 | 51 | 47 | 43 | 39 |
| | | F | 69 | 61 | 54 | 48 | 43 | 39 | 36 | 32 | 30 |
| | | G | 45 | 39 | 35 | 31 | 28 | 26 | 23 | 21 | 20 |
| | 16Ga | A | — | — | — | — | — | — | — | — | — |
| | | B | 182 | 144 | 124 | 105 | 91 | — | — | — | — |
| | | C | 144 | 126 | 113 | 100 | 90 | — | — | — | — |
| | | D | 139 | 122 | 109 | 98 | 88 | 80 | 70 | 63 | 57 |
| | | E | 92 | 81 | 73 | 65 | 59 | 53 | 49 | 45 | 41 |
| | | F | 72 | 63 | 56 | 50 | 45 | 41 | 37 | 34 | 31 |
| | | G | 46 | 41 | 36 | 33 | 29 | 27 | 24 | 22 | 20 |
| | 14Ga | A | 224 | 178 | — | — | — | — | — | — | — |
| | | B | 195 | 172 | 153 | 130 | 113 | 99 | 89 | 78 | 71 |
| | | C | 152 | 133 | 119 | 105 | 95 | 86 | 78 | 71 | 65 |
| | | D | 146 | 129 | 115 | 103 | 93 | 85 | 77 | 71 | 65 |
| | | E | 98 | 86 | 77 | 69 | 62 | 56 | 51 | 47 | 43 |
| | | F | 76 | 67 | 59 | 53 | 47 | 43 | 39 | 36 | 33 |
| | | G | 50 | 43 | 38 | 34 | 31 | 28 | 26 | 24 | 22 |

Factored Load (psf)

| Beam Description | | Connection Type | Beam Length (ft) 13 | 14 | 15 | 16 | 17 | 18 | 19 | 20 | 22 | 24 |
|---|---|---|---|---|---|---|---|---|---|---|---|---|
| 6" | 18Ga | A | — | — | — | — | — | — | — | — | — | — |
| | | B | — | — | — | — | — | — | — | — | — | — |
| | | C | 38 | 32 | 26 | 23 | 22 | 19 | — | — | — | — |
| | | D | 31 | 27 | 23 | 21 | 21 | 18 | 17 | 17 | 13 | 11 |
| | | E | 22 | 19 | 16 | 14 | 13 | 12 | 11 | 10 | 9 | 8 |
| | | F | 16 | 13 | 12 | 10 | 10 | 9 | 8 | 8 | 7 | 6 |
| | 16Ga | A | — | — | — | — | — | — | — | — | — | — |
| | | B | 49 | 41 | 35 | — | 29 | 25 | 22 | — | — | — |
| | | C | 45 | 39 | 34 | 29 | 27 | 24 | 21 | 21 | 17 | 15 |
| | | D | 33 | 28 | 24 | 21 | 21 | 19 | 17 | 17 | 14 | 11 |
| | | E | 23 | 19 | 17 | 15 | 14 | 12 | 11 | 11 | 9 | 8 |
| | | F | 16 | 14 | 12 | 11 | 11 | 10 | 9 | 9 | 7 | 7 |
| | 14Ga | A | 61 | 50 | 42 | 36 | 35 | 31 | — | — | — | — |
| | | B | 52 | 44 | 39 | 34 | 34 | 30 | 27 | 26 | 21 | 18 |
| | | C | 48 | 41 | 36 | 31 | 28 | 25 | 22 | 23 | 19 | 17 |
| | | D | 34 | 30 | 26 | 23 | 23 | 20 | 18 | 18 | 15 | 12 |
| | | E | 24 | 21 | 18 | 16 | 15 | 13 | 12 | 11 | 9 | 8 |
| | | F | 17 | 15 | 13 | 11 | 11 | 10 | 9 | 9 | 8 | 7 |
| 8" | 18Ga | A | — | — | — | — | — | — | — | — | — | — |
| | | B | — | — | — | — | — | — | — | — | — | — |
| | | C | 43 | 35 | — | — | — | — | — | — | — | — |
| | | D | 39 | 34 | 29 | 25 | 25 | 22 | 19 | 19 | 15 | 14 |
| | | E | 26 | 22 | 19 | 17 | 16 | 14 | 13 | 12 | 10 | 9 |
| | | F | 20 | 17 | 15 | 13 | 13 | 12 | 12 | 11 | 9 | 8 |
| | 16Ga | A | — | — | — | — | — | — | — | — | — | — |
| | | B | 55 | — | — | — | — | | — | — | — | — |
| | | C | 54 | 46 | 38 | 32 | 32 | 28 | 25 | 25 | 20 | 17 |
| | | D | 41 | 35 | 30 | 27 | 27 | 24 | 24 | 20 | 17 | 14 |
| | | E | 27 | 23 | 20 | 18 | 16 | 15 | 13 | 13 | 11 | 10 |
| | | F | 20 | 17 | 15 | 13 | 14 | 12 | 12 | 11 | 9 | 9 |
| | 14Ga | A | 68 | 56 | — | — | — | — | — | — | — | — |

TABLE VII(c)-continued

| LIMITING LOAD FOR SCREW FASTENER CONFIGURATIONS 24" Spacing "Limit States" | | | | | | | | | | |
|---|---|---|---|---|---|---|---|---|---|---|
| B | 65 | 55 | 47 | 41 | 40 | 3 | 30 | 30 | 24 | 21 |
| C | 57 | 49 | 42 | 37 | 33 | 29 | 26 | 27 | 22 | 20 |
| D | 43 | 37 | 32 | 28 | 29 | 26 | 25 | 22 | 18 | 15 |
| E | 28 | 24 | 21 | 19 | 17 | 15 | 14 | 13 | 11 | 10 |
| F | 22 | 18 | 16 | 14 | 14 | 13 | 13 | 12 | 10 | 9 |

TABLE VIII

| SCREW AMD WEB CONFIGURATION CODES | | | | | | | | |
|---|---|---|---|---|---|---|---|---|
| FOR BEAMS 8'-0" TO 12'-0" (5 WEBS) | | | | | | | | |
| A | 5 | 3 | 1 | 3 | 5 | | | |
| B | 4 | 3 | 1 | 3 | 4 | | | |
| C | 4 | 2 | 1 | 2 | 4 | | | |
| D | 3 | 2 | 1 | 2 | 3 | | | |
| E | 2 | 2 | 1 | 2 | 2 | | | |
| F | 2 | 1 | 1 | 1 | 2 | | | |
| G | 1 | 1 | 1 | 1 | 1 | | | |
| FOR BEAMS 13'-0" TO 16'-0" (6 WEBS) | | | | | | | | |
| A | 4 | 3 | 1 | 1 | 3 | 4 | | |
| B | 3 | 3 | 1 | 1 | 3 | 3 | | |
| C | 3 | 2 | 1 | 1 | 2 | 3 | | |
| D | 2 | 2 | 1 | 1 | 2 | 2 | | |
| E | 2 | 1 | 1 | 1 | 1 | 2 | | |
| F | 1 | 1 | 1 | 1 | 1 | 1 | | |
| FOR BEAMS 17'-0" TO 19'-0" (7 WEBS) | | | | | | | | |
| A | 4 | 3 | 2 | 1 | 2 | 3 | 4 | |
| B | 3 | 3 | 2 | 1 | 2 | 3 | 3 | |
| C | 3 | 2 | 1 | 1 | 1 | 2 | 3 | |
| D | 2 | 2 | 1 | 1 | 1 | 2 | 2 | |
| E | 2 | 1 | 1 | 1 | 1 | 1 | 2 | |
| F | 1 | 1 | 1 | 1 | 1 | 1 | 1 | |
| FOR BEAMS 20'-0" AND 22'-0" (8 WEBS) | | | | | | | | |
| A | 4 | 3 | 2 | 1 | 1 | 2 | 3 | 4 |
| B | 3 | 3 | 2 | 1 | 1 | 2 | 3 | 3 |
| C | 3 | 2 | 2 | 1 | 1 | 2 | 2 | 3 |
| D | 2 | 2 | 1 | 1 | 1 | 1 | 2 | 2 |
| E | 2 | 1 | 1 | 1 | 1 | 1 | 1 | 2 |

TABLE VIII-continued

| SCREW AMD WEB CONFIGURATION CODES | | | | | | | | | |
|---|---|---|---|---|---|---|---|---|---|
| F | 1 | 1 | 1 | 1 | 1 | 1 | 1 | 1 | |
| FOR BEAM 24'-0" (9 WEBS) | | | | | | | | | |
| A | 4 | 3 | 2 | 1 | 1 | 1 | 2 | 3 | 4 |
| B | 3 | 3 | 2 | 1 | 1 | 1 | 2 | 3 | 3 |
| C | 3 | 2 | 2 | 1 | 1 | 1 | 2 | 2 | 3 |
| D | 2 | 2 | 1 | 1 | 1 | 1 | 1 | 2 | 2 |
| E | 2 | 1 | 1 | 1 | 1 | 1 | 1 | 1 | 2 |
| F | 1 | 1 | 1 | 1 | 1 | 1 | 1 | 1 | 1 |

TABLE IX(a)

6" BEAM WIND LOAD TABLE
MAXIMUM UNIFORMLY DISTRIBUTED SINGLE BEAM LOAD (psf)
"Limit States"
Strength Loads are Factored Deflection Loads are Specified
(Alternate Embodiment)

| Beam Length (ft) | Strength or Deflection | Beam Spacing (in) 6" × 18GA 12 | 16 | 24 | 6" × 16GA 12 | 16 | 24 | 6" × 14GA 12 | 16 | 24 |
|---|---|---|---|---|---|---|---|---|---|---|
| 8 | STRENGTH | 239 | 179 | 119 | 309 | 23 | 155 | 395 | 296 | 197 |
| | L/360 | 470 | 352 | 235 | 563 | 422 | 282 | 645 | 484 | 323 |
| 8½ | STRENGTH | 201 | 151 | 101 | 260 | 19 | 130 | 321 | 241 | 161 |
| | L/360 | 376 | 282 | 188 | 452 | 339 | 226 | 524 | 393 | 262 |
| 9 | STRENGTH | 173 | 129 | 86 | 224 | 168 | 112 | 278 | 208 | 139 |
| | L/360 | 302 | 226 | 151 | 365 | 273 | 183 | 424 | 318 | 212 |
| 9½ | STRENGTH | 147 | 110 | 74 | 191 | 143 | 95 | 236 | 177 | 118 |
| | L/360 | 246 | 185 | 123 | 300 | 225 | 150 | 351 | 263 | 176 |
| 10 | STRENGTH | 129 | 97 | 65 | 167 | 125 | 83 | 206 | 154 | 103 |
| | L/360 | 203 | 152 | 102 | 248 | 186 | 124 | 292 | 219 | 146 |
| 10½ | STRENGTH | 114 | 86 | 57 | 147 | 110 | 74 | 182 | 136 | 91 |
| | L/360 | 169 | 127 | 85 | 208 | 156 | 104 | 246 | 185 | 123 |
| 11 | STRENGTH | 99 | 74 | 50 | 129 | 97 | 65 | 159 | 119 | 80 |

TABLE IX(a)-continued

6" BEAM WIND LOAD TABLE
MAXIMUM UNIFORMLY DISTRIBUTED SINGLE BEAM LOAD (psf)
"Limit States"
Strength Loads are Factored Deflection Loads are Specified
(Alternate Embodiment)

| Beam Length (ft) | Strength or Deflection | Beam Spacing (in) 6" × 18GA 12 | 16 | 24 | 6" × 16GA 12 | 16 | 24 | 6" × 14GA 12 | 16 | 24 |
|---|---|---|---|---|---|---|---|---|---|---|
| | L/360 | 142 | 107 | 71 | 176 | 132 | 88 | 208 | 156 | 104 |
| 11½ | STRENGTH | 89 | 66 | 44 | 114 | 86 | 57 | 144 | 108 | 72 |
| | L/360 | 121 | 91 | 61 | 150 | 113 | 75 | 178 | 134 | 89 |
| 12 | STRENGTH | 80 | 60 | 40 | 102 | 77 | 51 | 128 | 96 | 64 |
| | L/360 | 103 | 78 | 52 | 128 | 96 | 64 | 153 | 115 | 77 |
| 13 | STRENGTH | 75 | 56 | 38 | 98 | 73 | 49 | 122 | 91 | 61 |
| | L/360 | 118 | 89 | 59 | 146 | 109 | 73 | 173 | 129 | 87 |
| 14 | STRENGTH | 63 | 47 | 32 | 81 | 61 | 41 | 101 | 75 | 50 |
| | L/360 | 90 | 68 | 45 | 112 | 84 | 56 | 134 | 100 | 67 |
| 15 | STRENGTH | 53 | 39 | 26 | 69 | 52 | 35 | 84 | 63 | 42 |
| | L/360 | 71 | 53 | 36 | 88 | 66 | 44 | 106 | 80 | 53 |
| 16 | STRENGTH | 45 | 34 | 23 | 59 | 44 | 29 | 72 | 54 | 36 |
| | L/360 | 56 | 42 | 28 | 71 | 53 | 36 | 85 | 64 | 43 |
| 17 | STRENGTH | 44 | 33 | 22 | 57 | 43 | 29 | 71 | 53 | 35 |
| | L/360 | 59 | 44 | 30 | 74 | 55 | 37 | 89 | 66 | 45 |
| 18 | STRENGTH | 38 | 28 | 19 | 50 | 37 | 25 | 62 | 46 | 31 |
| | L/360 | 48 | 36 | 24 | 60 | 45 | 30 | 73 | 55 | 37 |
| 19 | STRENGTH | 33 | 25 | 17 | 44 | 33 | 22 | 54 | 41 | 27 |
| | L/360 | 40 | 30 | 20 | 50 | 37 | 25 | 61 | 46 | 31 |
| 20 | STRENGTH | 33 | 25 | 17 | 42 | 32 | 21 | 53 | 39 | 26 |
| | L/360 | 42 | 32 | 21 | 53 | 39 | 27 | 64 | 48 | 32 |
| 22 | STRENGTH | 26 | 19 | 13 | 33 | 25 | 17 | 42 | 32 | 21 |
| | L/360 | 30 | 23 | 15 | 38 | 28 | 19 | 47 | 35 | 24 |
| 24 | STRENGTH | 23 | 17 | 11 | 30 | 23 | 15 | 36 | 27 | 16 |
| | L/360 | 26 | 19 | 13 | 33 | 25 | 17 | 40 | 30 | 20 |

TABLE IX(b)

8" BEAM WIND LOAD TABLE
MAXIMUM UNIFORMLY DISTRIBUTED SINGLE BEAM LOAD (psf)
"Limit States"
Strength Loads are Factored Deflection Loads are Specified
(Alternate Embodiment)

| Beam Length (ft) | Strength or Deflection | Beam Spacing (in) 8" × 18GA 12 | 16 | 24 | 8" × 16GA 12 | 16 | 24 | 8" × 14GA 12 | 16 | 24 |
|---|---|---|---|---|---|---|---|---|---|---|
| 8 | STRENGTH | 266 | 199 | 133 | 363 | 272 | 182 | 447 | 335 | 224 |
| | L/360 | 615 | 461 | 308 | 727 | 546 | 364 | 833 | 624 | 417 |
| 8½ | STRENGTH | 224 | 168 | 112 | 288 | 216 | 144 | 356 | 267 | 178 |
| | L/360 | 477 | 358 | 239 | 566 | 424 | 283 | 653 | 489 | 327 |
| 9 | STRENGTH | 192 | 144 | 96 | 248 | 186 | 124 | 306 | 230 | 153 |
| | L/360 | 375 | 281 | 188 | 454 | 341 | 227 | 529 | 397 | 265 |
| 9½ | STRENGTH | 162 | 122 | 81 | 210 | 158 | 105 | 260 | 195 | 130 |
| | L/360 | 300 | 225 | 150 | 365 | 273 | 183 | 427 | 321 | 214 |
| 10 | STRENGTH | 141 | 106 | 71 | 182 | 136 | 91 | 225 | 169 | 113 |
| | L/360 | 245 | 183 | 123 | 299 | 224 | 150 | 352 | 264 | 176 |
| 10½ | STRENGTH | 125 | 93 | 62 | 161 | 120 | 80 | 198 | 149 | 99 |
| | L/360 | 201 | 151 | 101 | 247 | 186 | 124 | 291 | 218 | 146 |
| 11 | STRENGTH | 108 | 81 | 54 | 140 | 105 | 70 | 177 | 133 | 89 |
| | L/360 | 167 | 125 | 84 | 206 | 154 | 103 | 245 | 183 | 123 |
| 11½ | STRENGTH | 98 | 73 | 49 | 126 | 95 | 63 | 156 | 117 | 78 |
| | L/360 | 141 | 106 | 71 | 174 | 131 | 87 | 207 | 155 | 104 |
| 12 | STRENGTH | 87 | 65 | 44 | 114 | 86 | 57 | 141 | 106 | 71 |
| | L/360 | 120 | 90 | 60 | 148 | 111 | 74 | 177 | 133 | 89 |
| 13 | STRENGTH | 86 | 64 | 43 | 110 | 82 | 55 | 137 | 102 | 68 |
| | L/360 | 148 | 111 | 74 | 182 | 136 | 91 | 215 | 161 | 108 |
| 14 | STRENGTH | 71 | 53 | 35 | 92 | 69 | 46 | 113 | 84 | 56 |
| | L/360 | 112 | 84 | 56 | 138 | 104 | 69 | 165 | 124 | 83 |
| 15 | STRENGTH | 59 | 44 | 29 | 77 | 57 | 38 | 95 | 71 | 47 |
| | L/360 | 86 | 64 | 43 | 107 | 80 | 54 | 128 | 96 | 64 |

TABLE IX(b)-continued

8" BEAM WIND LOAD TABLE
MAXIMUM UNIFORMLY DISTRIBUTED SINGLE BEAM LOAD (psf)
"Limit States"
Strength Loads are Factored Deflection Loads are Specified
(Alternate Embodiment)

| Beam Length (ft) | Strength or Deflection | Beam Spacing (in) 8" × 18GA 12 | 16 | 24 | 8" × 16GA 12 | 16 | 24 | 8" × 14GA 12 | 16 | 24 |
|---|---|---|---|---|---|---|---|---|---|---|
| 16 | STRENGTH | 50 | 37 | 25 | 65 | 48 | 32 | 81 | 61 | 41 |
| | L/360 | 69 | 52 | 35 | 85 | 64 | 43 | 102 | 77 | 51 |
| 17 | STRENGTH | 50 | 37 | 25 | 65 | 48 | 32 | 80 | 60 | 40 |
| | L/360 | 76 | 57 | 38 | 95 | 71 | 48 | 113 | 84 | 57 |
| 18 | STRENGTH | 44 | 33 | 22 | 56 | 42 | 28 | 69 | 52 | 35 |
| | L/360 | 61 | 46 | 31 | 77 | 57 | 39 | 92 | 69 | 46 |
| 19 | STRENGTH | 38 | 28 | 19 | 50 | 37 | 25 | 60 | 45 | 30 |
| | L/360 | 50 | 37 | 25 | 63 | 47 | 32 | 76 | 57 | 38 |
| 20 | STRENGTH | 38 | 28 | 19 | 50 | 37 | 25 | 60 | 45 | 30 |
| | L/360 | 57 | 43 | 29 | 71 | 53 | 36 | 85 | 64 | 43 |
| 22 | STRENGTH | 30 | 23 | 15 | 39 | 29 | 20 | 48 | 36 | 24 |
| | L/360 | 40 | 30 | 20 | 51 | 38 | 26 | 61 | 46 | 31 |
| 24 | STRENGTH | 27 | 20 | 14 | 35 | 26 | 17 | 42 | 32 | 21 |
| | L/360 | 36 | 27 | 18 | 46 | 35 | 23 | 56 | 42 | 28 |

TABLE X(a)

BEAM COMBINED WIND AND AXIAL LOAD TABLE
MAXIMUM FACTORED AXIAL LOAD (kips) 12" c/c
(Alternate Embodiment) "Limit States"

| DEPTH in. | GAUGE | WIND SPEC* psf. | WIND FACT+ psf. | LENGTH 8'-0" | 8'-6" | 9'-0" | 9'-6" | 10'-0" | 10'-6" | 11'-0" | 11'-6" | 12'-0" |
|---|---|---|---|---|---|---|---|---|---|---|---|---|
| 6 | 18 | 10 | 15 | 12.88 | 12.73 | 12.57 | 12.37 | 12.17 | 11.97 | 11.73 | 11.48 | 11.23 |
| | | 20 | 30 | 12.08 | 11.77 | 11.46 | 11.07 | 10.67 | 10.26 | 9.77 | 9.28 | 8.79 |
| | | 30 | 45 | 11.28 | 10.82 | 10.35 | 9.76 | 9.16 | 8.55 | 7.82 | 7.08 | 6.34 |
| | | 40 | 60 | 10.48 | 9.87 | 9.24 | 8.45 | 7.66 | 6.85 | 5.87 | 4.88 | 3.90 |
| | | 50 | 75 | 9.68 | 8.91 | 8.13 | 7.15 | 6.15 | 5.14 | 3.92 | 2.69 | 1.45 |
| | 16 | 10 | 15 | 17.01 | 16.86 | 16.70 | 16.50 | 16.30 | 16.10 | 15.85 | 15.60 | 15.35 |
| | | 20 | 30 | 16.21 | 15.90 | 15.58 | 15.18 | 14.78 | 14.37 | 13.88 | 13.38 | 12.88 |
| | | 30 | 45 | 15.40 | 14.93 | 14.46 | 13.86 | 13.26 | 12.65 | 11.90 | 11.16 | 10.41 |
| | | 40 | 60 | 14.59 | 13.97 | 13.34 | 12.55 | 11.74 | 10.42 | 9.93 | 8.94 | 7.94 |
| | | 50 | 75 | 13.79 | 13.01 | 12.22 | 11.23 | 10.22 | 9.20 | 7.96 | 6.72 | 5.47 |
| | 14 | 10 | 15 | 21.48 | 21.33 | 21.17 | 20.97 | 20.76 | 20.55 | 20.30 | 20.05 | 19.80 |
| | | 20 | 30 | 20.67 | 20.35 | 20.03 | 19.63 | 19.22 | 18.81 | 18.31 | 17.81 | 17.30 |
| | | 30 | 45 | 19.85 | 19.38 | 18.90 | 18.30 | 17.68 | 17.06 | 16.31 | 15.56 | 14.80 |
| | | 40 | 60 | 19.03 | 18.41 | 17.77 | 16.96 | 16.15 | 15.31 | 14.31 | 13.31 | 12.30 |
| | | 50 | 75 | 18.22 | 17.43 | 16.64 | 15.63 | 14.61 | 13.57 | 12.32 | 11.07 | 9.79 |
| 8 | 18 | 10 | 15 | 12.94 | 12.80 | 12.65 | 12.47 | 12.28 | 12.09 | 11.85 | 11.66 | 11.38 |
| | | 20 | 30 | 12.21 | 11.92 | 11.63 | 11.25 | 10.87 | 10.49 | 10.03 | 9.64 | 9.09 |
| | | 30 | 45 | 11.47 | 11.04 | 10.60 | 10.04 | 9.47 | 8.90 | 8.20 | 7.62 | 6.79 |
| | | 40 | 60 | 10.74 | 10.16 | 9.58 | 8.82 | 8.07 | 7.30 | 6.37 | 5.60 | 4.50 |
| | | 50 | 75 | 10.00 | 9.28 | 8.55 | 7.61 | 6.66 | 5.71 | 4.55 | 3.58 | 2.20 |
| | 16 | 10 | 15 | 17.08 | 16.93 | 16.78 | 16.59 | 16.40 | 16.21 | 15.97 | 15.78 | 15.50 |
| | | 20 | 30 | 16.33 | 16.04 | 15.75 | 15.37 | 14.98 | 14.60 | 14.13 | 13.74 | 13.18 |
| | | 30 | 45 | 15.59 | 15.16 | 14.71 | 14.14 | 13.57 | 12.99 | 12.28 | 11.70 | 10.86 |
| | | 40 | 60 | 14.85 | 14.27 | 13.68 | 12.91 | 12.15 | 11.38 | 10.44 | 9.66 | 8.54 |
| | | 50 | 75 | 14.11 | 113.38 | 12.64 | 11.69 | 10.73 | 9.77 | 8.59 | 7.62 | 6.22 |
| | 14 | 10 | 15 | 21.59 | 21.40 | 21.25 | 21.06 | 20.86 | 20.67 | 20.47 | 20.23 | 19.99 |
| | | 20 | 30 | 20.88 | 20.50 | 20.20 | 19.82 | 19.43 | 19.04 | 18.64 | 18.16 | 17.68 |
| | | 30 | 45 | 20.18 | 19.60 | 19.15 | 18.58 | 17.99 | 17.41 | 16.82 | 16.09 | 15.37 |
| | | 40 | 60 | 19.47 | 18.70 | 18.10 | 17.34 | 16.55 | 15.78 | 14.99 | 14.03 | 13.07 |
| | | 50 | 75 | 18.76 | 17.80 | 17.06 | 16.10 | 15.12 | 14.15 | 13.16 | 11.96 | 10.76 |

*SPEC = specified wind load
+FACT = factored wind load

TABLE X(b)

BEAM COMBINED WIND AND AXIAL LOAD TABLE
MAXIMUM FACTORED AXIAL LOAD (kips) 16" c/c
(Alternate Embodiment) "Limit States"

| DEPTH | | WIND SPEC* | WIND FACT+ | LENGTH | | | | | | | | |
|---|---|---|---|---|---|---|---|---|---|---|---|---|
| in. | GAUGE | psf. | psf. | 8'-0" | 8'-6" | 9'-0" | 9'-6" | 10'-0" | 10'-6" | 11'-0" | 11'-6" | 12'-0" |
| 6 | 18 | 10 | 15 | 9.66 | 9.54 | 9.43 | 9.28 | 9.13 | 8.98 | 8.80 | 8.61 | 8.43 |
| | | 20 | 30 | 9.06 | 8.83 | 8.60 | 8.30 | 8.00 | 7.70 | 7.33 | 6.96 | 6.59 |
| | | 30 | 45 | 8.46 | 8.11 | 7.76 | 7.32 | 6.87 | 6.42 | 5.87 | 5.31 | 4.76 |
| | | 40 | 60 | 7.86 | 7.40 | 6.93 | 6.34 | 5.74 | 5.13 | 4.40 | 3.66 | 2.92 |
| | | 50 | 75 | 7.26 | 6.68 | 6.10 | 5.36 | 4.62 | 3.85 | 2.94 | 2.01 | 1.09 |
| | 16 | 10 | 15 | 12.76 | 12.64 | 12.53 | 12.38 | 12.23 | 12.07 | 11.89 | 11.70 | 11.51 |
| | | 20 | 30 | 12.15 | 11.92 | 11.69 | 11.39 | 11.09 | 10.78 | 10.41 | 10.03 | 9.66 |
| | | 30 | 45 | 11.55 | 11.20 | 10.85 | 10.40 | 9.95 | 9.48 | 8.93 | 8.37 | 7.81 |
| | | 40 | 60 | 10.94 | 10.48 | 10.01 | 9.41 | 8.81 | 8.19 | 7.45 | 6.70 | 5.96 |
| | | 50 | 75 | 10.34 | 9.76 | 9.17 | 8.42 | 7.67 | 6.90 | 5.97 | 5.04 | 4.10 |
| | 14 | 10 | 15 | 16.11 | 15.99 | 15.88 | 15.72 | 15.57 | 15.42 | 15.23 | 15.04 | 14.85 |
| | | 20 | 30 | 15.51 | 15.26 | 15.03 | 14.72 | 14.42 | 14.11 | 13.73 | 13.35 | 12.97 |
| | | 30 | 45 | 14.89 | 14.53 | 14.18 | 13.72 | 13.26 | 12.80 | 12.23 | 11.67 | 11.10 |
| | | 40 | 60 | 14.28 | 13.80 | 13.33 | 12.72 | 12.11 | 11.49 | 10.74 | 9.98 | 9.22 |
| | | 50 | 75 | 113.66 | 13.07 | 12.48 | 11.72 | 10.96 | 10.18 | 9.24 | 8.30 | 7.35 |
| 8 | 18 | 10 | 15 | 9.71 | 9.60 | 9.49 | 9.35 | 9.21 | 9.06 | 8.89 | 8.75 | 8.54 |
| | | 20 | 30 | 9.16 | 8.94 | 8.72 | 8.44 | 8.16 | 7.87 | 7.52 | 7.23 | 6.82 |
| | | 30 | 45 | 8.60 | 8.28 | 7.95 | 7.53 | 7.10 | 6.67 | 6.15 | 5.72 | 5.10 |
| | | 40 | 60 | 8.05 | 7.62 | 7.18 | 6.62 | 6.05 | 5.48 | 4.78 | 4.20 | 3.37 |
| | | 50 | 75 | 7.50 | 6.96 | 6.42 | 5.71 | 5.00 | 4.28 | 3.41 | 2.69 | 1.65 |
| | 16 | 10 | 15 | 12.81 | 12.70 | 12.59 | 12.45 | 12.30 | 12.16 | 11.98 | 11.83 | 11.63 |
| | | 20 | 30 | 12.25 | 12.03 | 11.81 | 11.53 | 11.24 | 10.95 | 10.60 | 10.30 | 9.89 |
| | | 30 | 45 | 11.69 | 11.37 | 11.04 | 10.61 | 10.18 | 9.74 | 9.21 | 8.77 | 8.15 |
| | | 40 | 60 | 11.14 | 10.70 | 10.26 | 9.69 | 9.11 | 8.53 | 7.83 | 7.24 | 6.41 |
| | | 50 | 75 | 10.58 | 10.03 | 9.48 | 8.77 | 8.05 | 7.32 | 6.44 | 5.71 | 4.67 |
| | 14 | 10 | 15 | 16.19 | 16.05 | 15.94 | 15.79 | 15.65 | 15.50 | 15.35 | 15.17 | 14.99 |
| | | 20 | 30 | 15.66 | 15.38 | 15.15 | 14.86 | 14.57 | 14.28 | 13.98 | 13.62 | 13.26 |
| | | 30 | 45 | 15.13 | 14.70 | 14.36 | 13.93 | 13.49 | 13.06 | 12.61 | 12.07 | 11.53 |
| | | 40 | 60 | 14.60 | 14.03 | 13.58 | 13.00 | 12.42 | 11.83 | 11.24 | 10.52 | 9.80 |
| | | 50 | 75 | 14.07 | 13.35 | 12.79 | 12.07 | 11.34 | 10.61 | 9.87 | 8.971 | 8.07 |

*SPEC = specified wind load
+FACT = factored wind load

TABLE X(c)

BEAM COMBINED WIND AND AXIAL LOAD TABLE
MAXIMUM FACTORED AXIAL LOAD (kips) 24" c/c
(Alternate Embodiment) "Limit States"

| DEPTH | | WIND SPEC* | WIND FACT+ | LENGTH | | | | | | | | |
|---|---|---|---|---|---|---|---|---|---|---|---|---|
| in. | GAUGE | psf. | psf. | 8'-0" | 8'-6" | 9'-0" | 9'-6" | 10'-0" | 10'-6" | 11'-0" | 11'-6" | 12'-0" |
| 6 | 18 | 10 | 15 | 6.44 | 6.36 | 6.29 | 6.19 | 6.09 | 5.99 | 5.86 | 5.74 | 5.62 |
| | | 20 | 30 | 6.04 | 5.89 | 5.73 | 5.53 | 5.33 | 5.13 | 4.89 | 4.64 | 4.39 |
| | | 30 | 45 | 5.64 | 5.41 | 5.18 | 4.88 | 4.58 | 4.28 | 3.91 | 3.54 | 3.17 |
| | | 40 | 60 | 5.24 | 4.93 | 4.62 | 4.23 | 3.83 | 3.42 | 2.93 | 2.44 | 1.95 |
| | | 50 | 75 | 4.84 | 4.46 | 4.07 | 3.57 | 3.08 | 2.57 | 1.96 | 1.34 | 0.73 |
| | 16 | 10 | 15 | 8.51 | 8.43 | 8.35 | 8.25 | 8.15 | 8.05 | 7.92 | 7.80 | 7.68 |
| | | 20 | 20 | 8.10 | 7.95 | 7.79 | 7.59 | 7.39 | 7.19 | 6.94 | 6.69 | 6.44 |
| | | 30 | 45 | 7.70 | 7.47 | 7.23 | 6.93 | 6.63 | 6.33 | 5.95 | 5.58 | 5.21 |
| | | 40 | 60 | 7.30 | 6.99 | 6.67 | 6.27 | 5.87 | 5.46 | 4.97 | 4.47 | 3.97 |
| | | 50 | 75 | 6.89 | 6.50 | 6.11 | 5.61 | 5.11 | 4.60 | 3.98 | 3.36 | 2.74 |
| | 14 | 10 | 15 | 10.74 | 10.66 | 10.58 | 10.48 | 10.38 | 10.28 | 10.15 | 10.03 | 9.90 |
| | | 20 | 20 | 10.33 | 10.18 | 10.02 | 9.82 | 9.61 | 9.40 | 9.15 | 8.90 | 8.65 |
| | | 30 | 45 | 9.93 | 9.69 | 9.45 | 9.15 | 8.84 | 8.53 | 8.16 | 7.78 | 7.40 |
| | | 40 | 60 | 9.52 | 9.20 | 8.88 | 8.48 | 8.07 | 7.66 | 7.16 | 6.66 | 6.15 |
| | | 50 | 75 | 9.11 | 8.72 | 8.32 | 7.81 | 7.30 | 6.78 | 6.16 | 5.53 | 4.90 |
| 8 | 18 | 10 | 15 | 6.47 | 6.40 | 6.33 | 6.23 | 6.14 | 6.04 | 5.93 | 5.83 | 5.69 |
| | | 20 | 20 | 6.10 | 5.96 | 5.81 | 5.63 | 5.44 | 5.25 | 5.01 | 4.82 | 4.54 |
| | | 30 | 45 | 5.74 | 5.52 | 5.30 | 5.02 | 4.74 | 4.45 | 4.10 | 3.81 | 3.40 |
| | | 40 | 60 | 5.37 | 5.08 | 4.79 | 4.41 | 4.03 | 3.65 | 3.19 | 2.80 | 2.25 |
| | | 50 | 75 | 5.00 | 4.64 | 4.28 | 3.80 | 3.33 | 2.85 | 2.27 | 1.79 | 1.10 |
| | 16 | 10 | 15 | 8.54 | 8.47 | 8.39 | 8.30 | 8.20 | 8.10 | 7.99 | 7.89 | 7.75 |

TABLE X(c)-continued

BEAM COMBINED WIND AND AXIAL LOAD TABLE
MAXIMUM FACTORED AXIAL LOAD (kips) 24" c/c
(Alternate Embodiment) "Limit States"

| DEPTH | | WIND | | LENGTH | | | | | | | | |
|---|---|---|---|---|---|---|---|---|---|---|---|---|
| | | SPEC* | FACT+ | | | | | | | | | |
| in. | GAUGE | psf. | psf. | 8'-0" | 8'-6" | 9'-0" | 9'-6" | 10'-0" | 10'-6" | 11'-0" | 11'-6" | 12'-0" |
| | | 20 | 20 | 8.17 | 8.02 | 7.87 | 7.68 | 7.49 | 7.30 | 7.06 | 6.87 | 6.59 |
| | | 30 | 45 | 7.80 | 7.58 | 7.36 | 7.07 | 6.78 | 6.49 | 6.14 | 5.85 | 5.43 |
| | | 40 | 60 | 7.42 | 7.13 | 6.84 | 6.46 | 6.07 | 5.69 | 5.22 | 4.83 | 4.27 |
| | | 50 | 75 | 7.05 | 6.69 | 6.32 | 5.84 | 5.37 | 4.88 | 4.30 | 3.81 | 3.11 |
| | 14 | 10 | 15 | 10.80 | 10.70 | 10.63 | 10.53 | 10.43 | 10.33 | 10.24 | 10.12 | 10.00 |
| | | 20 | 20 | 10.44 | 10.25 | 10.10 | 9.91 | 9.71 | 9.52 | 9.32 | 9.08 | 8.84 |
| | | 30 | 45 | 10.09 | 9.80 | 9.58 | 9.29 | 9.00 | 8.70 | 8.41 | 8.05 | 7.69 |
| | | 40 | 60 | 9.73 | 9.35 | 9.05 | 8.67 | 8.28 | 7.89 | 7.49 | 7.01 | 6.53 |
| | | 50 | 75 | 9.38 | 8.90 | 8.53 | 8.05 | 7.56 | 7.07 | 6.58 | 5.98 | 5.38 |

*SPEC = specified wind load
+FACT = factored wind load

TABLE XI(a)

LIMITING LOAD FOR SCREW FASTENER CONFIGURATIONS
(Alternate Embodiment) 12" Spacing "Limit States"

| Factored Load (psf) | | | | | | | | | | | |
|---|---|---|---|---|---|---|---|---|---|---|---|
| Beam | | Connection | Beam Length (ft) | | | | | | | | |
| Description | | Type | 8 | 8-½ | 9 | 9-½ | 10 | 10-½ | 11 | 11-½ | 12 |
| 6" | 18Ga | A | 239 | 201 | — | — | — | — | — | — | — |
| | | B | 219 | 194 | 173 | 147 | 129 | 114 | 99 | 89 | 80 |
| | | C | 131 | 116 | 104 | 92 | 84 | 75 | 69 | 63 | 57 |
| | | D | 110 | 96 | 86 | 77 | 69 | 63 | 57 | 53 | 48 |
| | | E | 65 | 57 | 51 | 47 | 42 | 38 | 35 | 32 | 29 |
| | 16Ga | A | 309 | 260 | 224 | 191 | 167 | — | — | — | — |
| | | B | 260 | 228 | 204 | 183 | 165 | 147 | 129 | 114 | 102 |
| | | C | 155 | 137 | 122 | 110 | 99 | 89 | 81 | 74 | 68 |
| | | D | 129 | 114 | 102 | 92 | 83 | 74 | 68 | 62 | 57 |
| | | E | 78 | 68 | 60 | 54 | 50 | 44 | 41 | 38 | 33 |
| | 14Ga | A | 395 | 321 | 278 | 236 | — | — | — | — | 122 |
| | | B | 329 | 291 | 260 | 234 | 206 | 182 | 159 | 144 | 128 |
| | | C | 197 | 174 | 156 | 140 | 126 | 114 | 104 | 95 | 87 |
| | | D | 165 | 14.6 | 131 | 117 | 105 | 95 | 87 | 80 | 72 |
| | | E | 99 | 87 | 78 | 69 | 63 | 57 | 51 | 47 | 44 |
| | 18Ga | A | — | — | — | — | — | — | — | — | — |
| | | B | 266 | 224 | 192 | 162 | 141 | 125 | 108 | 98 | 87 |
| | | C | 162 | 144 | 128 | 116 | 104 | 95 | 86 | 78 | 72 |
| | | D | 129 | 114 | 102 | 92 | 83 | 75 | 68 | 62 | 57 |
| | | E | 81 | 72 | 63 | 57 | 51 | 47 | 42 | 39 | 36 |
| | 16Ga | A | 363 | 288 | 248 | — | — | — | — | — | — |
| | | B | 305 | 270 | 240 | 210 | 182 | 161 | 140 | 126 | 114 |
| | | C | 192 | 170 | 152 | 135 | 123 | 111 | 101 | 92 | 84 |
| | | D | 153 | 135 | 120 | 108 | 98 | 87 | 80 | 74 | 68 |
| | | E | 96 | 86 | 75 | 68 | 62 | 56 | 50 | 45 | 42 |
| | 14Ga | A | 447 | 356 | — | — | — | — | — | — | — |
| | | B | 389 | 344 | 306 | 260 | 225 | 198 | 177 | 156 | 141 |
| | | C | 245 | 216 | 192 | 174 | 156 | 141 | 129 | 117 | 106 |
| | | D | 194 | 173 | 153 | 138 | 125 | 113 | 102 | 93 | 86 |
| | | E | 122 | 108 | 96 | 87 | 78 | 71 | 65 | 59 | 54 |

| Factored Load (psf) | | | | | | | | | | | |
|---|---|---|---|---|---|---|---|---|---|---|---|
| Beam | | Connection | Beam Length (ft) | | | | | | | | |
| Description | | Type | 13 | 14 | 15 | 16 | 17 | 18 | 19 | 20 | 22 | 24 |
| 6" | 18Ga | A | — | — | — | — | — | — | — | 33 | 26 | — |
| | | B | 75 | 63 | 53 | 45 | 44 | 38 | 33 | — | — | 23 |
| | | C | 57 | 48 | 42 | 38 | 38 | 33 | 30 | 30 | 24 | 20 |
| | | D | 39 | 33 | 30 | 26 | 24 | 21 | 20 | 18 | 15 | 14 |
| | | E | 29 | 24 | 21 | 18 | 18 | 17 | 15 | 15 | 12 | 11 |
| | 16Ga | A | 98 | — | — | — | 57 | — | — | 42 | 33 | 30 |

TABLE XI(a)-continued

LIMITING LOAD FOR SCREW FASTENER CONFIGURATIONS
(Alternate Embodiment) 12" Spacing "Limit States"

| | | | | | | | | | | | | |
|---|---|---|---|---|---|---|---|---|---|---|---|---|
| | | B | 93 | 81 | 69 | 59 | 56 | 50 | 44 | — | — | 27 |
| | | C | 68 | 57 | 5o | 44 | 44 | 39 | 35 | 36 | 29 | 24 |
| | | D | 47 | 41 | 35 | 30 | 29 | 26 | 23 | 21 | 18 | 17 |
| | | E | 33 | 29 | 24 | 21 | 21 | 20 | 18 | 18 | 14 | 14 |
| | 14Ga | A | 122 | — | — | — | — | — | — | 53 | 42 | 36 |
| | | B | 120 | 101 | 84 | 72 | 71 | 62 | 54 | — | — | 35 |
| | | C | 86 | 74 | 65 | 56 | 56 | 50 | 45 | 45 | 38 | 32 |
| | | D | 60 | 51 | 45 | 39 | 36 | 33 | 29 | 29 | 23 | 21 |
| | | E | 42 | 36 | 32 | 29 | 29 | 26 | 23 | 23 | 18 | 17 |
| 8" | 18Ga | A | — | — | — | — | — | — | — | — | — | — |
| | | B | 86 | 71 | 59 | 50 | 50 | 44 | — | 38 | — | 27 |
| | | C | 72 | 62 | 53 | 47 | 48 | 42 | 38 | 36 | 30 | 24 |
| | | D | 47 | 41 | 35 | 30 | 29 | 26 | 23 | 23 | 18 | 17 |
| | | E | 36 | 30 | 27 | 23 | 24 | 21 | 18 | 20 | 15 | 15 |
| | 16Ga | A | — | — | — | — | — | — | — | 50 | 39 | — |
| | | B | 110 | 92 | 77 | 65 | 65 | 56 | 50 | 45 | 38 | 35 |
| | | C | 84 | 72 | 63 | 56 | 56 | 50 | 45 | 42 | 35 | 29 |
| | | D | 56 | 48 | 41 | 36 | 35 | 30 | 27 | 26 | 21 | 20 |
| | | E | 42 | 36 | 32 | 27 | 27 | 24 | 23 | 23 | 18 | 17 |
| | | A | — | — | — | — | — | — | — | 60 | — | — |
| | | B | 137 | 113 | 95 | 81 | 80 | 69 | 60 | 59 | 48 | 42 |

Printout cancelled by operator.

TABLE XI(b)

LIMITING LOAD FOR SCREW FASTENER CONFIGURATIONS
(Alternate Embodiment) 16" Spacing "Limit States"

Factored Load (psf)

| Beam Description | | Connection Type | Beam Length (ft) 8 | 8-½ | 9 | 9-½ | 10 | 10-½ | 11 | 11-½ | 12 |
|---|---|---|---|---|---|---|---|---|---|---|---|
| 6" | 18Ga | A | 179 | 151 | — | — | — | — | — | — | — |
| | | B | 164 | 145 | 129 | 110 | 97 | 86 | 74 | 66 | 60 |
| | | C | 98 | 87 | 78 | 69 | 63 | 56 | 52 | 47 | 43 |
| | | D | 82 | 72 | 64 | 57 | 52 | 47 | 43 | 39 | 36 |
| | | E | 48 | 43 | 38 | 35 | 32 | 28 | 26 | 24 | 21 |
| | 16Ga | A | 232 | 195 | 168 | 143 | 125 | — | — | — | — |
| | | B | 195 | 171 | 153 | 137 | 124 | 110 | 97 | 86 | 77 |
| | | C | 116 | 102 | 91 | 82 | 74 | 66 | 61 | 55 | 51 |
| | | D | 97 | 86 | 77 | 69 | 62 | 55 | 51 | 46 | 43 |
| | | E | 59 | 51 | 45 | 41 | 37 | 33 | 30 | 28 | 25 |
| | 14Ga | A | 296 | 241 | 208 | 177 | — | — | — | — | — |
| | | B | 246 | 218 | 195 | 176 | 154 | 136 | 119 | 108 | 96 |
| | | C | 147 | 131 | 117 | 105 | 95 | 86 | 78 | 71 | 65 |
| | | D | 124 | 109 | 98 | 88 | 79 | 71 | 65 | 60 | 54 |
| | | E | 74 | 65 | 59 | 52 | 47 | 43 | 38 | 35 | 33 |
| 8" | 18Ga | A | — | — | — | — | — | — | — | — | — |
| | | B | 199 | 168 | 144 | 122 | 106 | 93 | 81 | 73 | 65 |
| | | C | 122 | 108 | 96 | 87 | 78 | 71 | 64 | 59 | 54 |
| | | D | 97 | 86 | 77 | 69 | 62 | 56 | 51 | 46 | 43 |
| | | E | 61 | 54 | 47 | 43 | 38 | 35 | 32 | 29 | 27 |
| | 16Ga | A | 272 | 216 | 186 | — | — | — | — | — | — |
| | | B | 228 | 203 | 180 | 158 | 136 | 120 | 105 | 95 | 86 |
| | | C | 144 | 127 | 114 | 101 | 92 | 83 | 75 | 69 | 63 |
| | | D | 115 | 101 | 90 | 81 | 73 | 65 | 60 | 55 | 51 |
| | | B | 72 | 64 | 56 | 51 | 46 | 42 | 37 | 34 | 32 |
| | 14Ga | A | 335 | 267 | — | — | — | — | — | — | — |
| | | B | 291 | 258 | 230 | 195 | 169 | 149 | 133 | 117 | 106 |
| | | C | 183 | 162 | 144 | 131 | 117 | 106 | 97 | 88 | 81 |
| | | D | 145 | 129 | 115 | 104 | 93 | 84 | 77 | 70 | 64 |
| | | E | 91 | 81 | 72 | 65 | 59 | 53 | 48 | 44 | 41 |

Factored Load (psf)

| Beam Description | | Connection Type | Beam Length (ft) 13 | 14 | 15 | 16 | 17 | 18 | 19 | 20 | 22 | 24 |
|---|---|---|---|---|---|---|---|---|---|---|---|---|
| 6" | 18Ga | A | — | — | — | — | — | — | — | 25 | 19 | — |
| | | B | 56 | 47 | 39 | 34 | 33 | 28 | 25 | — | — | 17 |

TABLE XI(b)-continued

LIMITING LOAD FOR SCREW FASTENER CONFIGURATIONS
(Alternate Embodiment) 16" Spacing "Limit States"

| | | | | | | | | | | | | |
|---|---|---|---|---|---|---|---|---|---|---|---|---|
| | | C | 43 | 36 | 32 | 28 | 28 | 25 | 23 | 23 | 18 | 15 |
| | | D | 29 | 25 | 23 | 19 | 18 | 16 | 15 | 14 | 11 | 10 |
| | 16Ga | E | 21 | 18 | 16 | 14 | 14 | 12 | 11 | 11 | 9 | 8 |
| | | A | 73 | — | — | — | 43 | — | — | 32 | 25 | 23 |
| | | B | 70 | 61 | 52 | 44 | 42 | 37 | 33 | — | — | 20 |
| | | C | 51 | 43 | 37 | 33 | 33 | 29 | 26 | 27 | 21 | 18 |
| | | D | 35 | 30 | 26 | 23 | 21 | 19 | 17 | 16 | 14 | 12 |
| | | E | 25 | 21 | 18 | 16 | 16 | 15 | 14 | 14 | 10 | 10 |
| | 14Ga | A | 91 | — | — | — | — | — | — | 39 | 32 | 27 |
| | | B | 90 | 75 | 63 | 54 | 53 | 46 | 41 | — | — | 26 |
| | | C | 64 | 55 | 48 | 42 | 42 | 37 | 34 | 34 | 28 | 24 |
| | | D | 45 | 38 | 34 | 29 | 27 | 25 | 21 | 21 | 17 | 16 |
| | | E | 32 | 27 | 24 | 21 | 21 | 19 | 17 | 17 | 14 | 12 |
| 8" | 18Ga | A | — | — | — | — | — | — | — | — | — | — |
| | | B | 64 | 53 | 44 | 37 | 37 | 33 | — | 28 | — | 20 |
| | | C | 54 | 46 | 39 | 35 | 36 | 32 | 28 | 27 | 23 | 18 |
| | | D | 35 | 30 | 26 | 23 | 21 | 19 | 17 | 17 | 14 | 12 |
| | 16Ga | E | 27 | 23 | 20 | 17 | 18 | 16 | 14 | 15 | 11 | 11 |
| | | A | — | — | — | — | — | — | — | 37 | 29 | — |
| | | B | 82 | 69 | 57 | 48 | 46 | 42 | 37 | 34 | 28 | 26 |
| | | C | 63 | 54 | 47 | 42 | 42 | 37 | 34 | 32 | 26 | 21 |
| | | D | 42 | 36 | 30 | 27 | 26 | 23 | 20 | 19 | 16 | 15 |
| | | E | 32 | 27 | 24 | 20 | 20 | 18 | 17 | 17 | 14 | 12 |
| | 14Ga | A | — | — | — | — | — | — | — | 45 | — | — |
| | | B | 102 | 84 | 71 | 61 | 60 | 52 | 45 | 44 | 36 | 32 |
| | | C | 81 | 69 | 61 | 53 | 54 | 47 | 43 | 41 | 34 | 27 |
| | | D | 53 | 45 | 39 | 35 | 33 | 29 | 26 | 25 | 20 | 18 |
| | | E | 41 | 35 | 30 | 26 | 27 | 24 | 21 | 21 | 18 | 17 |

TABLE XI(c)

LIMITING LOAD FOR SCREW FASTENER CONFIGURATIONS
(Alternate Embodiment) 24" Spacing "Limit States"

| Factored Load (psf) | | | | | | | | | | | |
|---|---|---|---|---|---|---|---|---|---|---|---|
| Beam | | Connection | Beam Length (ft) | | | | | | | | |
| Description | | Type | 8 | 8-½ | 9 | 9-½ | 10 | 10-½ | 11 | 11-½ | 12 |
| 6" | 18Ga | A | 119 | 101 | — | — | — | — | — | — | — |
| | | B | 110 | 97 | 86 | 74 | 65 | 57 | 50 | 44 | 40 |
| | | C | 65 | 58 | 52 | 46 | 42 | 38 | 35 | 32 | 29 |
| | | D | 55 | 48 | 43 | 38 | 35 | 32 | 29 | 26 | 24 |
| | | E | 32 | 29 | 26 | 23 | 21 | 19 | 17 | 16 | 141 |
| | 16Ga | A | 155 | 130 | 112 | 95 | 83 | — | — | — | — |
| | | B | 130 | 114 | 102 | 92 | 83 | 74 | 65 | 57 | 51 |
| | | C | 77 | 68 | 61 | 55 | 50 | 44 | 41 | 37 | 34 |
| | | D | 65 | 57 | 51 | 46 | 41 | 37 | 34 | 31 | 29 |
| | | E | 39 | 34 | 30 | 27 | 25 | 22 | 20 | 19 | 17 |
| | 14Ga | A | 197 | 161 | 139 | 118 | — | — | — | — | — |
| | | B | 164 | 146 | 130 | 117 | 103 | 91 | 80 | 72 | 64 |
| | | C | 98 | 87 | 78 | 70 | 63 | 57 | 52 | 47 | 44 |
| | | D | 83 | 73 | 65 | 59 | 53 | 47 | 44 | 40 | 36 |
| | | E | 50 | 44 | 39 | 35 | 32 | 29 | 26 | 23 | 22 |
| 8" | 18Ga | A | — | — | — | — | — | — | — | — | — |
| | | B | 133 | 112 | 96 | 81 | 71 | 62 | 54 | 49 | 44 |
| | | C | 81 | 72 | 64 | 58 | 52 | 47 | 43 | 39 | 36 |
| | | D | 65 | 57 | 51 | 46 | 41 | 38 | 34 | 31 | 29 |
| | | E | 41 | 36 | 32 | 29 | 26 | 23 | 21 | 20 | 18 |
| | 16Ga | A | 182 | 144 | 124 | — | — | — | — | — | — |
| | | B | 152 | 135 | 120 | 105 | 91 | 80 | 70 | 63 | 57 |
| | | C | 96 | 85 | 76 | 68 | 62 | 56 | 50 | 46 | 42 |
| | | D | 77 | 68 | 60 | 54 | 49 | 44 | 40 | 37 | 34 |
| | | E | 48 | 43 | 38 | 34 | 31 | 28 | 25 | 23 | 21 |
| | 14Ga | A | 224 | 178 | — | — | — | — | — | — | — |
| | | B | 194 | 172 | 153 | 130 | 113 | 99 | 89 | 78 | 71 |
| | | C | 122 | 108 | 96 | 67 | 78 | 71 | 65 | 59 | 54 |
| | | D | 97 | 86 | 77 | 69 | 62 | 56 | 51 | 47 | 43 |
| | | E | 61 | 54 | 48 | 44 | 39 | 35 | 32 | 29 | 27 |

TABLE XI(c)-continued

LIMITING LOAD FOR SCREW FASTENER CONFIGURATIONS
(Alternate Embodiment) 24" Spacing "Limit States"

Factored Load (psf)

| Beam Description | | Connection Type | Beam Length (ft) 13 | 14 | 15 | 16 | 17 | 18 | 19 | 20 | 22 | 24 |
|---|---|---|---|---|---|---|---|---|---|---|---|---|
| 6" | 18Ga | A | — | — | — | — | — | — | — | 17 | 13 | — |
| | | B | 38 | 32 | 26 | 23 | 22 | 19 | 17 | — | — | 11 |
| | | C | 29 | 24 | 21 | 19 | 19 | 17 | 15 | 15 | 12 | 10 |
| | | D | 20 | 17 | 15 | 13 | 12 | 11 | 10 | 9 | 8 | 7 |
| | | E | 14 | 12 | 11 | 9 | 9 | 8 | 8 | 8 | 6 | 5 |
| | 16Ga | A | 49 | — | — | — | 29 | — | — | 21 | 17 | 15 |
| | | B | 47 | 41 | 35 | 29 | 28 | 25 | 22 | — | — | 14 |
| | | C | 34 | 29 | 25 | 22 | 22 | 20 | 17 | 18 | 14 | 12 |
| | | D | 23 | 20 | 17 | 15 | 14 | 13 | 11 | 11 | 9 | 8 |
| | | E | 17 | 14 | 12 | 11 | 11 | 10 | 9 | 9 | 7 | 7 |
| | 14Ga | A | 61 | — | — | — | — | — | — | 26 | 21 | 18 |
| | | B | 60 | 50 | 42 | 36 | 25 | 31 | 27 | — | — | 17 |
| | | C | 43 | 37 | 32 | 28 | 28 | 25 | 23 | 23 | 19 | 16 |
| | | D | 30 | 26 | 23 | 20 | 18 | 17 | 14 | 14 | 11 | 11 |
| | | E | 21 | 18 | 16 | 14 | 14 | 13 | 11 | 11 | 9 | 8 |
| 8" | 18Ga | A | — | — | — | — | — | — | — | — | — | — |
| | | B | 43 | 35 | 29 | 25 | 25 | 22 | — | 19 | — | 14 |
| | | C | 36 | 31 | 26 | 23 | 24 | 21 | 19 | 18 | 15 | 12 |
| | | D | 23 | 20 | 17 | 15 | 14 | 13 | 11 | 11 | 9 | 8 |
| | | E | 18 | 15 | 14 | 11 | 12 | 11 | 9 | 10 | 8 | 7 |
| | 16Ga | A | — | — | — | — | — | — | — | 25 | 20 | — |
| | | B | 55 | 46 | 38 | 32 | 32 | 28 | 25 | 23 | 19 | 17 |
| | | C | 42 | 36 | 32 | 28 | 28 | 25 | 23 | 21 | 17 | 14 |
| | | D | 28 | 24 | 20 | 18 | 17 | 15 | 14 | 13 | 11 | 10 |
| | | E | 21 | 18 | 16 | 14 | 14 | 12 | 11 | 11 | 9 | 8 |
| | 14Ga | A | — | — | — | — | — | — | — | 30 | — | — |
| | | B | 68 | 56 | 47 | 41 | 40 | 35 | 30 | 29 | 24 | 21 |
| | | C | 54 | 46 | 41 | 35 | 36 | 32 | 29 | 27 | 23 | 16 |
| | | D | 35 | 30 | 26 | 23 | 22 | 20 | 17 | 17 | 14 | 12 |
| | | E | 27 | 23 | 20 | 17 | 18 | 16 | 14 | 14 | 12 | 11 |

TABLE XII

Screw and Web Configuration Codes

| Beam Configuration Code | First Position | Second Position | Third Position | Fourth Position | Fifth Position | Sixth Position | Seventh Position | Eighth Position | Ninth Position |
|---|---|---|---|---|---|---|---|---|---|
| FOR BEAMS 9'-0" TO 12'-0" (5 WEBS) | | | | | | | | | |
| A | 4 | 4 | 1 | 4 | 4 | | | | |
| B | 4 | 2 | 1 | 2 | 4 | | | | |
| C | 2 | 2 | 1 | 2 | 2 | | | | |
| D | 2 | 1 | 1 | 1 | 2 | | | | |
| E | 1 | 1 | 1 | 1 | 1 | | | | |
| FOR BEAMS 13'-0" TO 16'-0" (6 WEBS) | | | | | | | | | |
| A | 4 | 4 | 1 | 1 | 4 | 4 | | | |
| B | 4 | 2 | 1 | 1 | 2 | 4 | | | |
| C | 2 | 2 | 1 | 1 | 2 | 2 | | | |
| D | 2 | 1 | 1 | 1 | 1 | 2 | | | |
| E | 1 | 1 | 1 | 1 | 1 | 1 | | | |
| FOR BEAMS 17'-0" TO 19'-0" (7 WEBS) | | | | | | | | | |
| A | 4 | 2 | 2 | 1 | 2 | 2 | 4 | | |
| B | 4 | 2 | 1 | 1 | 1 | 2 | 4 | | |
| C | 2 | 2 | 1 | 1 | 1 | 2 | 2 | | |
| D | 2 | 1 | i | 1 | 1 | 1 | 2 | | |
| E | 1 | 1 | 1 | 1 | 1 | 1 | 1 | | |
| FOR BEAMS 20'-0" AND 22'-0" (8 WEBS) | | | | | | | | | |
| A | 4 | 2 | 2 | 1 | 1 | 2 | 2 | 4 | |
| B | 2 | 2 | 2 | 1 | 1 | 2 | 2 | 2 | |
| C | 2 | 2 | 1 | 1 | 1 | 1 | 2 | 2 | |
| D | 2 | 1 | 1 | 1 | 1 | 1 | 1 | 2 | |
| E | 1 | 1 | 1 | 1 | 1 | 1 | 1 | 1 | |

TABLE XII-continued

| Beam Configuration Code | First Position | Second Position | Third Position | Fourth Position | Fifth Position | Sixth Position | Seventh Position | Eighth Position | Ninth Position |
|---|---|---|---|---|---|---|---|---|---|
| | Screw and Web Configuration Codes | | | | | | | | |
| | FOR BEAM 24'-0" (9 WEBS) | | | | | | | | |
| A | 4 | 2 | 2 | 1 | 1 | 1 | 2 | 2 | 4 |
| B | 2 | 2 | 2 | 1 | 1 | 1 | 2 | 2 | 2 |
| C | 2 | 2 | 1 | 1 | 1 | 1 | 1 | 2 | 2 |
| D | 2 | 1 | 1 | 1 | 1 | 1 | 1 | 1 | 2 |
| E | 1 | 1 | 1 | 1 | 1 | 1 | 1 | 1 | 1 |

I claim:

1. A kit of parts for on-site construction of a plurality of beams for inclusion in a frame of a building structure, such as a floor, ceiling or wall, which structure is required to be capable of bearing a maximum load selected from a predetermined range of loads, comprising:

a plurality of substantially identical tubular, rectangular, metal chords;

a plurality of substantially identical webs, each web comprising at least one channel-shaped portion having a central wall and two opposing side walls which terminate at different positions along a longitudinal axis of the channel-shaped portion in order to locate first and second chords such that the first and second chords are disposed at opposing ends of the web in substantially parallel fashion and the longitudinal axis of the channel-shaped portion is orientated at a predetermined angle to the first and second chords, and a flat, tag portion at each end of the channel-shaped portion, the flat, tag portion being substantially continuous with the central wall of the channel-shaped portion;

a plurality of screws;

wherein each web includes first and second plural numbers of screw indicators on the flat tag portions thereof for fastening the first and second chords respectively to the web, the indicators being located to permit up to the first and second numbers of said screws, respectively, to be installed through the web for fastening each web to the first and second chords;

wherein each chord presents a lengthwise continuous, substantially non-perforated face to permit location of each of a plurality of spaced apart webs at any lengthwise point along the beam, as required to bear the load, for receipt of the screws through the web at the indicator locations so as to pierce and pass through the metal of the chord; and wherein the chords and webs are each of a gauge to permit on-site installation of the screws using a hand-held tool.

2. The kit of parts of claim 1 wherein each indicator comprises an aperture for receipt of a said screw therethrough.

3. The kit of parts of claim 2 wherein each web further comprises first and second legs in the general shape of a "V" and one of said flat, tag portions of the web is located at a base thereof and one of said flat, tag portions of the web is located at an end of each said leg distal to the base.

4. The kit of parts of claim 3 wherein the metal of the chords has a gauge of between about 18 GA and 14 GA.

5. The kit of parts of claim 4, wherein said screws are self-tapping screws.

6. The kit of parts of claim 4 wherein each set of indicators comprises three holes.

7. A kit of parts for on site construction of a plurality of beams for inclusion in a frame of a building structure, such as a floor, ceiling or wall, which structure is required to be capable of bearing a maximum load, comprising:

a plurality of rectangular, tubular, metallic chords;

a plurality of screws;

a plurality of webs, each web comprising at least one channel-shaped portion having a central wall and two opposing side walls which terminate at different positions along a longitudinal axis of the channel-shaped portion in order to locate first and second chords such that the first and second chords are disposed at opposing ends of the web in substantially parallel fashion and the longitudinal axis of the channel-shaped portion is orientated at an angle to the first and second chords, and a flat, tag portion at each end of the channel-shaped portion, the flat, tag portion being substantially continuous with the central wall of the channel-shaped portion;

wherein each beam, when constructed, comprises first and second chords joined together by a specified number of spaced apart webs, and screws which fasten the webs to the first and second chords, the number of webs for each said beam and the number of screws for each web thereof being selected according to a recipe which determines a substantial minimal number of webs and screws required for each beam in order for said building structure to withstand the maximum load at a given length and depth of beam at a given beam spacing;

each web including first and second plural numbers of screw indicator locations on the opposing flat, tag portions of the web for fastening the first and second chords respectively to the web, the indicators being located to permit up to a first and second numbers of said screws, respectively, to be installed through the web for fastening each of said specified number of webs to the first and second chords; and wherein each cord presents opposing lengthwise continuous faces for location of each of a given number of spaced apart webs at any lengthwise point along any side of the beam, for receipt of the screws through the web at the indicator locations so as to pierce and pass through the metal of the chord.

8. The kit according to claim 7 wherein the web comprises two channel-shaped portions arranged in a "V"-shape.

* * * * *